US008334862B2

(12) United States Patent
Shirai

(10) Patent No.: US 8,334,862 B2
(45) Date of Patent: Dec. 18, 2012

(54) DISPLAY PANEL DRIVE TECHNIQUE FOR REDUCING POWER CONSUMPTION

(75) Inventor: Hiroaki Shirai, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1149 days.

(21) Appl. No.: 11/889,910

(22) Filed: Aug. 17, 2007

(65) Prior Publication Data

US 2008/0043012 A1 Feb. 21, 2008

(30) Foreign Application Priority Data

Aug. 18, 2006 (JP) ..... 2006-223398

(51) Int. Cl.
*G09G 5/00* (2006.01)

(52) U.S. Cl. ..... 345/208; 345/99; 345/100

(58) Field of Classification Search ..... 345/98–100, 345/103, 94, 96, 208–209
See application file for complete search history.

(56) References Cited

U.S. PATENT DOCUMENTS

| | | | | |
|---|---|---|---|---|
| 7,088,328 | B2 | 8/2006 | Inada et al. | |
| 2004/0179014 | A1 | 9/2004 | Nakano et al. | |
| 2005/0140633 | A1* | 6/2005 | Kato | 345/96 |
| 2007/0091050 | A1* | 4/2007 | Katayama et al. | 345/98 |

FOREIGN PATENT DOCUMENTS

| | | | |
|---|---|---|---|
| JP | 10-326090 | A | 12/1998 |
| JP | 11-327518 | | 11/1999 |
| JP | 2003-215540 | A | 7/2003 |
| JP | 2003-330423 | A | 11/2003 |
| JP | 2004-264476 | A | 9/2004 |
| JP | 2004-354758 | A | 12/2004 |
| JP | 2005-43418 | | 2/2005 |
| JP | 2006-154772 | A | 6/2006 |
| JP | 2005-92176 | A | 4/2007 |
| JP | 2007-140296 | A | 6/2007 |
| JP | 2007-171567 | A | 7/2007 |

OTHER PUBLICATIONS

Japanese Office Action dated Dec. 5, 2011, with partial English translation.

Japanese Office Action dated Aug. 17, 2012 with English Translation.

* cited by examiner

*Primary Examiner* — Chanh Nguyen
*Assistant Examiner* — Allison Walthall
(74) *Attorney, Agent, or Firm* — McGinn IP Law Group, PLLC

(57) ABSTRACT

A method is provided for operating a display apparatus in which one source output of a source driver is connected with first to N-th data lines through first to N-th time division switches, which method includes: driving a first pixel positioned in a first horizontal line and connected with one of the first to N-th data lines, by feeding a first drive voltage to the one of the first to N-th data lines from the one source output with associated one of the first to N-th time division switches; and driving a second pixel positioned in a second horizontal line next to the first horizontal line and connected with the one of the first to N-th data lines, by feeding a second drive voltage to the one of the first to N-th data lines from the source output with associated one of the first to N-th time division switches. The associated one time division switch is kept turned on during a time period from a start time of the driving the first pixel to a start time of the driving the second pixel.

10 Claims, 43 Drawing Sheets

R:DRIVE VOLTAGES OF PIXELS 11R
G:DRIVE VOLTAGES OF PIXELS 11G
B:DRIVE VOLTAGES OF PIXELS 11B

R:DRIVE VOLTAGES OF PIXELS 11R
G:DRIVE VOLTAGES OF PIXELS 11G
B:DRIVE VOLTAGES OF PIXELS 11B

R:DRIVE VOLTAGES OF PIXELS 11R
G:DRIVE VOLTAGES OF PIXELS 11G
B:DRIVE VOLTAGES OF PIXELS 11B

DISPLAY PANEL DRIVE TECHNIQUE FOR REDUCING POWER CONSUMPTION

BACKGROUND OF THE INVENTION

1. Field of the Invention

The present invention relates to a display apparatus and, more specifically, to a technique for time-divisionally driving a plurality of data lines by a single amplifier.

2. Description of the Related Art

Due to the recent requirement of improved resolution, display panels are required to have an increased number of data lines (or signal lines), with reduced spacing between adjacent data lines. One problem caused by the increase in the number of signal lines and the decrease in the spacing therebetween is the difficulty in providing sufficient pitches for external wirings that provides electrical connections between data lines to a display panel driver. The decrease in the spacing between the data lines decreases the pitch allowed to the external wirings, which makes it difficult to connect the display panel with the display panel driver for driving the display panel. Another problem is the increase in the number of amplifiers used to drive the data lines within the display driver. The increase in the number of amplifiers undesirably makes the driver large-scaled and increases the cost of the display driver.

One approach for overcoming such problems it to time-divisionally drives a plurality of data lines by a single amplifier. For example, Japanese Laid-Open Patent Application No. Jp-A Heisei 11-327518 discloses a liquid crystal display apparatus that is designed to drive three data lines by a single amplifier.

FIG. 1 illustrates the structure of the liquid crystal display apparatus disclosed in this Japanese Laid-Open Patent Application. The liquid crystal display apparatus of FIG. 1 includes; a liquid crystal display panel 100; a common voltage generator circuit 104; a driver IC 107; and a switch control circuit 108. The liquid crystal display panel 100 includes: gate lines (scanning lines) 101: data lines 102R, 102G, and 102B; and a common electrode 103. Pixels are provided at respective intersections of the gate lines 101 and the data lines 102R, 102G, 102B. The gate lines 101 are driven by a vertical drive circuit 105. Switches 106R, 106G, and 106B are provided for the data lines 102R, 102G, and 102B, respectively, and each set of the switches 106R, 106G, and 106B are commonly connected to the same output of the driver IC. The switches 106R, 106G, and 106B are turned on and off by switch control pulses SL1, SL2, and SL3 received from a switch control circuit 108, respectively. The data lines to be driven are selected by the switches 106R, 106G, and 106B.

The driver IC 107 includes sampling circuits 111, memories 112, D/A converters 113, and output amplifiers 114. Pixel data of respective pixels (that is, data indicative of the grayscale levels of respective pixels) are sampled by the associated sampling circuits 111 and stored in the associated memories 112. The D/A converters 113 each generate an analog grayscale voltage corresponding to the image data stored in the associated memories 112. The output amplifiers 114 each drive the data line selected by the switches 106R, 106G, and 106B to the same drive voltages as the analog grayscale voltages received from the D/A converters 113.

FIG. 2 is a timing chart illustrating the operation of the liquid crystal display apparatus of FIG. 1, particularly the procedure of driving three target pixels positioned at the intersections of the data lines 102Rn, 102Gn, and 102Bn and the gate line 101*m*. The three target pixels are driven through the following procedure. After the voltage Vg of the gate line 101*m* is pulled up to "High" level, the switch control pulses SL1, SL2, and SL3 are successively supplied to successively turn on the switches 106Rn, 106Gn, and 106Bn. Simultaneously with the turn-on of the switches 106Rn, 106Gn, and 106Bn, drive voltages are successively supplied from the driver IC 107 to the data lines 102Rn, 102Gn, and 102Bn. After the data lines 102Rn, 102Gn, and 102Bn are driven, the switches 106Rn, 106Gn, and 106Bn are turned off. Through this procedure, the drive voltages are successively written into the three pixels at the intersections of the data lines 102Rn, 102Gn, and 102Bn and the gate line 101*m*.

Japanese Laid-Open Patent Application No. Jp-A 2005-43418 discloses another liquid crystal display apparatus designed to drive three data lines by a single amplifier. FIG. 3 is a block diagram illustrating the structure of the liquid crystal display apparatus disclosed in this Japanese Laid-Open Patent Application. This liquid crystal display apparatus is configured to precharge all of the data lines to a predetermined amendment voltage Vamd before actually driving the data lines so as to suppress vertical crosstalk (display unevenness in the direction along the data lines). The data line precharge is also effective to reduce the power consumption of the liquid crystal display apparatus.

More specifically, the liquid crystal display apparatus of FIG. 3 includes: a display panel 201; a gate line drive circuit 203; a data line drive circuit 204; a control circuit 205; and a frame memory 206. The display panel 201 includes data lines X1 to Xm and gate lines Y1 to Yn, and pixels 202 are provided at respective intersections of the data lines X1 to Xm and the gate lines Y1 to Yn. The gate line drive circuit 203 drives the gate lines Y1 to Yn, while the data line drive circuit 204 drives the data lines X1 to Xm. The data line drive circuit 204 includes a driver IC 241 and a time-division circuit 242. The driver IC 241 includes output lines DO1 to DOi, and every three data lines are connected to the same output line through the time-division circuit 242. The time-division circuit 242 includes three switches 243, 244, and 245 for each of the every three data lines. The switches 243, 244, and 245 connect or disconnect the three data lines to/from the associated output pins in response to selection signals SS1, SS2, and SS3 received from the control circuit 205, respectively.

FIG. 4 is a timing chart illustrating the operation of the liquid crystal display apparatus of FIG. 3, particularly, the procedure for driving three pixels positioned at the intersections of the data lines X1 to X3 and the gate line Y1. The three pixels are driven through the following procedure. After activation of the gate line Y1, all the control signals SS1 to SS3 are pulled up to the "High" level to turn on the switches 243, 244, and 245. The turn-on of the switches 243, 244, and 245 allows the data lines X1 to X3 to be electrically connected with the output pin PIN1 of the driver IC 241. The amendment voltage Vamd is then outputted from the output line DO1 with the switches 243, 244, and 244 turned on, so that the data lines X1 to X3 are precharged to the amendment voltage Vamd. Thereafter, the control signals SS1 to SS3 are all pulled down to the "Low" level. This is followed by successively pull up the control signals SS1 to SS3 to the "High" level to successively turn on the switches 243, 244, and 245. Simultaneously with the turn-on of the switches 243, 244, and 245, drive voltages are then successively supplied from the driver IC 241 to the data lines X1 to X3. After the data lines X1 to X3 are driven, the switches 243, 244, and 245 are turned off. Through this procedure, the drive voltages are written to the three pixels positioned at the intersections of the data lines X1 to X3 and the gate line Y1.

However, the liquid crystal display apparatuses shown in FIGS. 1 and 3 suffer from such a problem that increased electric power is consumed in the switches used for selecting the data lines (that is, the switches 106R, 106G, 106B in FIG. 1, and the switches 243, 244, 245 in FIG. 3). The electric power Q consumed in a single switch is expressed with a following formula:

$$Q=C_G\times V_G\times(f\times r)\times V_G, \quad (1)$$

where $C_G$ (pF) is the sum of the gate capacitance and the capacitance of the interconnections connected to the gates of the switches, $V_G$ is the voltage applied to the gates, f (Hz) is the frame frequency (frame rate), and m is the number of lines (number of gate lines). As understood from the formula (1), the electric power consumed in the switch is proportional to the sum of the gate capacitance and the interconnection capacitance, and is also proportional to the square of the voltage applied to the gate of the switches.

Unpreferably, TFTs (thin film transistors), which have a large gate capacitance, are usually used as the switches for selecting the data lines, and the voltage applied to the gate is inevitably high. The TFTs are requested to have a high drive ability for driving the long data lines, and this requires the TFTs to have a large gate width. Thus, the gate capacitance thereof is inevitably large. In addition, the drive voltage of the pixels may reach as high as about 20V, and this requires applying high voltage of about 20V to the gates of the TFTs. Therefore, as understood from the formula (1), the power consumption of the switches used for selecting the data lines may be unacceptably increased. The increased power consumption is an issue particularly when the liquid crystal display apparatus is used within a portable electronic device.

SUMMARY

In an aspect of the present invention, a method is provided for operating a display apparatus in which one source output of a source driver is connected with first to N-th data lines through first to N-th time division switches, which method includes:

driving a first pixel positioned in a first horizontal line and connected with one of the first to N-th data lines, by feeding a first drive voltage to the one of the first to N-th data lines from the one source output with associated one of the first to N-th time division switches; and driving a second pixel positioned in a second horizontal line next to the first horizontal line and connected with the one of the first to N-th data lines, by feeding a second drive voltage to the one of the first to N-th data lines from the source output with associated one of the first to N-th time division switches.

The associated one time division switch is kept turned on during a time period from a start time of the driving the first pixel to a start time of the driving the second pixel.

In another aspect of the present invention, a method is provided for operating a display apparatus in which one source output of a source driver is connected with first to N-th data lines through first to N-th time division switches, which method includes:

precharging the first to N-th data lines by outputting a predetermined precharge voltage from the source output with the first to N-th time division switches turned on; and driving a specific pixel connected with one of the first to N-th data lines, by feeding a first drive voltage to the one of the first to N-th data lines from the one source output with associated one of the first to N-th time division switches turned on.

The associated one of the first to N-th time division switches is kept turned on during a period between a first timing when the precharging is started and a second timing when the driving the specific pixel is completed.

In still another aspect of the present invention, a method is provided for operating a display apparatus in which one source output of a source driver is connected with first to N-th data lines through first to N-th time division switches and the first to N-th data lines are connectable through at least one neutralization switch, which method includes:

precharging the first to N-th data lines by outputting a predetermined precharge voltage from the source output with the first to N-th data lines electrically connected with the at least one neutralization switch and with at least one but not all of the first to N-th time division switches turned on.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 5:
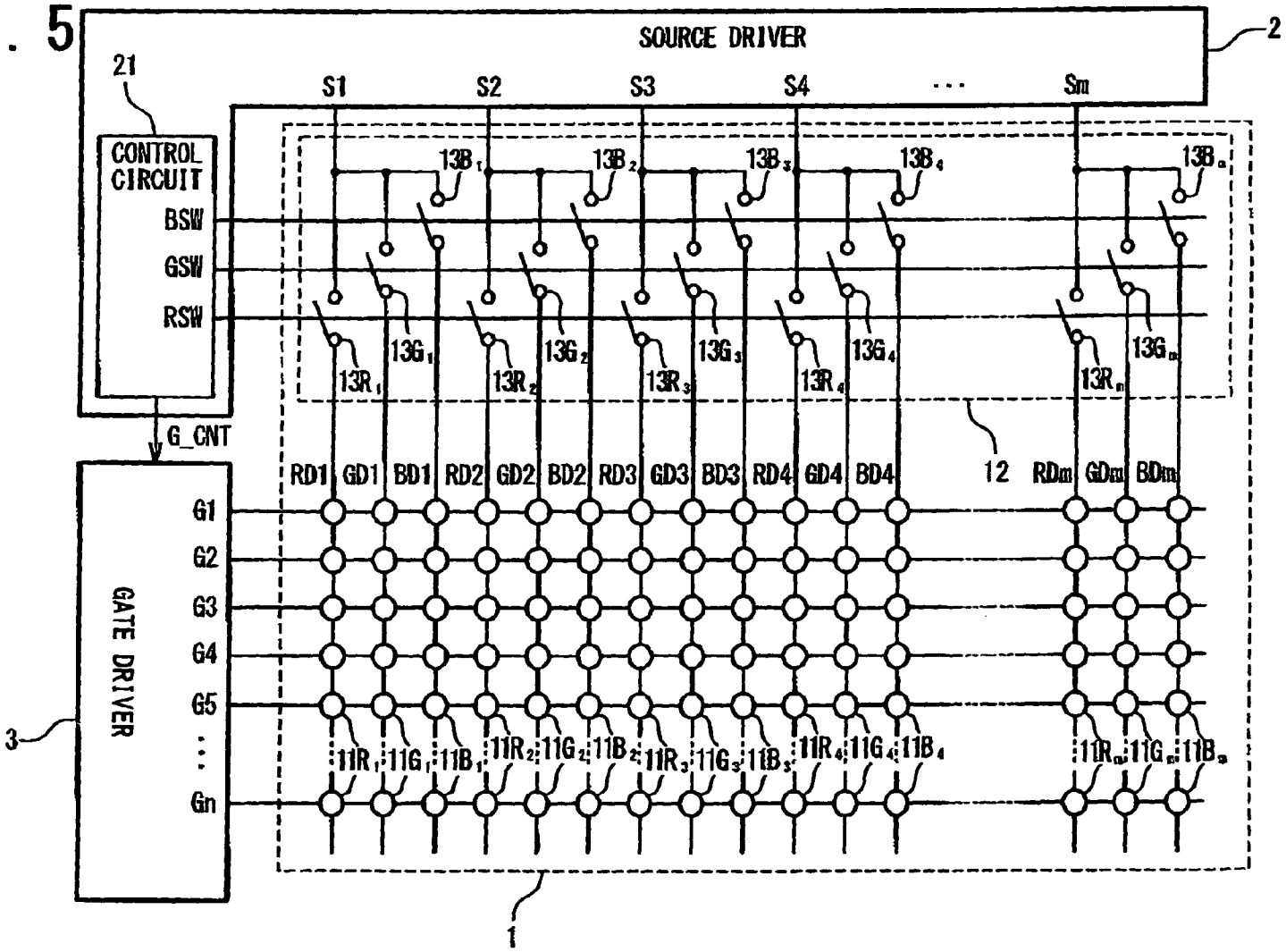
FIG. 5 is a diagram illustrating an exemplary the structure of a liquid crystal display apparatus according to a first embodiment.

FIG. 5 is a block diagram illustrating an exemplary structure of a liquid crystal display apparatus according to a first embodiment of the present invention. The liquid crystal display apparatus includes a liquid crystal display panel 1, a source driver 2, and a gate driver 3.

The liquid crystal display panel 1 includes: data lines RD1 to RDm, GD1 to GDm, BD1 to BDm; gate lines G1 to Gn; and pixels 11$R_1$ to 11$R_m$, 11$G_2$ to 11$G_m$, 11$B_1$ to 11$B_m$. The pixels 11$R_1$ to 11$R_m$ are used to display red color, positioned at respective intersections of the data lines RD1 to RDm and the gate lines G1 to Gn. Similarly, the pixels 11$G_1$ to 11$G_m$ are used to display green color, positioned at respective intersections of the data lines GD1 to GDm and the gate lines G1 to Gn. Finally, the pixels 11$B_1$ to 11$B_m$ are used to display blue color, positioned at respective intersections of the data lines BD1 to BDm and the gate lines G1 to Gn.

In the following, the data lines RD1 to RDm may be collectively referred to as the data lines RD if it is not necessary to distinguish one from another. Similarly, the data lines GD1 to GDm and the data lines BD1 to BDm may be collectively referred to as the data lines GD and the data lines BD, respectively. Further, the gate lines G1 to Gn may be collectively referred to as the gate lines G if it is not necessary to be distinguish one from another.

Furthermore, the pixels 11$R_1$ to 11$R_m$, which are used to display red color, may be collectively referred to as the pixels 11R if it is not necessary to distinguish one from another. Similarly, the pixels 11$G_1$ to 11$G_m$ and the pixels 11$B_1$ to 11$B_m$ may be collectively referred to as the pixels 11G and the pixels 11B, respectively. In addition, the pixels 11R, 11G, and 11B may be collectively referred to as the pixels 11 if it is not necessary to distinguish one from another. Furthermore, a row of the pixels 11 connected to the same gate line GS is called a "line", and the pixels 11 connected to the gate line Gj may be collectively referred to as the pixels 11 of the j-th line.

The liquid crystal display panel 1 additionally includes a time-division switch circuit 12. The time-division switch circuit 12 includes time-division switches 13$R_1$ to 13$R_m$, 13$G_1$ to 13$G_m$, 13$B_1$ to 13$B_m$. TFTs integrated on the liquid crystal display panel 1 are used as the time-division switches 13$R_1$ to 13$R_m$, 13$G_1$ to 13$G_m$, 13$B_1$ to 13$B_m$. Data lines RDi, GDi, and BDi are connected to a source output Si of the source driver 2 through the time-division switches 13$R_i$, 13$G_i$, and 13$B_i$, respectively. As described later, the time-division switches 13$R_i$, 13$G_i$, and 13$B_i$ have a function of providing an electrical connection between the source output Si and a desired data line selected from the data lines RDi, GDi, and BDi. In the followings, the time-division switches 13$R_1$ to 13$R_m$ may be collectively referred to as the time-division switches 13R, if it is not necessary to distinguish one from another. Similarly, the time-division switches 13$G_1$ to 13$G_m$ and the time-division switches 13$B_1$ to 13$B_m$ may be collectively referred to as the time-division switches 13G and the time-division switch 13B, respectively. Furthermore, the time-division switches 13R, 13G, and 13B may be collectively referred to as the time-division switches 13 if it is not necessary to discriminate one from another.

Figure 6:
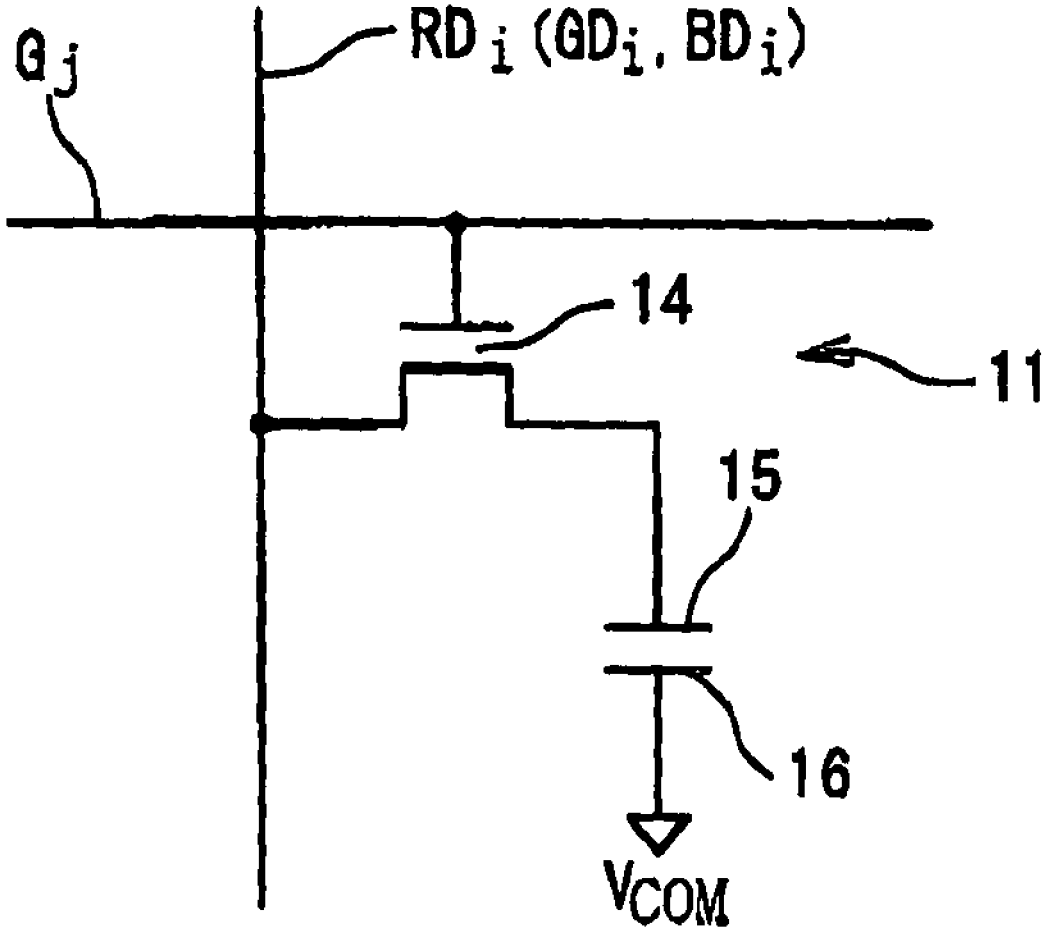
FIG. 6 is a block diagram of an equivalent circuit showing the structure of pixels.

FIG. 6 is a diagram illustrating the structure of the pixels 11. The pixels 11 each include a TFT 14 and a pixel electrode 15. The source of the TFT 14 is connected to the data line RD (or GD, BD), and the gate thereof is connected to the gate line G. The drain of the TFT 14 is connected to the pixel electrode 15. The pixel electrode 15 is opposed to the common electrode 16, and liquid crystal material is filled between the pixel electrode 15 and the common electrode 16. The grayscale level (or brightness) of each pixel 11 is controlled by the voltage between the pixel electrode 15 and the common electrode 16.

Referring back to FIG. 5, the source driver 2 outputs drive voltages from the source outputs S1 to Sm so as to drive the data lines RD, GD, and BD. In addition, the source driver 2 includes a control circuit 21 which supplies control signals RSW, GSW, and BSW to the time-division switch circuit 12 within the liquid crystal display panel 1. The time-division switches 13$R_1$ to 13$R_m$ of the time-division switch circuit 12 are turned on and off in response to the control signal RSW. Similarly, the time-division switches 13$G_1$ to 13$G_m$ are turned on and off in response to the control signal GSW, and the time-division switches 13$B_1$ to 13$B_m$ are turned on and off in response to the control signal BSW. Further, the control circuit 21 supplies a gate driver control signal G_CNT to the gate driver 3.

The gate driver 3 scans and drives the gate lines G1 to Gn. The timings at which the gate lines G1 to Gn are driven are controlled by the gate driver control signal G_CNT.

Figure 7:
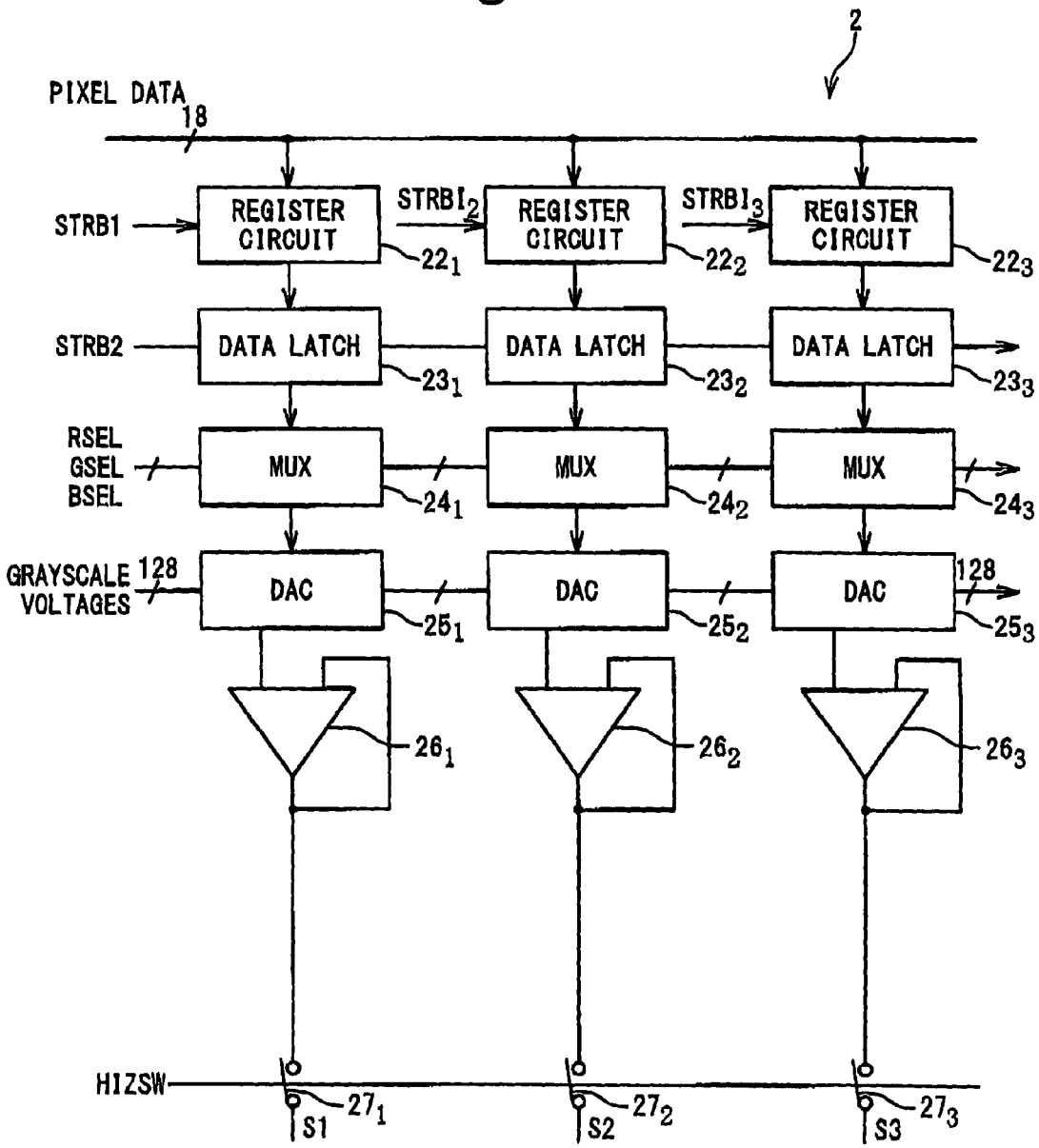
FIG. 7 is a block diagram showing an exemplary structure of a source driver according to the first embodiment.

FIG. 7 is a block diagram illustrating an exemplary structure of the source driver 2. The source driver 2 includes: register circuits 22$_1$ to 22$_m$; data latch circuits 23$_1$ to 23$_m$; multiplexers 24$_1$ to 24$_m$; D/A converters 25$_1$ to 25$_m$; output amplifiers 26$_1$ to 26$_m$; and output switches 27$_1$ to 27$_m$. The register circuits 22$_1$ to 22$_m$ latches pixel data successively transmitted thereto. The pixel data are data indicating the grayscale levels of respective pixels 11. In this embodiment, pixel data for one single pixel 11 is composed of six bits. The pixel data of three pixels of red, green, and blue are transmitted simultaneously to the register circuit 22$_i$. The register circuit 22$_i$ latches the pixel data transmitted thereto in response to associated latch signals SRTB1$_i$. In response to a common latch signal SRTB2, the data latch circuits 23$_1$ to 23$_m$ latch the three pixel data from the associated register circuits 22$_1$, to 22$_m$. The multiplexers 24$_1$ to 24$_m$ each select one from the three pixel data latched by the associated data latch circuits 23$_1$ to 23$_m$ in response to selection signals RSEL, GSEL, and BSEL, and transfer the selected pixel data to the associated D/A converters 25$_1$ to 25$_m$. The D/A converters 25$_1$ to 2$_m$ each receive 64 (=$2^6$) positive grayscale voltages and 64 negative grayscale voltages. It should be noted that the polarities of the grayscale voltages are defined with respect to the voltage level of the common electrode 16. The D/A converters 25$_1$ to 25$_m$ select the grayscale voltages indicated by the pixel data transmitted thereto, and output the selected grayscale voltages to the associated output amplifiers 26$_1$ to 26$_m$. The output amplifiers 26$_1$ to 26$_m$ function as voltage followers, and drive the source outputs S1 to Sm to the same drive voltages as the grayscale voltages received from the associated D/A converters 25$_1$ to 25$_m$. Output switches 27$_1$ to 27$_m$ are connected between the source outputs S1 to Sm and the output amplifiers 26$_1$ to 26$_m$, respectively. The output switches 27$_1$ to 27$_m$ are turned off when a control signal HIZSW is pulled up to the "High" level, and turned on when the control signal HIZSW is pulled down to the "Low" level. When the output switches 27$_1$ to 27$_m$ are turned off, the source outputs S1 to Sm are placed into the high impedance state.

Figure 8:
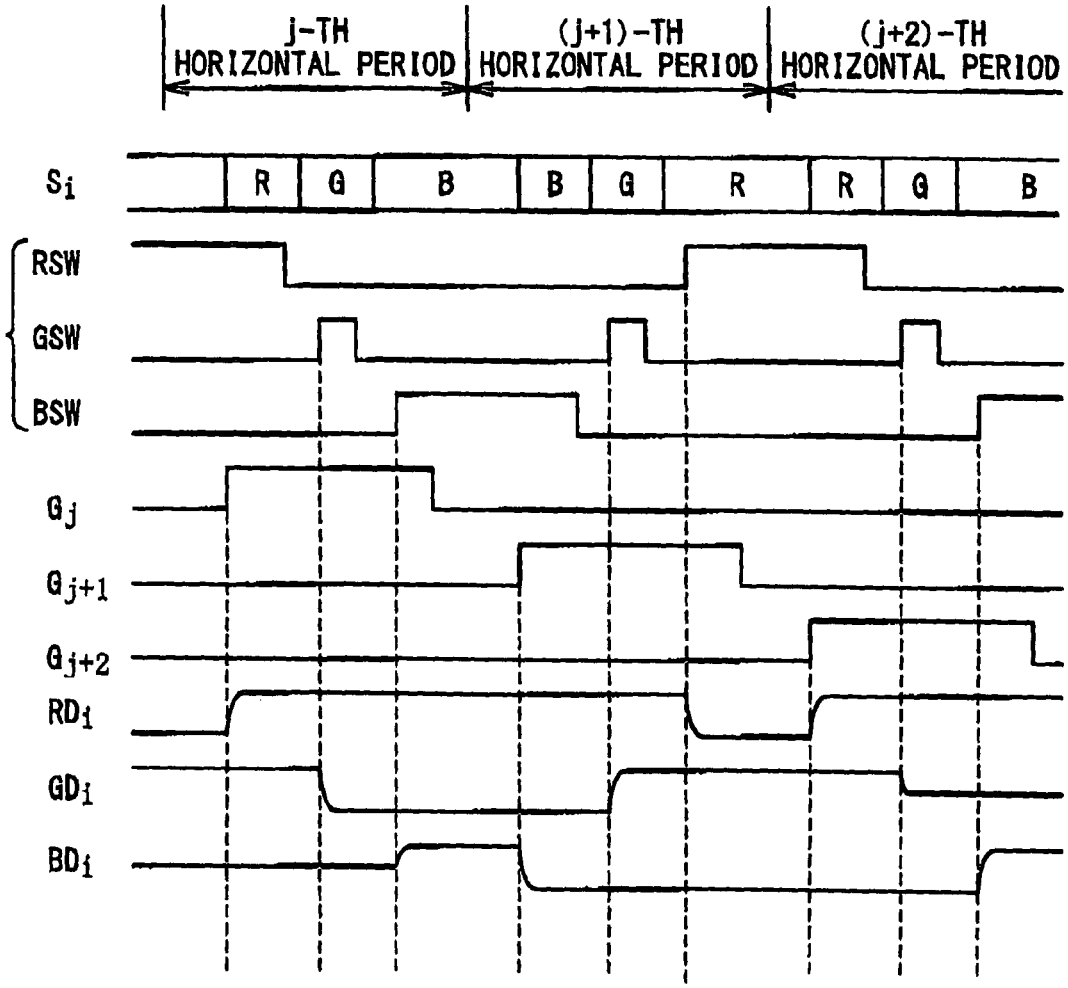
FIG. 8 is a timing chart illustrating an exemplary operation of the liquid crystal display apparatus according to the first embodiment.

FIG. 8 is a timing chart illustrating the operation of the liquid crystal display apparatus according to the first embodiment. One feature of the operation of the liquid crystal display apparatus according to the first embodiment is as follows:

(1) after a certain pixel 11 is driven lastly in a certain horizontal period, the pixel 11 connected to the same data line as the certain pixel 11 is driven first in the next horizontal period; and (2) in the next horizontal period, the time-division switch connected to the same data line is kept turned on until the drive of the pixel 11 connected to the same data line is completed.

To achieve such operation, the pixels 11 of the j-th line are driven in order of the pixels 11R, 11G, and 11B in the j-th horizontal period. In the following (j+1)-th horizontal period, the pixels 11 of the (j+1)-th line are driven in the inverse order. The operation of the first embodiment decreases the number of times of switching the time-division switches 13 per horizontal period, thereby reducing the power consumption effectively. In the following, the operation of the liquid crystal display apparatus according to the first embodiment is described in detail.

In the j-th horizontal period, as shown in FIG. 8, the pixels 11 of the j-th line are driven in order of the pixels 11R, 11G, and 11. The polarities of the drive voltages supplied to adjacent pixels of the j-th line are opposite from each other. It should be noted that the polarities of drive voltages are defined on the basis of the voltage level of the common electrode 16. The drive of the pixels 11 of the j-th line in the j-th horizontal period is executed in the following manner.

At the beginning of the j-th horizontal period, the control signal RSW is being pulled up continuously from the (j−1)-th horizontal period. That is, the time-division switches 13R are already turned on at the beginning of the j-th horizontal period.

When the gate line Gj is pulled up after the initiation of the j-th horizontal period, drive voltages associated with the pixels 11R are outputted from the source outputs S1 to Sm to the data lines RD, to thereby drive the pixels 11R to desired drive voltage. Subsequently, the control signal RSW is pulled down so that the time-division switches 13R are turned off. It should be noted that the data lines RD (and the pixel 11R) maintains the drive voltages.

This is followed by pulling up the control signals GSW and BSW in this order, so that the time-division switches 13G and 13B are turned on in this order. Simultaneously with the turn-on of the time-division switches 13G and 13B, the source driver 2 outputs drive voltages associated with the pixels 11G and 11B from the source outputs S1 to Sm to drive the pixels 11G and 11B in this order.

After the drive of the pixels 11B of the j-th line is completed, the gate line Gj is pulled down. However, the control signal BSW is not pulled down, so that the time-division switches 13B are continuously kept turned on. The time-division switches 13B are continuously turned on until the next horizontal period (the (j+1)-th horizontal period).

In the (j+1)-th horizontal period, the pixels 11 of the (j+1)-th line are driven in order of the pixels 11B, 11G, and 11R. It should be noted that, after the pixels 11B of the j-th line are driven lastly in the j-th horizontal period, the pixels 11B of the (j+1)-th line, which are connected with the same data lines, are driven first in the (j+1)-th horizontal period.

More specifically, when the gate line Gj+1 is pulled up after the initiation of the (j+1)-th horizontal period, drive voltages associated with the pixels 11B are outputted from the source outputs S1 to Sm. When the drive voltages associated with the pixels 11B are outputted, the drive voltages are supplied immediately to the data line BD, and the pixels 11B are driven to the drive voltages, because the control signal BSW is pulled up continuously from the j-th horizontal period. Subsequently, the control signal BSW is pulled down so that the time-division switches 13B are turned off.

Subsequently, the control signals GSW and RSW are activated in this order. As a result, the time-division switches 13G and 13R are turned on in this order. Simultaneously with the turn-on of the time-division switches 13G and 13R, the source driver 2 outputs the drive voltages associated with the pixels 11G and 11R from the source outputs S1 to Sm to drive the pixels 11G and 11R in this order.

After the drive of the pixels 11R on the (j+1)-th line is completed, the gate line Gj+1 is pulled down. However, the control signal RSW is not pulled down, so that the time-division switches 13R are continuously kept turned on. The time-division switches 13R are continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 of the (j+3)-th line are driven in the (j+3)-th horizontal period in the same manner as those of the (j+1)-th line. The pixels 11 of other lines are driven in the same manner.

Figure 9:
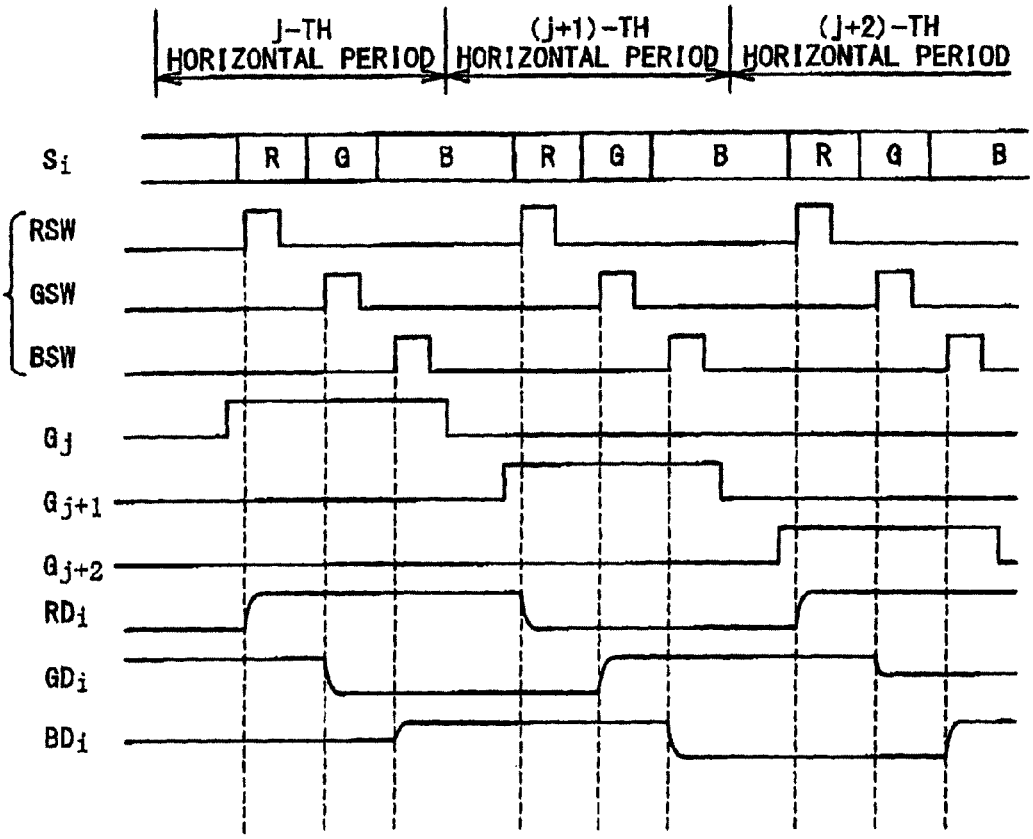
Fig. 9 (RELATED ART)
FIG. 9 is a timing chart illustrating an exemplary operation of a liquid crystal display apparatus according to a comparative example.

The operation of the first embodiment advantageously decreases the number of times of switching the time-division switches 13 per horizontal period, thereby effectively reducing the power consumption in the time-division switches 13. The advantage of the operation according to the first embodiment shown in FIG. 8 will be understood more clearly, when compared to the operation shown in FIG. 9. In a typical operation of a typical liquid crystal apparatus, as shown in FIG. 9, the control signals RSW, GSW, and BSW are successively pulled up when the pixels 11R, 11G, and 11B start to be driven, and the control signals RSW, GSW, and BSW are pulled down when the pixels 11R, 11G, and 11B stop being driven. In such operation, the control signals RSW, GSW, and BSW are pulled up three times in total, and pulled down three times in total, for each horizontal period. In the operation of the first embodiment shown in FIG. 8, on the other hand, the control signals RSW, GSW, and BSW are pulled up only twice in total, and pulled down only twice in total, for each horizontal period. The decrease in the number of times of the pull-down and pull-up of the control signals RSW, GSW, and BSW is equivalent to the decreased number of times of switching the time-division switches 13. Therefore, the operation of the first embodiment shown in FIG. 8 effectively decreases the number of times of switching the time-division switches 13.

As thus described, the operation of the liquid crystal display apparatus according to this embodiment effectively decrease the number of times of switching of the time-division switches, and thereby reduces the power consumption, effectively.

Figure 10:
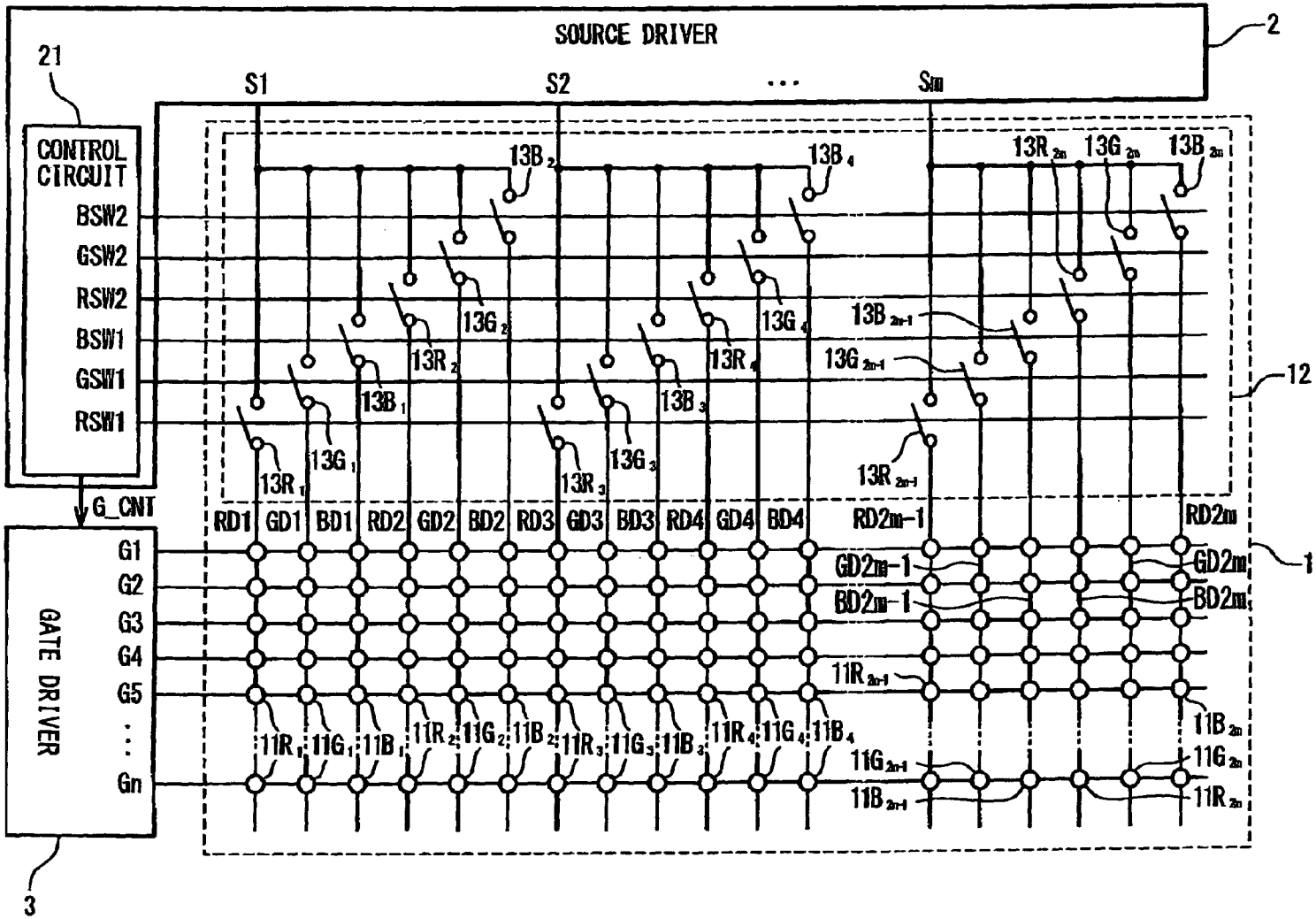
FIG. 10 is an illustration showing an exemplary structure of the liquid crystal display apparatus according to the first embodiment, in the case that six data lines are connected to each source output.

Although three data lines are connected to a single source output in the first embodiment, it should be understood that the number of data lines connected with one source output is not limited to three, For example, six data lines may be connected with one single source output as is shown in FIG. 10.

In the liquid crystal display apparatus of FIG. 10, the liquid crystal display panel 1 is provided with 6 m data lines RD1 to RD2*m*, GD1 to GD2*m*, and BD1 to BD2*m*. Six data lines RD2*i*-1, GD2*i*-1, BD2*i*-1, RD2*i*, GD2*i*, and BD2*i* are connected to a single source output Si of the source driver 2 through time-division switches $\mathbf{13}R_{2i-1}$, $\mathbf{13}G_{2i-1}$, $\mathbf{13}B_{2i-1}$, $\mathbf{13}R_{2i}$, $\mathbf{13}G_{2i}$, and $\mathbf{13}B_{2i}$, respectively.

In the liquid crystal display apparatus of FIG. 10, the control circuit 21 of the source driver 2 supplies six control signals RSW1, GSW1, BSW1, RSW2, GSW2, and BSW2 to the time-division switch circuit 12. The time-division switches $\mathbf{13}R_{2i-1}$, $\mathbf{13}G_{2i-1}$, $\mathbf{13}B_{2i-1}$, $\mathbf{13}R_{2i}$, $\mathbf{13}G_{2i}$, and $\mathbf{13}B_{2i}$ are turned on and off in response to the control signals RSW1, GSW1, SSW1, RSW2, GSW2, and BSW2, respectively.

Figure 11:
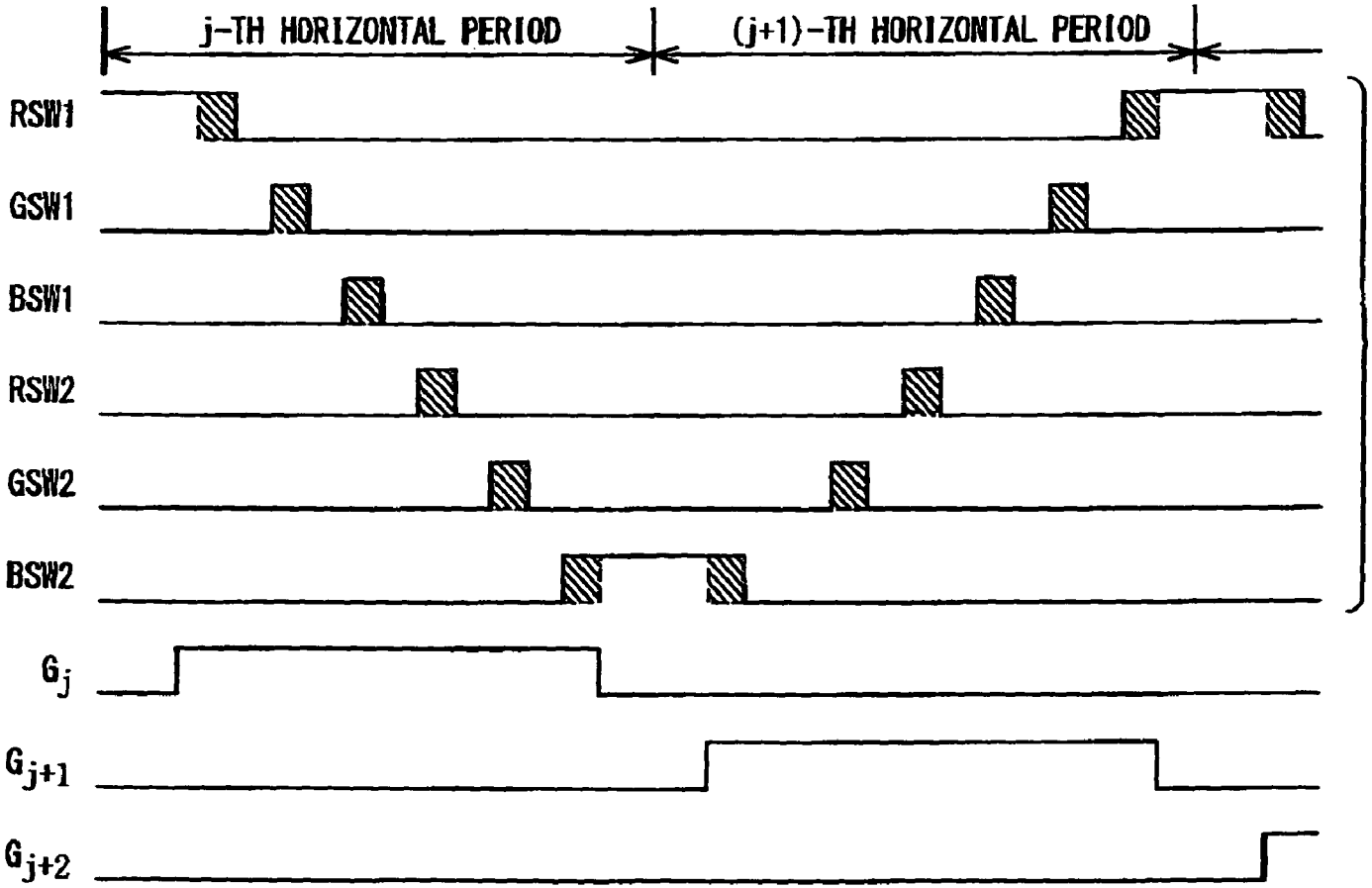
FIG. 11 is a timing chart illustrating an exemplary operation of the liquid crystal display apparatus of FIG. 10.

FIG. 11 is a timing chart illustrating the operation of the liquid crystal display apparatus of FIG. 10. At the beginning of the j-th horizontal period, the control signal RSW1 is being pulled up continuously from the (j−1)-th horizontal period. Thus, the time-division switches $\mathbf{13}R_{2i-1}$ are already turned on at the beginning of the j-th horizontal period.

Subsequently, the pixels 11 of the j-th line are driven in order of the pixels $\mathbf{11}R_{2i-1}$, $\mathbf{11}G_{2i-1}$, $\mathbf{11}B_{2i-1}$, $\mathbf{11}R_{2i}$, $\mathbf{11}G_{2i}$, and $\mathbf{11}B_{2i}$. In FIG. 11, hatchings indicate the periods during which the associated pixels 11 are driven.

More specifically, the gate line Gj is pulled up in driving the pixels 11 of the j-th line, and the drive voltage associated with the pixel $\mathbf{11}R_{2i-1}$ is outputted from the source output Si to drive the pixel $\mathbf{11}R_{2i-1}$.

Subsequently, the control signals GSW1, BSW1, RSW2, GSW2, and BSW2 are activated in this order to turn on the time-division switches $\mathbf{13}G_{2i-1}$, $\mathbf{13}B_{2i-1}$, $\mathbf{13}R_{2i}$, $\mathbf{13}G_{2i}$, and $\mathbf{13}B_{2i}$ in this order. Simultaneously with the turn-on of the time-division switches $\mathbf{13}G_{2i-1}$, $\mathbf{13}B_{2i-1}$, $\mathbf{13}R_{2i}$, $\mathbf{13}G_{2i}$, and $\mathbf{13}B_{2i}$, the drive voltages associated with the pixels $\mathbf{11}G_{2i-1}$, $\mathbf{11}B_{2i-1}$, $\mathbf{11}R_{2i}$, $\mathbf{11}G_{2i}$, and $\mathbf{11}B_{2i}$, are outputted from the source output Si to successively drive the pixels $\mathbf{11}G_{2i-1}$, $\mathbf{11}B_{2i-1}$, $\mathbf{11}R_{2i}$, $\mathbf{11}G_{2i}$, and $\mathbf{11}B_{2i}$.

After the drive of the pixel $\mathbf{11}B_{2i}$ on the J-th line is completed, the gate line Gj is pulled down. However, the control signal BSW2 is not pulled down, so that the time-division switch $\mathbf{13}B_{2i}$ is continuously kept turned on. The time-division switch $\mathbf{13}B_{2i}$ is continuously turned on until the next horizontal period (the (J+1)-th horizontal period), In the (j+1)-th horizontal period, the pixels 11 of the (j+1)-th line are driven in order of the pixels $\mathbf{11}B_{2i}$, $\mathbf{11}G_{2i}$, $\mathbf{11}R_{2i}$, $\mathbf{11}B_{2i-1}$, $\mathbf{11}G_{2i-1}$, and $\mathbf{11}R_{2i-1}$. More specifically, the gate line Gj+1 is pulled up, and the drive voltage associated with the pixel $\mathbf{11}B_{2i}$ is outputted from the source output Si. Since the control signal BSW2 is being pulled up continuously from the j-th horizontal period, the drive voltage is supplied immediately to the data line $BD_{2i}$, when the drive voltage associated with the pixel $\mathbf{11}B_{2i}$ is outputted from the source output Si. Thus, the pixel $\mathbf{11}B_{2i}$, is driven to the supplied drive voltage, Subsequently, the control signals GSW2, RSW2, BSW1, GSW1, and RSW1 are pulled up in this order to turn on the time-division switches $\mathbf{13}G_{2i}$, $\mathbf{13}R_{2i}$, $\mathbf{13}B_{2i-1}$, $\mathbf{13}G_{2i-1}$, and $\mathbf{13}R_{2i-1}$ in this order. Simultaneously with the turn-on of the time-division switches $\mathbf{13}G_{2i}$, $\mathbf{13}R_{2i}$, $\mathbf{13}B_{2i-1}$, $\mathbf{13}G_{2i-1}$, and $13R_{2i-1}$, the drive voltages associated with the pixels $11G_{2i}$, $11R_{2i}$, $11B_{2i-1}$, $11G_{2i-1}$ and $11R_{2i-1}$ are outputted from the source output Si to successively drive the pixels $11G_{2i}$, $11R_{2i}$, $11B_{2i-1}$, $11G_{2i-1}$, and $11R_{2i-1}$.

After the drive of the pixel $11R_{2i-1}$ of the (j+1)-th line is completed, the gate line Gj+1 is pulled down. However, the control signal RSW1 is not pulled down, so that the time-division switch $13R_{2i-1}$ is continuously kept turned on. The time-division switch $13R_{2i-1}$ is continuously turned on until the next horizontal period (the (j+2)-th horizontal period).

In the (j+2)-th horizontal period, the pixels 11 of the (j+2)-th line are driven in the same manner as those of the j-th line, Thereafter, the pixels 11 of the (j+3)-th line are driven in the (j+3)-th horizontal period in the same manner as those of the (j+1)-th line. The pixels 11 on other lines are driven in the same manner.

This operation effectively decreases the number of times of switching of the time-division switches 13, effectively reducing the power consumption. The operation of FIG. 11 only requires pulling up the control signals RSW1, GSW1, BSW1, RSW2, GSW2, and BSW2 only five times in total, and pulling down the same only five times in total, for each per horizontal period, even though there are six time-division switches 13 used for switching six data lines ($RD_{2i-1}$, GD2*i*-1, BD2*i*-1, RD2*i*, GD2*i*, and BD2*i*)

The order of driving the pixels $11R_{2i-1}$, $11G_{2i-1}$, $11B_{2i-1}$, $11R_{2i}$, $11G_{2i}$, and $11B_{2i}$ may be changed as desired. It should be noted, however, that it is necessary to satisfy such a requirement that, after a certain pixel is driven lastly in a certain horizontal period, the pixel connected to the same data line as the certain pixel driven is driven first in the next horizontal period.

Second Embodiment

Figure 12:
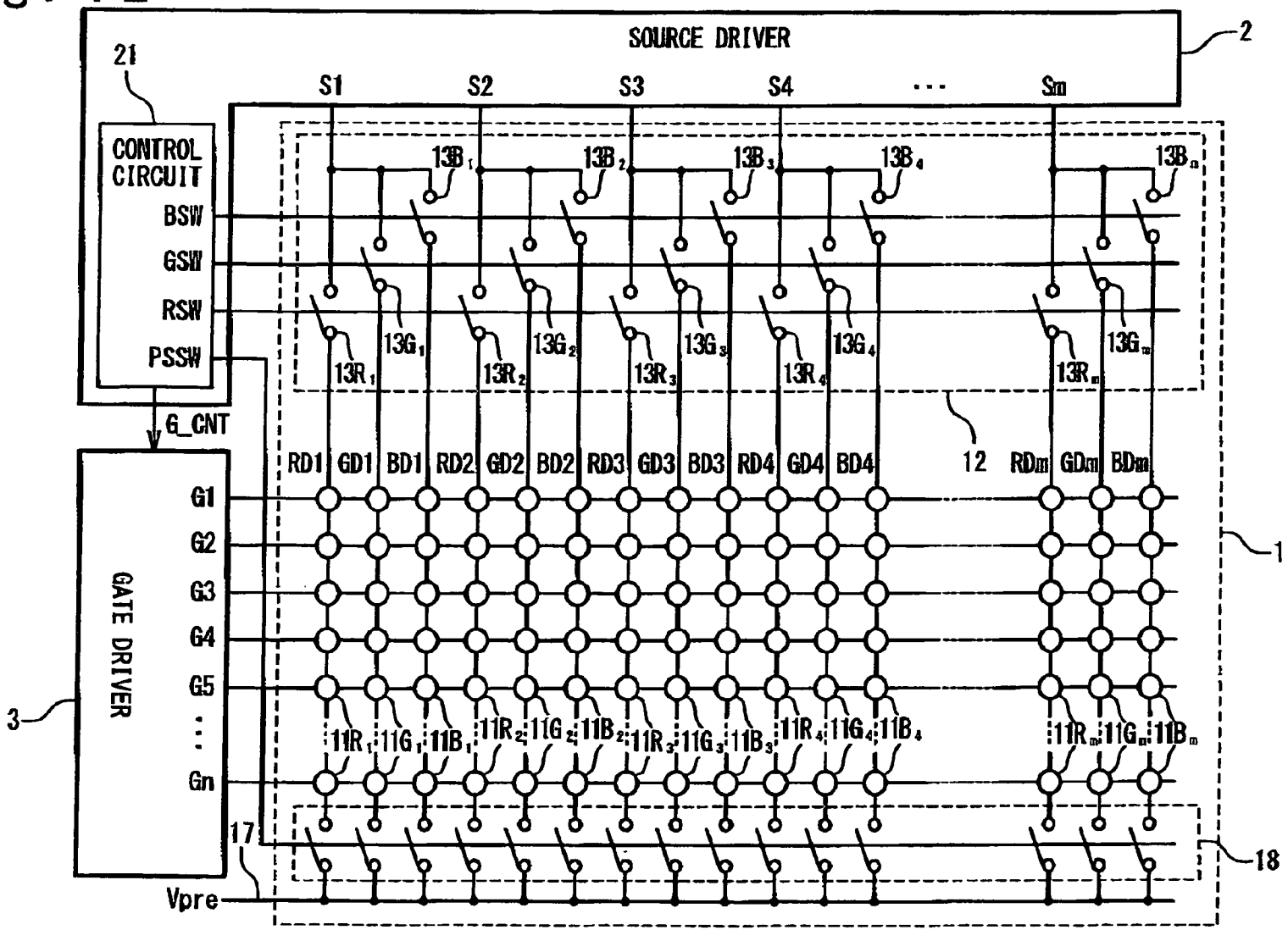
FIG. 12 is a diagram illustrating an exemplary structure of a liquid crystal display apparatus according to a second embodiment.

FIG. 12 is a block diagram showing an exemplary structure of a liquid crystal display apparatus according to a second embodiment of the present invention. The difference between the liquid crystal display apparatuses of the first and second embodiments is that the liquid crystal display apparatus according to the second embodiment is adapted to precharge the data lines RD, GD, and BD. Specifically, the liquid crystal display panel 1 of the second embodiment additionally includes a precharge line 17 and precharge switches 18. The precharge line 17 is fed with a desired precharge voltage Vpre. The precharge switches 18 are connected between the precharge line 17 and the data lines RD, GD, and BD. The precharge switches 18 are turned on and off in response to an external precharge signal PSSW supplied from the control circuit 21 of the source driver 2. When the precharge switches IS are turned on, the data lines RD, GD, and BD are precharged to the precharge voltage Vpre.

Figure 13:
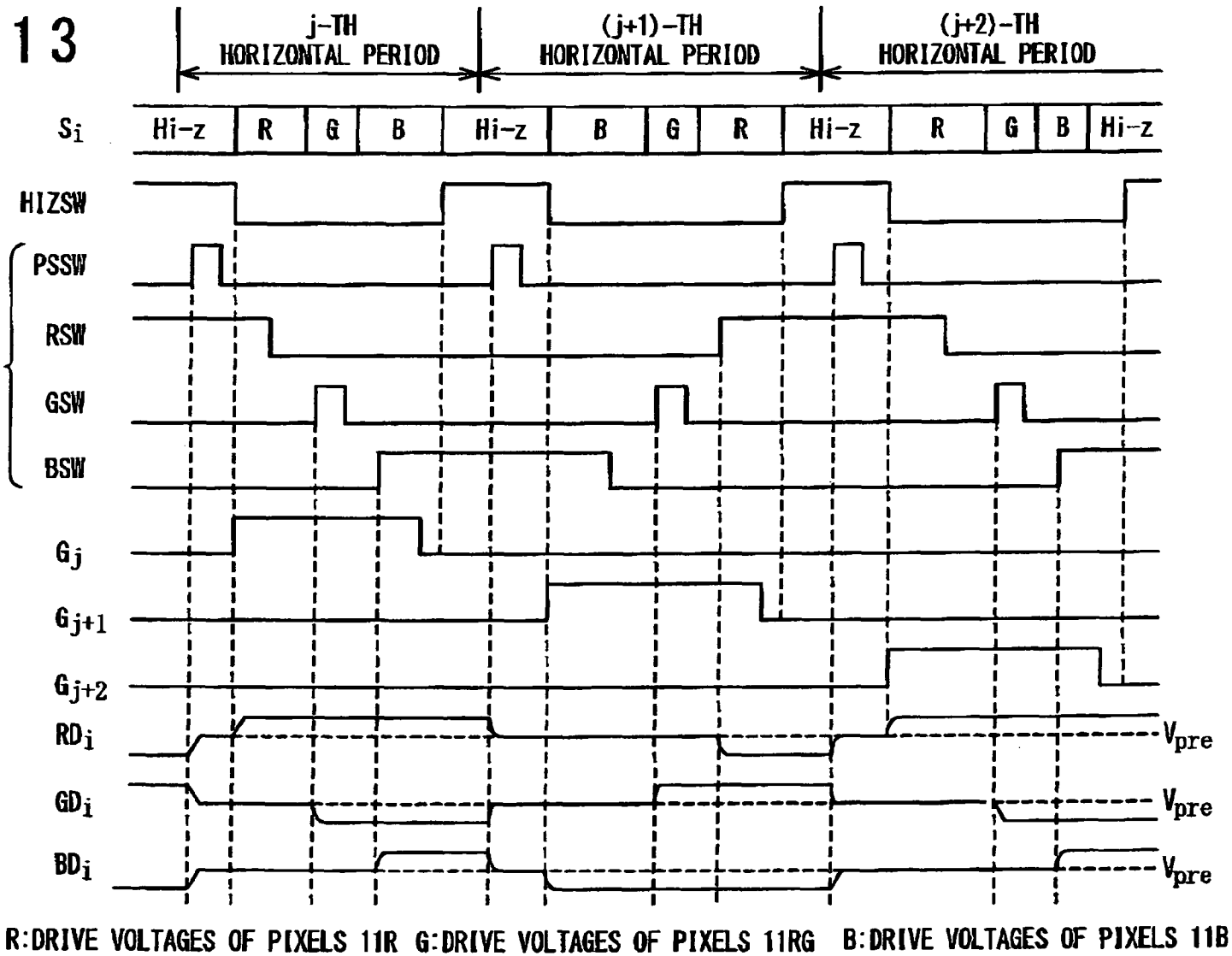
FIG. 13 is a timing chart illustrating an exemplary operation of the liquid crystal display apparatus according to the second embodiment.

FIG. 13 is a timing chart showing the operation of the liquid crystal display apparatus according to the second embodiment. FIG. 13 shows the operation of the case where the polarities of the drive voltages supplied to the pixels 11 are inverted every line (that is, the case where the pixels 11 are driven with the 1H inversion drive technique (or one-line inversion drive)). In the operation shown in FIG. 13, all the data lines are precharged to the precharge voltage Vpre immediately after the beginning of each horizontal line. As will be described later, when the polarities of the drive voltage supplied to the pixels 11 are inverted every n-line(s), precharge is executed once for every n-horizontal period(s).

At the beginning of the j-th horizontal period, the control signal RSW is being pulled up continuously from the (j−1)-th horizontal period. That is, the time-division switches 13R are already turned on at the beginning of the j-th horizontal period. In addition, at the beginning of the j-th horizontal period, a control signal HIZSW is pulled up and the source outputs S1 to Sm are placed into the high impedance state.

When the j-th horizontal period is started, the external precharge signal PSSW is pulled up to turn on the precharge switches, and thereby the data lines RD, GD, and BD are precharged to the precharge voltage Vpre.

During the precharge, the source outputs SI to Sm are kept at the high impedance state. In other words, the control signal HIZSW is pulled up to turn off the output switches $27_1$ to $27_m$, so that the outputs of the output amplifiers $26_1$ to $26_m$ are disconnected from the source outputs S1 to Sm (see FIG. 7). This is important to protect the output amplifiers $26_1$ to $26_m$. As described above, the time-division switches 13R are turned on during the precharge in the present embodiment. Therefore, the precharge voltage Vpre is undesirably applied to the outputs of the output amplifiers $26_1$ to $26_m$, if the source outputs S1 to Sm are electrically connected to the output amplifiers $26_1$ to $26_m$. In the second embodiment, the output switches $27_1$ to $27_m$ are turned off so as to prevent the precharge voltage Vpre from being applied to the outputs of the output amplifiers $26_1$ to $26_m$.

Subsequently, the pixels 11 of the j-th line are driven successively in the same manner as the first embodiment. Specifically, after completing the precharge, the gate line Gj is pulled up. The drive voltage associated with the pixels 11R are then outputted from the source outputs S1 to Sm and supplied to the data lines RD. This results in that the pixels 11R are driven to desired drive voltages. Subsequently, the control signal RSW is pulled down so that the time-division switches 13R are turned off. After the turn-off of the time-division switches 13R, the data lines RD (and the pixels 11R) maintain the drive voltages.

Subsequently, the control signals GSW and BSW are activated in this order to turn on the time-division switches 13G and 13B in this order. Simultaneously with the turn-on of the time-division switches 13G and 13B, the drive voltages associated with the pixels 11G and 11B are outputted from the source outputs S1 to Sm. This results in that the pixels 11G and 11B are driven in this order.

After the drive of the pixels 11B of the j-th line is completed, the gate line Gj is pulled down. In the meantime, the control signal BSW is not pulled down, so that the time-division switches 13B are continuously kept turned on. The time-division switches 13B are continuously turned on until the next horizontal period (the (j+1)-th horizontal period).

In the (j+1)-th horizontal period, the pixels 11 of the (j+1)-th line are driven successively after the precharge of the data lines. It should be noted that, in the (j+1)-th horizontal period, the pixels 11 of the (j+1)-th line are driven in order of the pixels 11B, 11G, and 11R.

Specifically, when the (j+1)-th horizontal period is started, the external precharge signal PSSW is pulled up to turn on the precharge switches 18. The turn-on of the precharge switches 18 allows the data lines RD, GD, and BD to be precharged to the precharge voltage Vpre. During the precharge, the source outputs S1 to Sm are placed into the high impedance state.

After completing the precharge, the gate line Gj+1 is pulled up and drive voltages associated with the pixels 11B are outputted from the source outputs S1 to Sm. Since the control signal BSW is being pulled up continuously from the j-th horizontal period, the drive voltages are supplied immediately to the data lines BD to drive the pixels 11B to the drive voltages, when the drive voltages are outputted from the source outputs S1 to Sm. Then, the control signal BSW is pulled down, and the time-division switches 13B are turned off. It should be noted that, after the pixels 11B are driven lastly among the of the j-th lines, the pixels 11B of the (j+1)-th line, which are connected to the same data lines, are driven first in the (j+1)-th horizontal period.

Subsequently, the control signals GSW and RSW are pulled up in this order to turn on the time-division switches 13G and 13R in this order. Simultaneously with the turn-on of the time-division switches 13G and 13R, the drive voltages associated with the pixels 11G and 11R are successively outputted from the source outputs S1 to Sm. As a result, the pixels 11G and 11R are driven in this order.

After the drive of the pixels 11R of the (j+1)-th line is completed, the gate line Gj+1 is pulled down. In the meantime, the control signal RSW is not pulled down, so that the time-division switches 13R are kept turned on. The time-division switches 13R are continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 on the (j+3)-th line are driven in the (j+3)-th horizontal period in the same manner as those of the (j+1)-th line. The pixels 11 of other lines are driven in the same manner.

Figure 14:
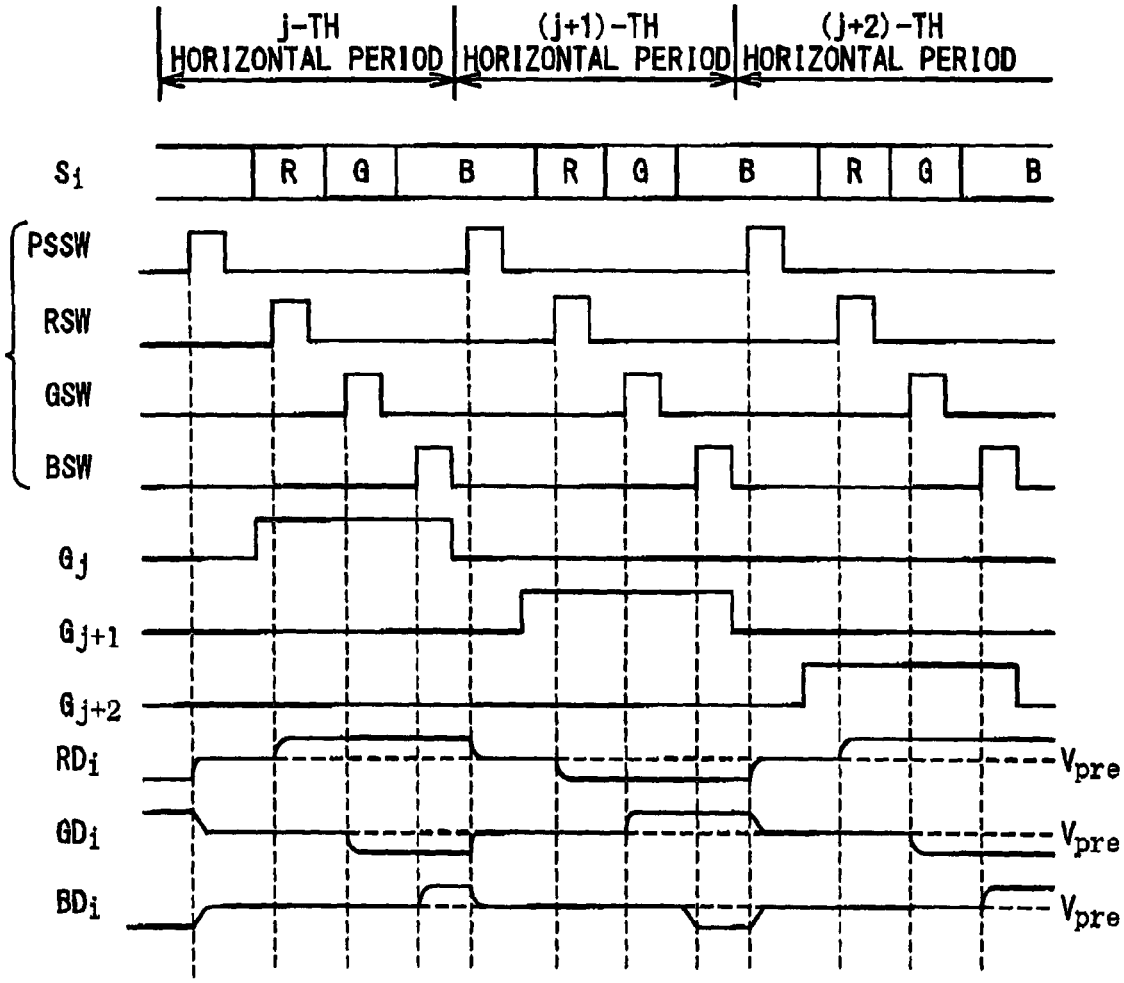
FIG. 14 is a timing chart illustrating an exemplary operation of a liquid crystal display apparatus according to a comparative example.

The above-described operation effectively decreases the number of times of switching of the time-division switches 13, thereby reducing the power consumption in the time-division switches 13. The advantage of the operation according to the second embodiment shown in FIG. 13 would be understood more clearly, when compared to the operation shown in FIG. 14. In the operation a typical liquid crystal apparatus shown in FIG. 14, the control signals RSW, GSW, and BSW are pulled up when the pixels 11R, 11G, and 11B start to be driven after the precharge, and the control signals RSW, GSW, and BSW are pulled down when the pixels 11, 11G, and 11B stop being driven. In such operation, the control signals RSW, GSW, and BSW are pulled up three times in total, and pulled down three times in total, for each horizontal period. In the operation of the second embodiment shown in FIG. 13, on the other hand, the control signals RSW, GSW, and BSW are pulled up only twice in total, and pulled down only twice in total, for each horizontal period. Therefore, the operation of the second embodiment shown in FIG. 13 effectively decreases the number of times of switching of the time-division switches 13.

As described above, the operation of the liquid crystal display apparatus according to the second embodiment decreases the number of times of switching of the time-division switches, thereby reducing the power consumption, effectively.

Figure 15:
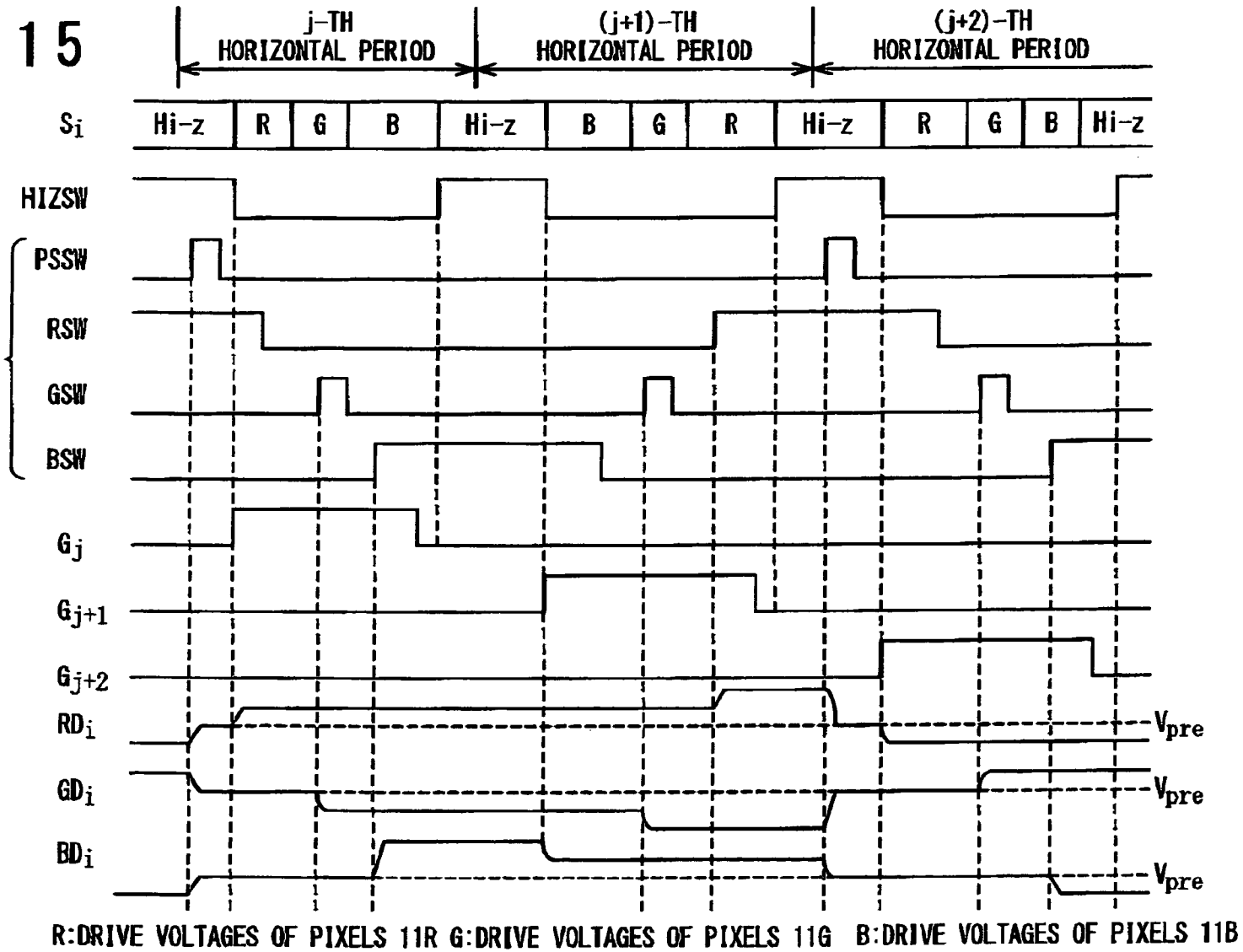
FIG. 15 is a timing chart illustrating an exemplary operation of the liquid crystal display apparatus of FIG. 12 when the 2H inversion drive technique is used.

It should be noted that the polarities of the drive voltages supplied to the pixels 11 may be inverted every two lines; in other words, the pixels 11 may be driven with a 2H inversion drive technique. FIG. 15 is an illustration showing the operation of the liquid crystal display apparatus when the pixels 11 are driven with the 2H inversion drive technique. As shown in FIG. 15, the external precharge signal PSSW is pulled up at the beginning of the j-th horizontal period to precharge the data lines. On the contrary, at the beginning of the following (j+1)-th horizontal period, the external precharge signal PSSW is not pulled up; the data lines are not precharged at the beginning of the following (j+1)-th horizontal period. In the next (j+2)-th horizontal period, the data lines are precharged at the beginning of the period. The polarities of the drive voltages supplied to the respective pixels 11 of the (j+2)-th line driven in the (j+2)-th horizontal period are inverted from the polarities of the drive voltages supplied to the corresponding pixels 11 of the j-th line.

In the operation shown in FIG. 15, the control signals RSW, GSW, and BSW are pulled up only twice in total, and pulled down only twice in total, for each horizontal period. This effectively decreases the number of times of switching of the time-division switches 13.

Figure 16:
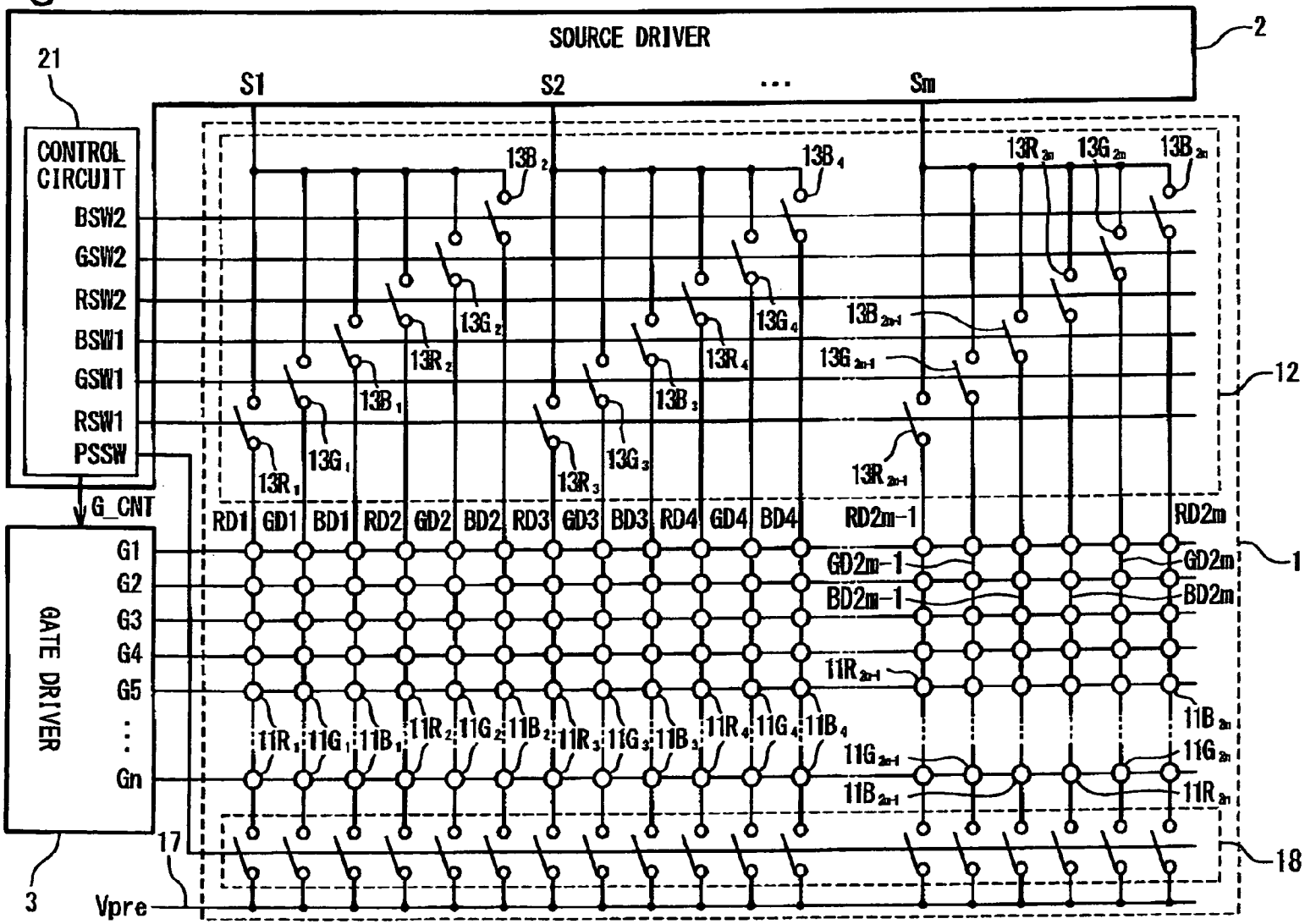
FIG. 16 is a diagram illustrating an exemplary structure of the liquid crystal display apparatus according to the second embodiment, in the case that where six data lines are connected to each source output.

Although three data lines are connected to each source output in the liquid crystal display apparatus of FIG. 12, it should be understood that the number of data lines connected to each source output is not limited to three. For example, six data lines may be connected with each source output. FIG. 16 is a diagram illustrating an exemplary structure of such liquid crystal display apparatus. The liquid crystal display apparatus shown in FIG. 16 has almost the same structure as that of the liquid crystal display apparatus shown in FIG. 10. The difference in the structure is that the liquid crystal display panel 1 additionally includes a precharge line 17 fed with the precharge voltage Vpre and precharge switches 18. When the precharge switches 18 are turned on, the data lines RD, GD, and BD are precharged to the precharge voltage Vpre.

Figure 17:
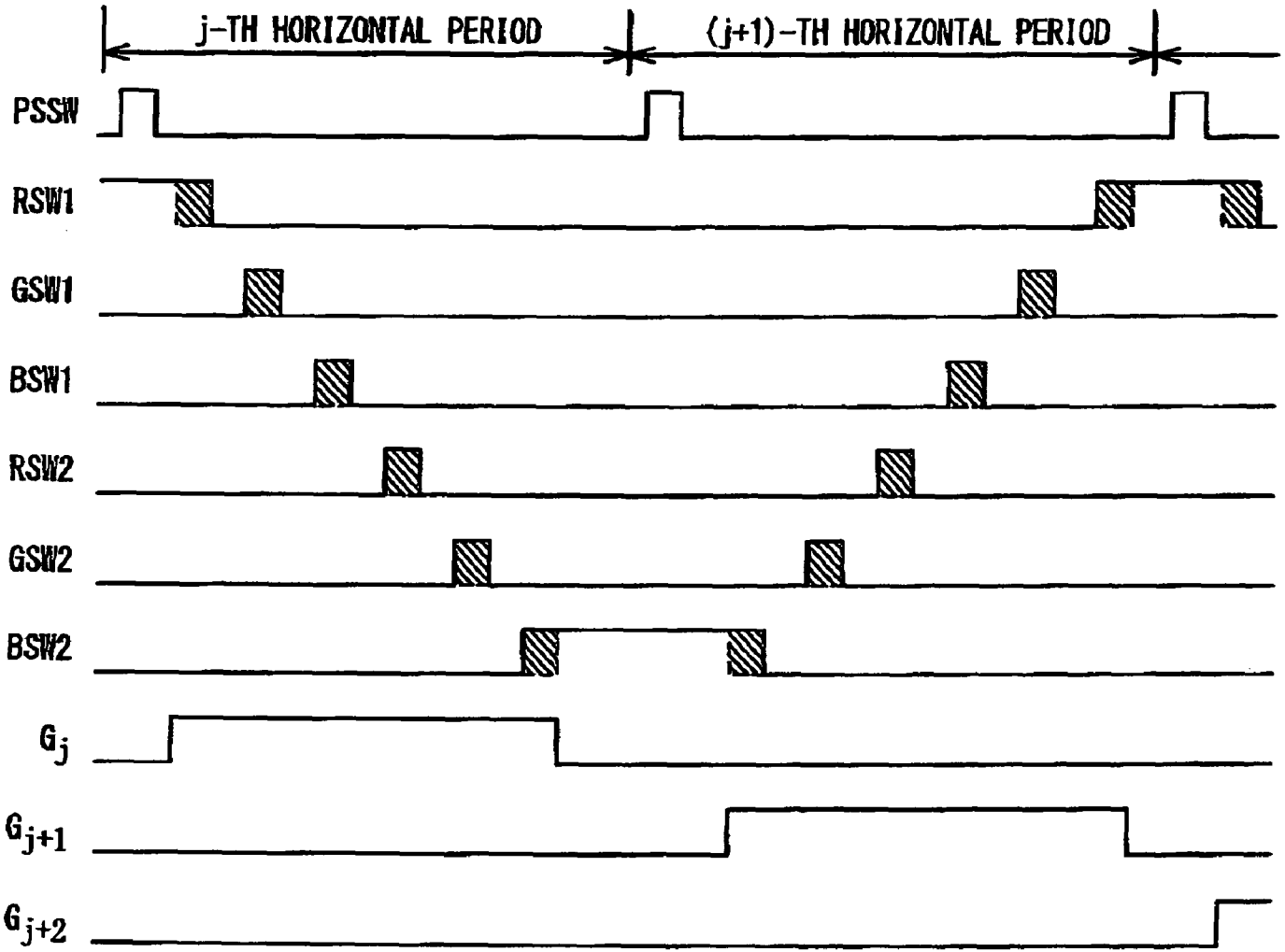
FIG. 17 is a timing chart illustrating an exemplary operation of the liquid crystal display apparatus of FIG. 16.

FIG. 17 is a timing chart illustrating an exemplary operation of the liquid crystal display apparatus of FIG. 16. The operation of the liquid crystal display apparatus shown in FIG. 17 is the same as the operation shown in FIG. 11, except that all the data lines are precharged at the beginning of each horizontal period.

At the beginning of the j-th horizontal period, the control signal RSW1 is being pulled up continuously from the (j−1)-th horizontal period. Thus, the time-division switch $\mathbf{13}R_{2i-1}$ is already turned on at the beginning of the j-th horizontal period. After the beginning of the j-th horizontal period, the external precharge signal PSSW is pulled up to precharge all the data lines to the precharge voltage Vpre. During the precharge, the source outputs S1 to Sm of the source driver 2 are placed into the high impedance state.

After completing the precharge, the gate line Gj is pulled up. After the pull-up of the gate line Gj, the pixels 11 of the j-th line are driven in order of the pixels $\mathbf{11}R_{2i-1}$, $\mathbf{11}G_{2i-1}$, $\mathbf{11}B_{2i-1}$, $\mathbf{11}R_{2i}$, $\mathbf{11}G_{2i}$, and $\mathbf{11}B_{2i}$. In FIG. 17, hatchings indicate periods where the associated pixels 11 are driven. It should be noted that it is unnecessary to switch the control signal RSW1 when driving the pixel $\mathbf{11}R_{2i-2}$, because the control signal RSW1 is being pulled up continuously from the j-th horizontal period at the beginning of the j-th horizontal period.

After the drive of the pixel $\mathbf{11}B_{2i}$ of the j-th line is completed, the gate line Gj is pulled down. In the meantime, the control signal BSW2 is not pulled down; the time-division switch $\mathbf{13}B_{2i}$ is kept turned on. The time-division switch $\mathbf{13}B_{2i}$ is continuously turned on until the next horizontal period (the (j+1)-th horizontal period).

In the (j+1)-th horizontal period, the pixels 11 of the (j+1)-th line are driven in order of the pixels $\mathbf{11}B_{2i}$, $\mathbf{11}R_{2i}$, $\mathbf{11}B_{2i-1}$, $\mathbf{11}G_{2i-1}$, and $\mathbf{11}R_{2i-1}$. It is unnecessary to switch the control signal BSW2 when driving the pixel $\mathbf{11}B_{2i}$, since the control signal BSW2 is being pulled up continuously from the j-th horizontal period at the beginning of the (j+1)-th horizontal period.

After the drive of the pixel $\mathbf{11}R_{2i-1}$ of the (j+1)-th line is completed, the gate line Gj+1 is pulled down. In the meantime, the control signal RSW1 is not pulled down; the time-division switch $\mathbf{13}R_{2i-1}$ is kept turned on. The time-division switch $\mathbf{13}R_{2i-1}$ is continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 of the (j+3)-th line are driven in the (j+3)-th horizontal period in the same manner as those of the (j+1)-th line. The pixels 11 on other lines are driven in the same manner as well.

The above-described operation effectively decreases the number of times of switching of the time-division switches 13, thereby reducing the power consumption. In the operation of FIG. 17, the control signals RSW1, GSW1, BSW1, RSW2, GSW2, and BSW2 are pulled up only five times in total, and pulled down only five times in total, for each horizontal period.

Figure 18:
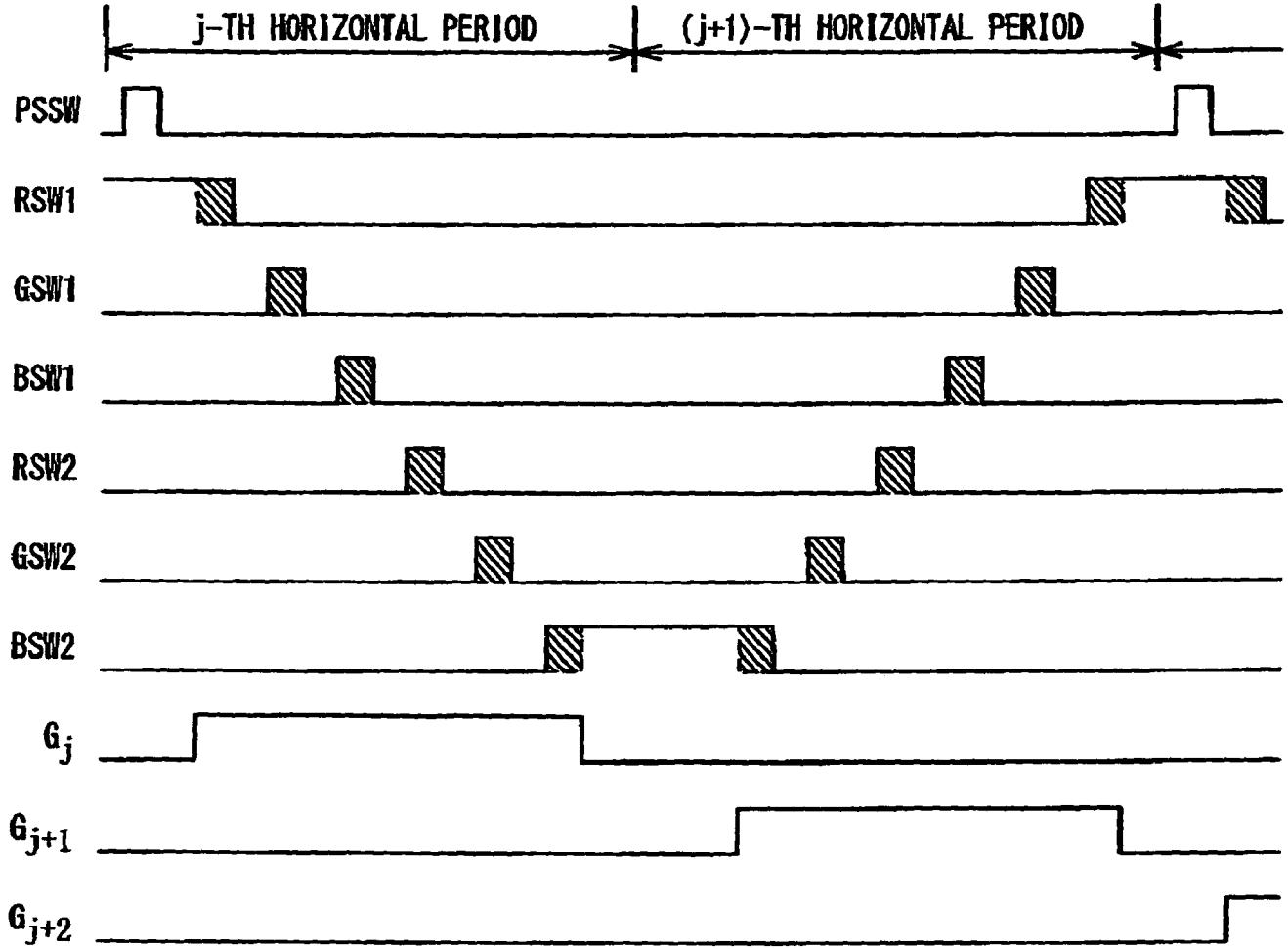
FIG. 18 is a timing chart illustrating an exemplary operation of the liquid crystal display apparatus of FIG. 16 when the 2H inversion drive is used.

It should be also noted that the 2H inversion drive technique may be used also for the case where six data lines are connected to one source output. FIG. 18 is an illustration showing an operation of the liquid crystal display apparatus adapted to the 2H inversion drive. As shown in FIG. 18, the external precharge signal PSSW is pulled up at the beginning of the j-th horizontal period, and the data lines are precharged. At the start of the following (j+1)-th horizontal period, on the contrary, the external precharge signal PSSW is not pulled up so that the data lines are not precharged. In the next (j+2)-th horizontal period, the data lines are precharged at the beginning of the period. The operation shown in FIG. 18 also decreases the number of times of switching of the time-division switches 13, effectively.

Third Embodiment

In a third embodiment, a source drive is designed to provide a function of precharging the data lines. In the third embodiment, the data lines are precharged by driving the source outputs to the precharge voltage Vpre with the time-division switches 13 turned on, differently from the liquid crystal display apparatuses FIG. 12 and FIG. 16, in which the precharge line 17 and the precharge switches 18 are provided for the liquid crystal display apparatus 1. For achieving such operation, the structure of the source driver according to the third embodiment is modified from those of the first embodiment and the second embodiment.

Figure 19:
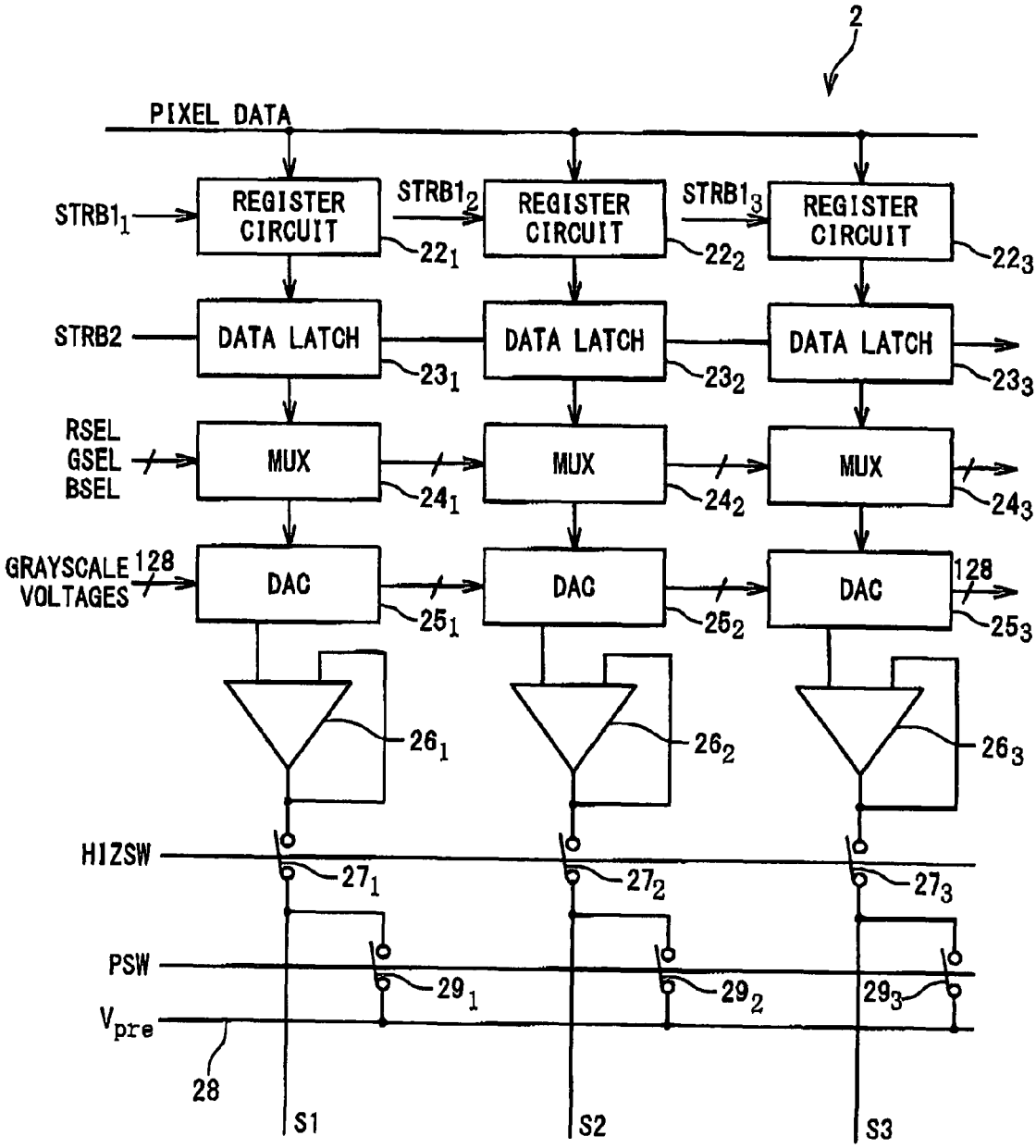
FIG. 19 is a block diagram illustrating an exemplary structure of a source driver of a liquid crystal display apparatus according to a third embodiment.

FIG. 19 is a block diagram showing a structure of the source driver 2 according to the third embodiment. The source driver 2 shown in FIG. 19 has a structure similar to that of the source driver shown in FIG. 7 except for that the source driver 2 according to the third embodiment additionally includes a precharge line 28, and precharge switches $\mathbf{29}_1$ to $\mathbf{29}_m$. The precharge voltage Vpre is supplied to the precharge line 28. The precharge switches $\mathbf{29}_1$ to $\mathbf{29}_m$ are connected between the precharge line 28 and the source outputs S1 to Sm. The precharge switches $\mathbf{29}_1$ to $\mathbf{29}_m$ are turned on and off in response to the internal precharge signal PSW. More specifically, the precharge switches $\mathbf{29}_1$ to $\mathbf{29}_m$ are turned on, when the internal precharge signal PSW is pulled up to the "High" level. Such structure allows the source outputs S1 to Sm to be driven to the precharge voltage Vpre through turning on the precharge switches $\mathbf{29}_1$ to $\mathbf{29}_m$ with the output switches $\mathbf{27}_1$ to $\mathbf{27}_m$ turned off.

Figure 20:
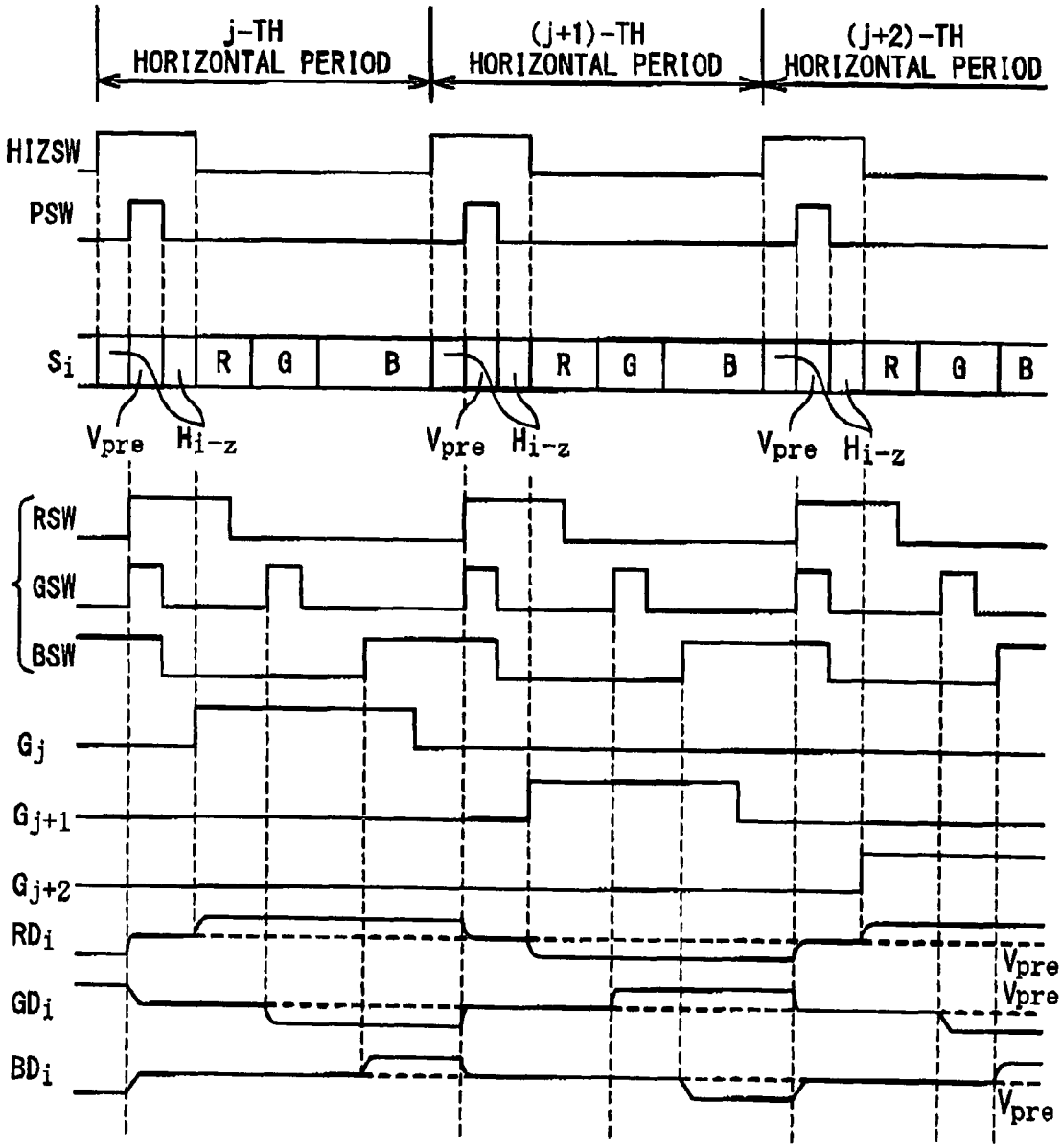
FIG. 20 is a timing chart illustrating an operation of the liquid crystal display apparatus according to the third embodiment.

FIG. 20 is a timing chart illustrating an exemplary operation of the liquid crystal display apparatus according to the third embodiment. One feature of the operation shown in FIG. 20 is that, after the precharge of the data lines through turning on all the time-division switches 13, ones of the time-division switches 13 associated with the data lines connected to the pixels 11 to be driven first, are continuously turned on until the actual drive of the pixels 11 driven first. Another feature is that the time-division switches 13 associated with the data lines connected to the pixels 11 driven lastly in each horizontal period are continuously turned on until the following precharge of the data lines.

More specifically, at the beginning of the j-th horizontal period, the control signal BSW is being activated continuously from the (j−1)-th horizontal period. In other words, the time-division switches 13B are already turned on at the beginning of the j-th horizontal period.

When the j-th horizontal period is started, the control signal HIZSW is pulled up to place the source outputs S1 to Sm into the high impedance state. Subsequently, the internal precharge signal PSW is pulled up to drive the source outputs S1 to Sm to the precharge voltage Vpre. The control signals RSW and GSW are also pulled up simultaneously with the pull-up of the internal precharge signal PSW. As a result, all the time-division switches 13 are turned on. Accordingly, the respective data lines are electrically connected to the corresponding source outputs S1 to Sm, so that all the data lines are driven to the precharge voltage Vpre.

After completing the precharge of the data lines, the internal precharge signal PSW is pulled down, and the source outputs S1 to Sm are returned to the high impedance state. In addition, the control signals GSW and BSW are pulled down to turn off the time-division switches 13G and 13B.

It should be noted that the control signal RSW is not pulled down after the precharge of the data lines is completed. The time-division switches 13R are continuously turned on. As will be described later, this aims to decrease the number of times of switching of the time-division switches 13.

Subsequently, the pixels 11 of the j-th line are driven in order of the pixels 11R, 11G, and 11B. Specifically, after completing the precharge, the gate line Gj is pulled up. Further, the drive voltages associated with the pixels 11R are outputted from the source outputs S1 to Sm, and supplied to the data lines RD. This allows the pixels 11R to be driven to desired drive voltages. The control signal RSW is then pulled down so that the time-division switches 13R are turned off. The data lines RD (and the pixels 11R) are kept at the drive voltages.

Subsequently, the control signals GSW and BSW are successively pulled up in this order, so that the time-division switches 13G and 13B are turned on in this order. Simultaneously with the turn-on of the time-division switches 13G and 13B, the drive voltages associated with the pixels 11G and pixels 11B are outputted from the source outputs Si to drive the pixels 11G and 11B in this order.

After the drive of the pixels 11B of the j-th line is completed, the gate line Gj is pulled down. However, the control signal BSW is not pulled down, so that the time-division switches 13B are kept turned on. The time-division switches 13B are continuously turned on until the next horizontal period (the (j+1)-th horizontal period).

In the (j+1)-th horizontal period, the pixels 11 of the (j+1)-th line are also driven in the same manner. The pixels 11 on other lines are driven in the same manner as well.

Figure 1:
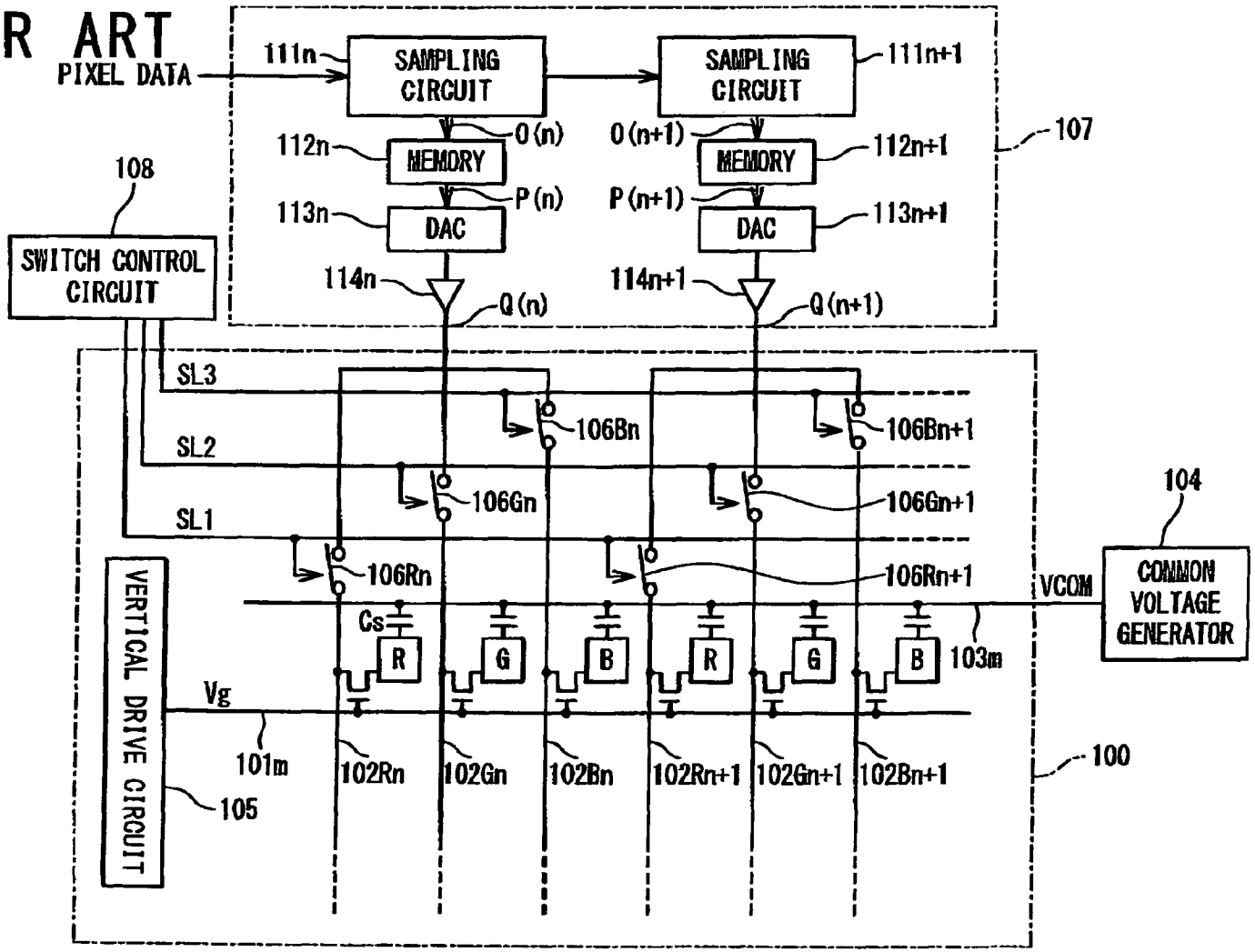
Fig. 1 PRIOR ART
FIG. 1 is a diagram illustrating the structure of a conventional liquid crystal display apparatus.
Figure 2:
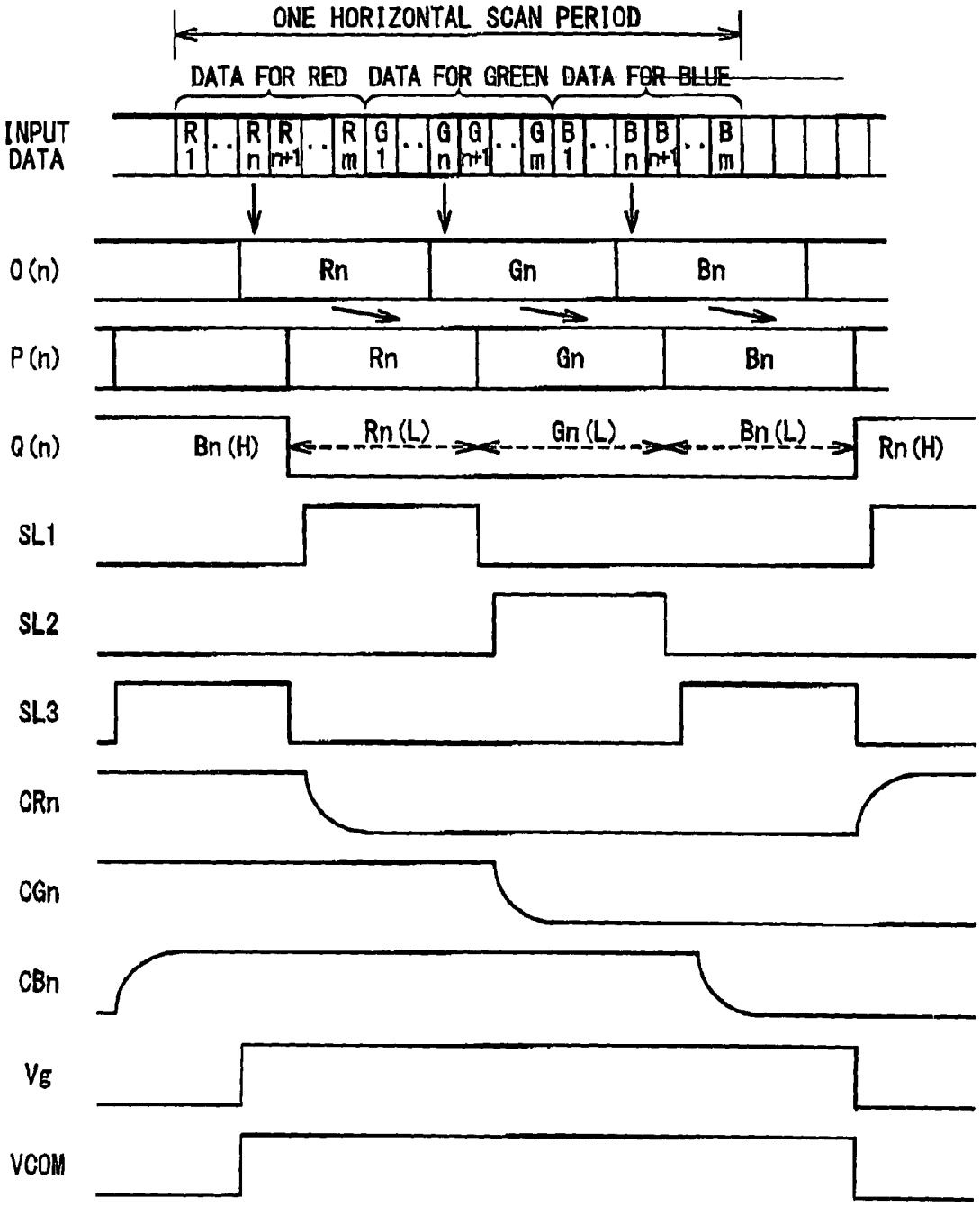
Fig. 2 PRIOR ART
FIG. 2 is a timing chart illustrating the operation of the liquid crystal display apparatus of FIG. 1.
Figure 3:
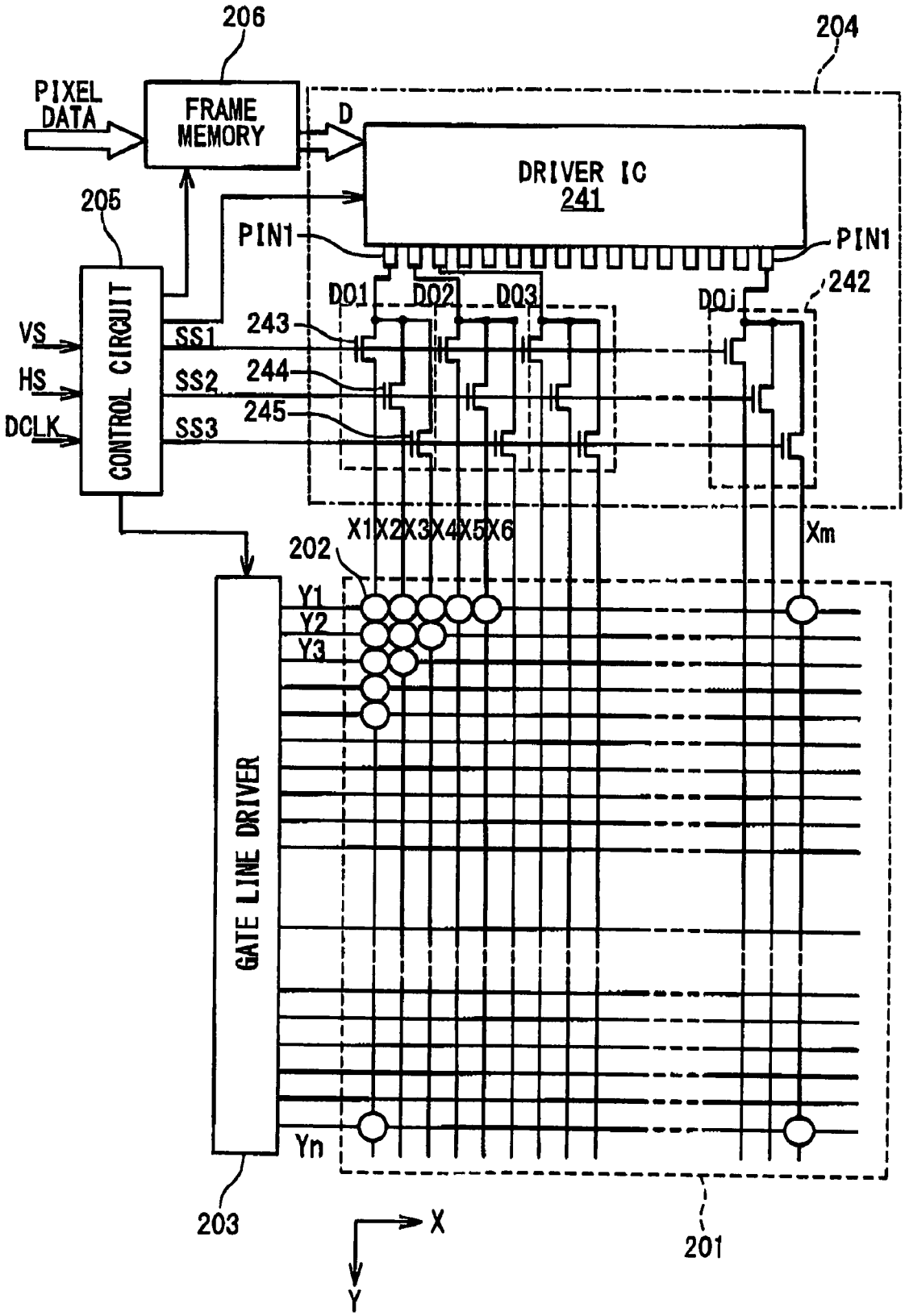
Fig. 3 PRIOR ART
FIG. 3 is a diagram illustrating the structure of another conventional liquid crystal display apparatus.
Figure 4:
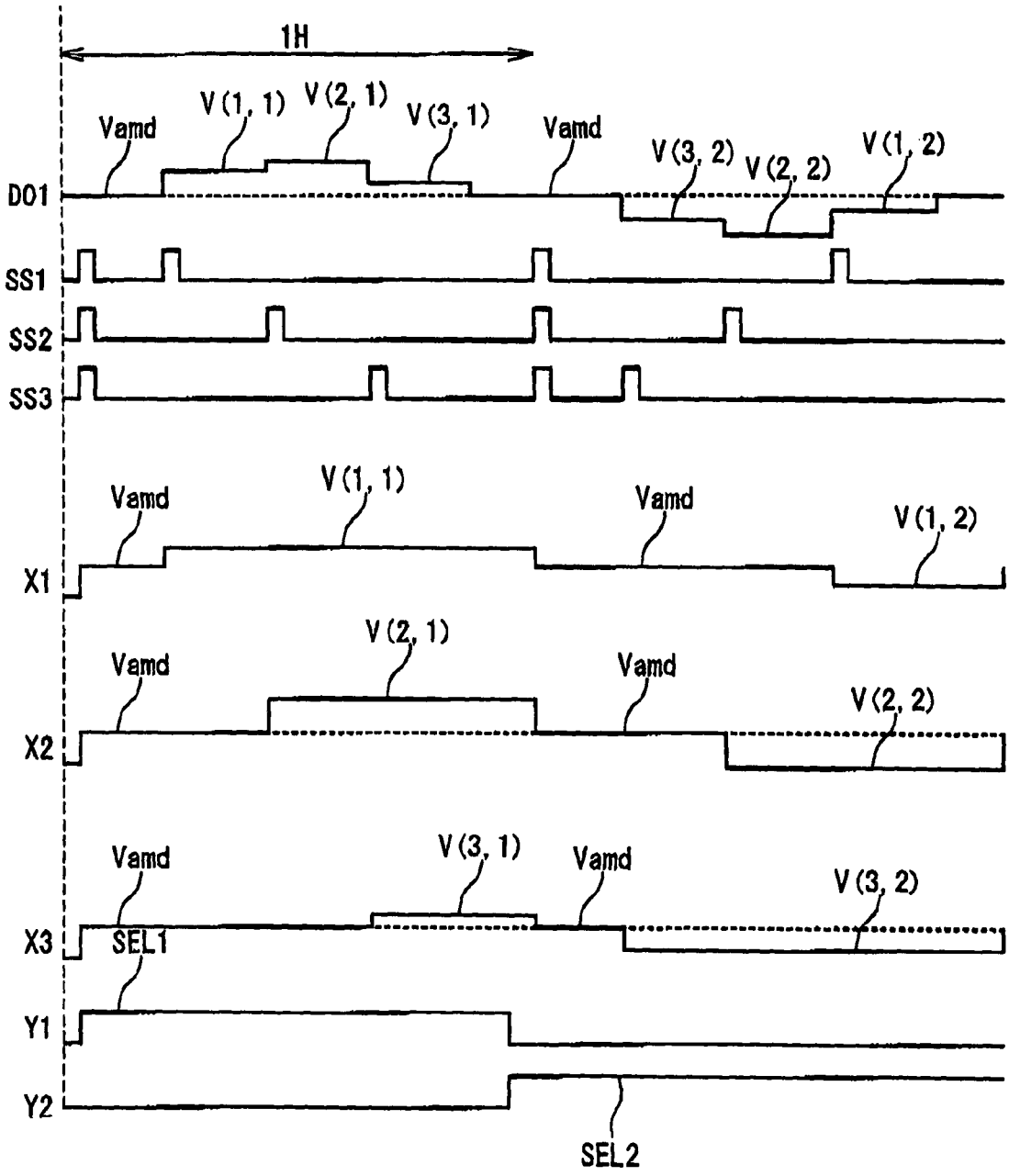
Fig. 4 PRIOR ART
FIG. 4 is a timing chart showing the operation of the liquid crystal display apparatus of FIG. 3.
Figure 21:
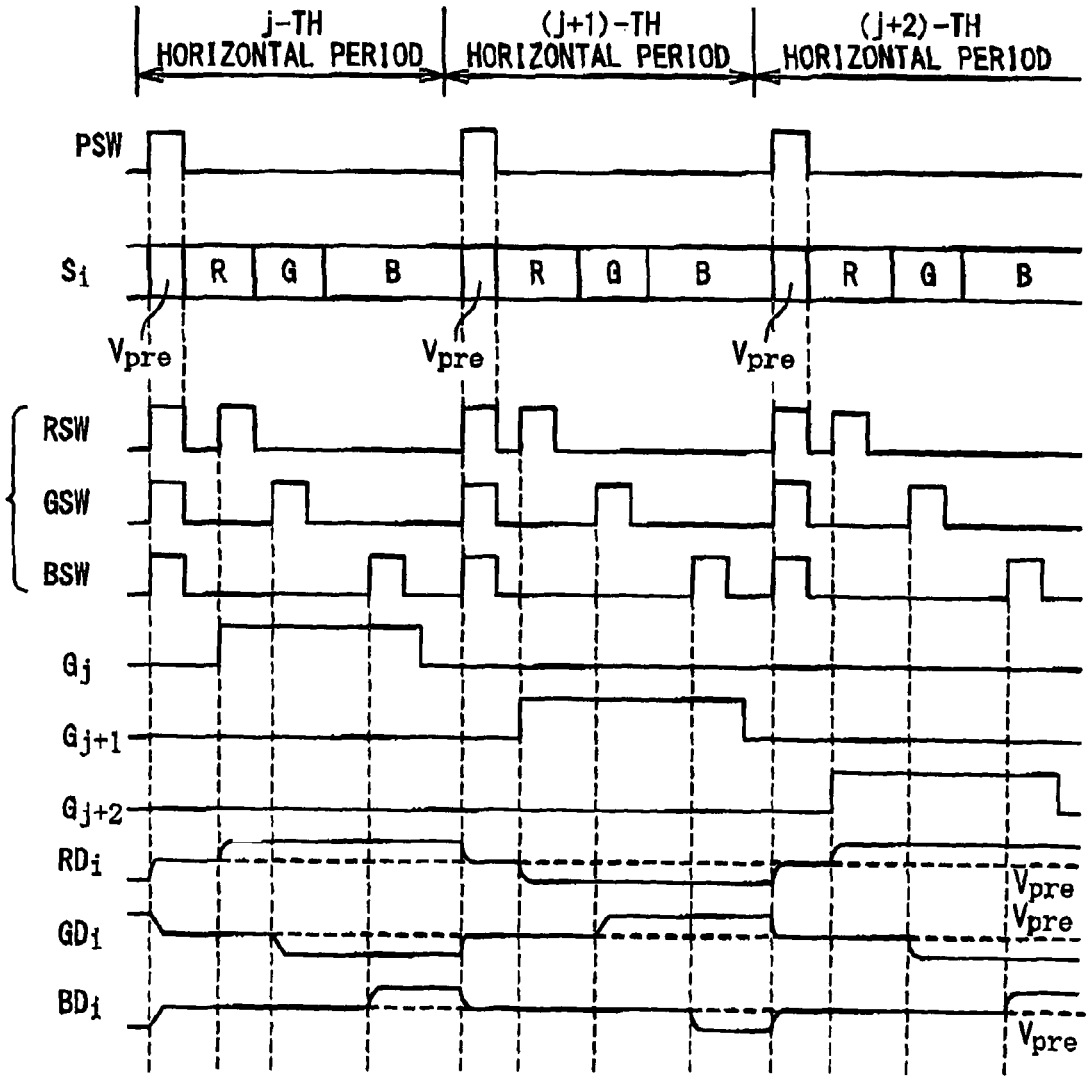
FIG. 21 is a timing chart illustrating an operation of a liquid crystal display apparatus according to a comparative example.

Such operation effectively decreases the number of times of switching the time-division switches 13, thereby effectively reducing the power consumption in the time-division switches 13. The advantage of the operation according to the third embodiment shown in FIG. 20 would be understood more clearly when compared to the operation shown in FIG. 21. In the operation of a typical liquid crystal display apparatus (for example, the liquid crystal display apparatus of FIG. 3), as shown in FIG. 21, all the control signals RSW, GSW, and BSW are pulled down when the precharge is completed, and the control signals RSW, GSW, and BSW are pulled up successively thereafter. With this, the pixels 11R, 11G, and 11B are driven successively. In such operation, the control signals RSW, GSW, and BSW are pulled up six times in total, and pulled down six times in total, for each horizontal period. Meanwhile, in the operation of the third embodiment shown in FIG. 20, the control signals RSW, GSW, and BSW are pulled up only four times in total, and pulled down only four times in total, for each horizontal period. The reduction of the number of times of the pull-down and pull-up of the control signals RSW, GSW, and BSW is equivalent to the reduction of the number of times of switching of the time-division switches 13. As thus described, the operation of the third embodiment shown in FIG. 20 effectively decreases the number of times of switching of the time-division switches 13.

Figure 22:
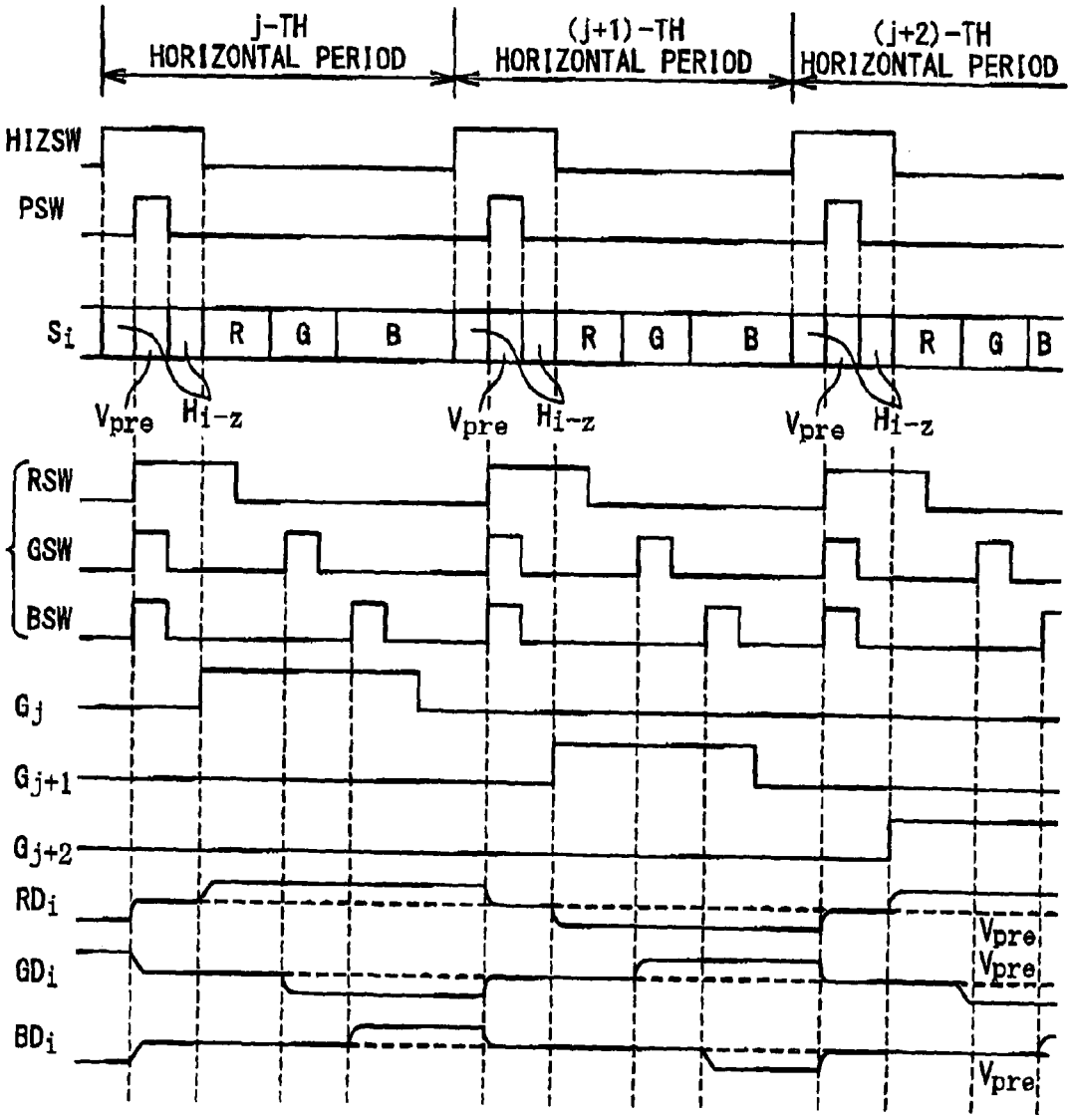
FIG. 22 is a timing chart illustrating another exemplary operation of the liquid crystal display apparatus according to the third embodiment.

It should be noted that the control signal BSW may be pulled down after the drive of the pixels 11B is completed, as shown in FIG. 22. It should be noted that the control signal RSW is continuously pulled up after the precharge also in this case. In the operation shown in FIG. 22, the control signals RSW, GSW, and BSW are pulled up five times in total, and pulled down five times in total, for each horizontal period. The operation of FIG. 22 effectively reduces the number of times of switching of the time-division switches 13 compared to the typical operation shown in FIG. 21, although it is larger than that of the operation shown in FIG. 20.

Figure 23:
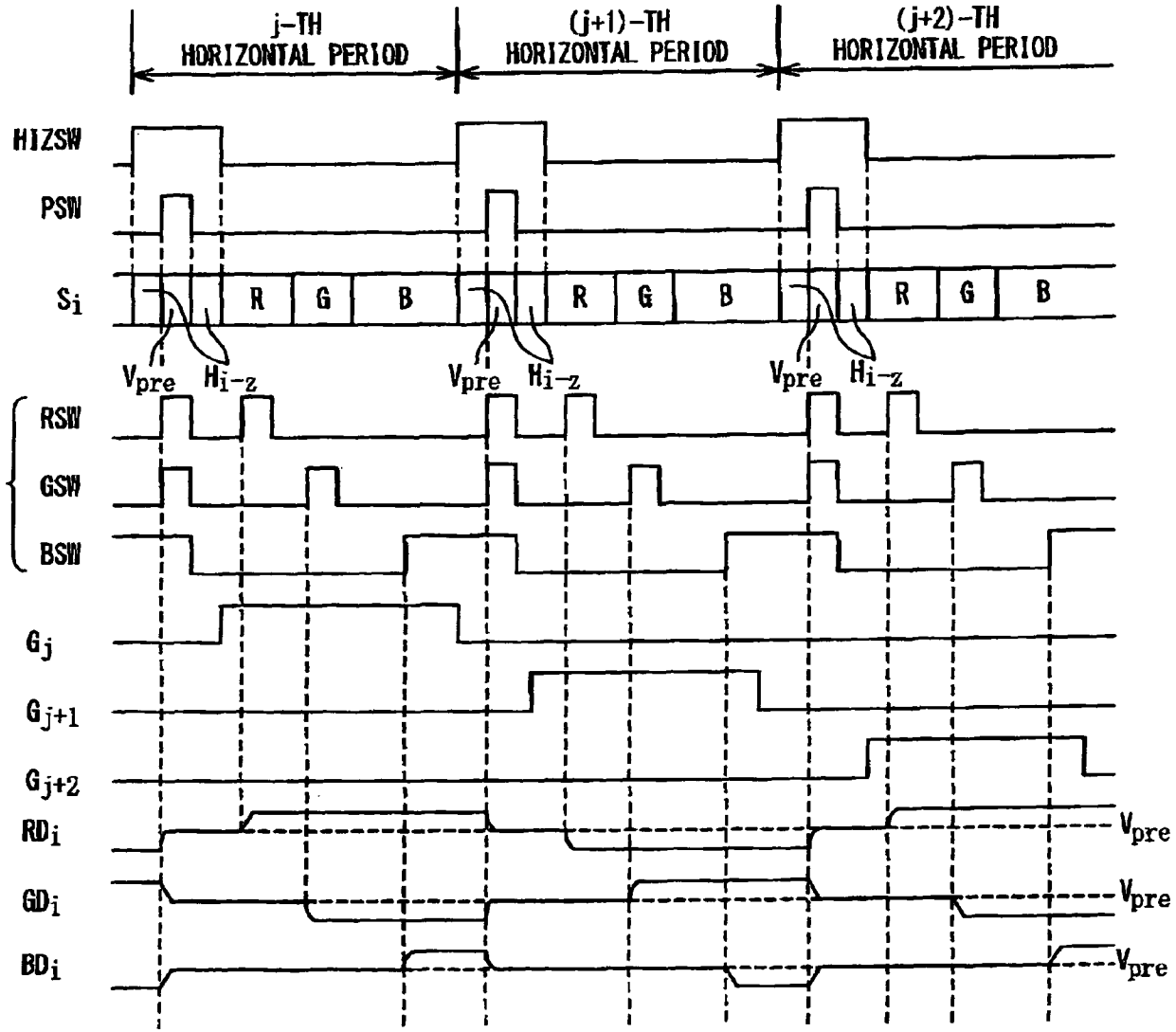
FIG. 23 is a timing chart illustrating still another exemplary operation of the liquid crystal display apparatus according to the third embodiment.

It should be also noted that the control signal RSW may be pulled down after the precharge is completed, as shown in FIG. 23. In this case, the control signal BSW is not pulled down until the beginning of the next horizontal period (the (j+1)-th horizontal period) after the drive of the pixels 11B is completed, so that the time-division switches 13B are kept turned on. The operation of FIG. 23 effectively reduces the number of times of switching of the time-division switches 13 compared to the typical operation shown in FIG. 21, even though it is larger than that of the operation shown in FIG. 20.

It should be also noted that the 2H inversion technique may be used in the third embodiment, which involves inverting the polarities of the drive voltages the pixels every two lines. When the 2H inversion drive is used, the data lines are precharged in every other horizontal period. In the followings, the operation of the liquid crystal display apparatus for the case that the 2H inversion drive is used will be described in detail.

Figure 24:
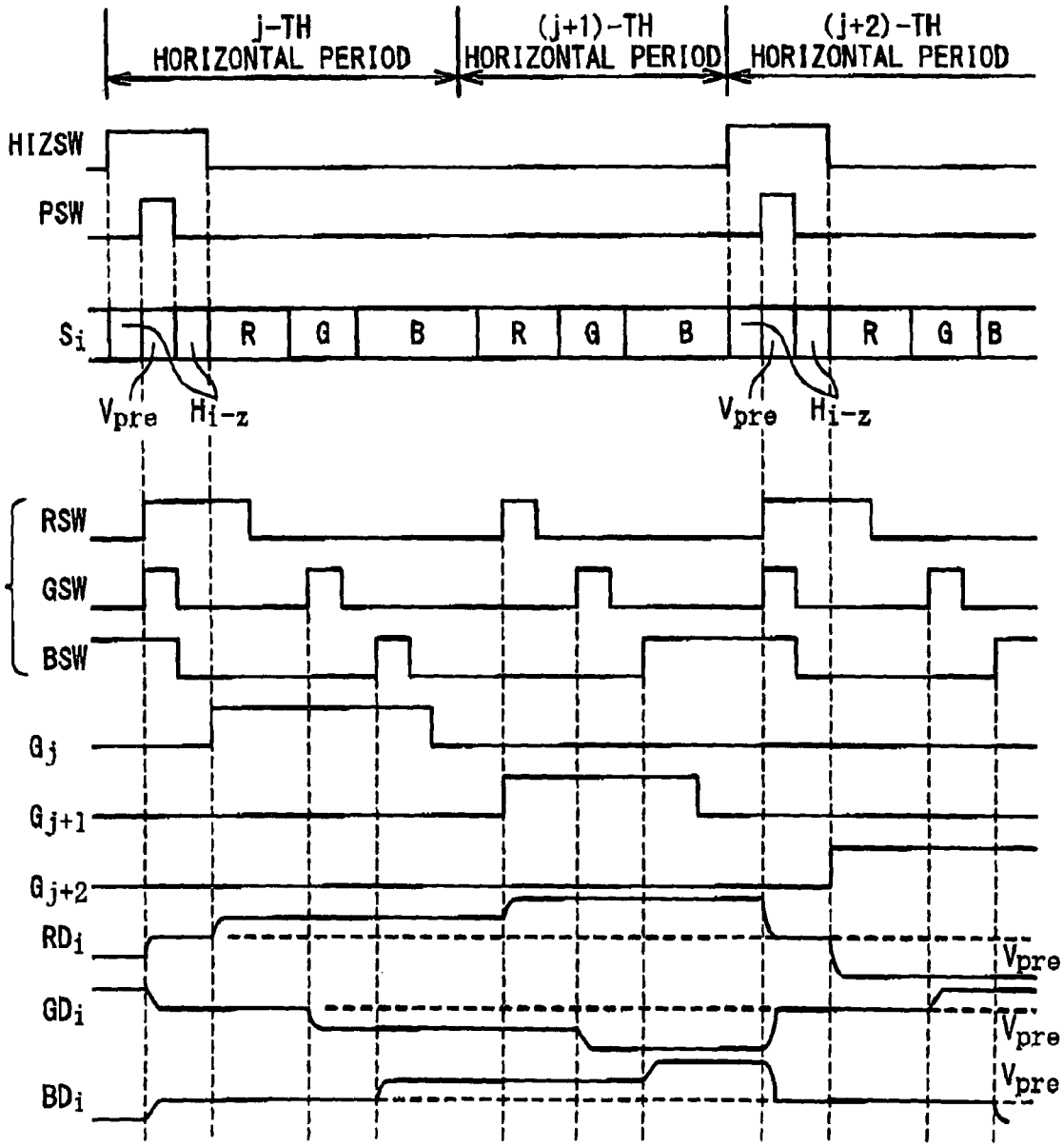
FIG. 24 is a timing chart illustrating an operation of the liquid crystal display apparatus of FIG. 20 when the 2H inversion drive is used.

FIG. 24 is a diagram illustrating the operation of the liquid crystal display apparatus according to the third embodiment when the 2H inversion drive is used. In the operation of FIG. 24, at the beginning of the j-th horizontal period, the control signal BSW is continuously activated from the (j−1)-th horizontal period. That is, the time-division switches 13B are already turned on at the beginning of the j-th horizontal period.

When the j-th horizontal period is started, the control signal HIZSW is pulled up to place the source outputs S1 to Sm into the high impedance state. Subsequently, the internal precharge signal PSW is pulled up to turn on the precharge switches $\mathbf{29}_1$ to $\mathbf{29}_m$. This achieves driving the source outputs S1 to Sm to the precharge voltage Vpre. Simultaneously with the pull-up of the internal precharge signal PSW, the control signals RSW, GSW, and BSW are also pulled up. As a result, all the time-division switches 13 are turned on. Accordingly, the data lines are connected to the associated source outputs S1 to Sm, so that all the data lines are driven to the precharge voltage Vpre.

After completing the precharge of the data lines, the internal precharge signal PSW is pulled down, and the source outputs S1 to Sm are returned to the high impedance state. In addition, the control signals GSW and BSW are pulled down, so that the time-division switches 13G and 13B are turned off.

Even after the precharge of the data lines is completed, the control signal RSW is not pulled down; the time-division switches 13R are kept turned on. As will be described later, this aims to decrease the number of times of switching of the time-division switches 13.

Subsequently, the pixels 11 of the j-th line are driven in order of the pixels 11R, 11G, and 11B. Specifically, after completing the precharge, the gate line Gj is pulled up. Further, the drive voltages associated with the pixels 11R are outputted from the source outputs S1 to Sm, and supplied to the data line RD. This allows the pixels 11R to be driven to desired drive voltages. Subsequently, the control signal RSW is pulled down so that the time-division switches 13R are turned off. The data lines RD (and the pixels 11R) are kept at the drive voltages.

Subsequently, the control signals GSW and BSW are pulled up in this order, so that the time-division switches 13G and 13B are turned on in this order. Simultaneously with the turn-on of the time-division switches 13G and 13B, the drive voltages associated with the pixels 11G and 11B are outputted from the source outputs S. This allows the pixels 11G and 11B to be driven in this order.

After the drive of the pixels 11B of the j-th line is completed, the control signal BSW is pulled down, and the gate line Gj is pulled down thereafter. It is noted that the operation of FIG. 24 is different from the operation of FIG. 20 in that the control signal BSW is pulled down after completing the drive of the pixels 11B.

In the (j+1)-th horizontal period, the data lines are not precharged. In the (j+1)-th horizontal period, the control signals RSW, GSW, and BSW are pulled up successively. Simultaneously with the pull-up of the control signals RSW, GSW, and BSW, the drive voltages associated with the pixels 11R, 11G, and 11B are outputted from the source outputs S1 to Sm. This allows the pixels 11R, 11G, and 11B to be driven in this order.

After the drive of the pixels 11B of the (j+1)-th line is completed, the gate line Gj+1 is pulled down. However, the control signal BSW is not pulled down, so that the time-division switches 13B are kept turned on. The time-division switches 13B are continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 of the (j+3)-th line are driven in the (j+3)-th horizontal period in the same manner as those of the (j+1)-th line. The pixels 11 on other lines are driven in the same manner as well.

In such operation, the control signals RSW, GSW, and BSW are pulled up three and a half times in total, and pulled down only three and a half times in total, for each horizontal period. As a result, the operation of FIG. 24 effectively decreases the number of times of switching of the time-division switches 13.

Figure 25:
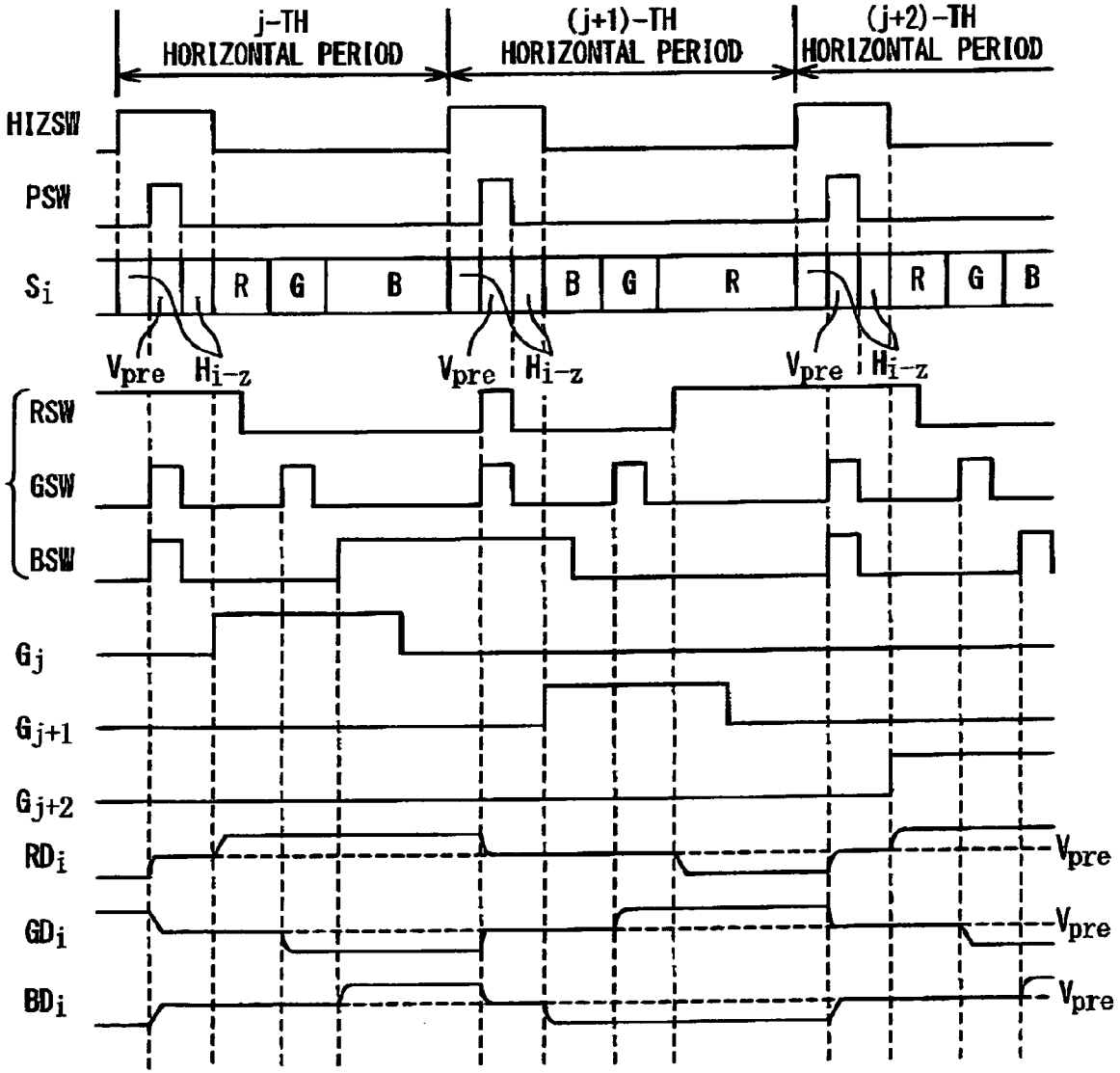
FIG. 25 is a timing chart illustrating a preferred operation of the liquid crystal display apparatus according to the third embodiment.

Further, as shown in FIG. 25, the pixels 11 of the j-th line may be driven in order of the pixels 11R, 11G, and 11B, while the pixels 11 of the (j+1)-th line driven in the reversed order. It should be noted that, after the pixels 11B are driven lastly among the pixels 11 of j-th line in the j-th horizontal period, the pixels 11B, which is connected to the same data lines, are driven first in the (j+1)-th horizontal period in the operation shown in FIG. 25.

More specifically, at the beginning of the j-th horizontal period, the control signal RSW is being activated continuously from the (j−1)-th horizontal period in the operation of FIG. 25. In other words, the time-division switches 13R are already turned on at the beginning of the j-th horizontal period.

When the j-th horizontal period is started, the control signal HIZSW is pulled up to place the source outputs S1 to Sm into the high impedance state. Subsequently, the internal precharge signal PSW is pulled up to turn on the precharge switches $29_1$ to $29_m$. As a result, the source outputs S1 to Sm are driven to the precharge voltage Vpre. Simultaneously with the pull-up of the internal precharge signal PSW, the control signals RSW and GSW are also pulled up. As a result, all the time-division switches 13 are turned on to provide electrical connections between the data lines and the associated source outputs S1 to Sm, so that all the data lines are driven to the precharge voltage Vpre.

After the completion of the precharge of the data lines, the internal precharge signal PSW is pulled down, and the source outputs S1 to Sm are returned to the high impedance state. In addition, the control signals GSW and BSW are pulled down, so that the time-division switches 13G and 13B are turned off.

Even after the precharge of the data lines is completed, the control signal RSW is not pulled down; the time-division switches 13R are continuously turned on. As will be described later, this aims to decrease the number of times of switching of the time-division switches 13.

Subsequently, the pixels 11 of the j-th line are driven in order of the pixels 11R, 11G, and 11B. Specifically, after completing the precharge, the gate line Gj is pulled up. Further, the drive voltages associated with the pixels 11R are outputted from the source outputs S1 to Sm, and supplied to the data lines RD. As a result, the pixels 11R are driven to desired drive voltages. Subsequently, the control signal RSW is pulled down so that the time-division switches 13R are turned off. The data lines RD (and the pixels 11R) are kept at the drive voltages.

Subsequently, the control signals GSW and BSW are pulled up in this order, so that the time-division switches 13G and 13B are turned on in this order. Simultaneously with the turn-on of the time-division switches 13G and 13B, the drive voltages associated with the pixels 11G and 11B are outputted from the source outputs S. As a result, the pixels 11G and 11B are driven in this order.

After the drive of the pixels 11B of the j-th line is completed, the gate line Gj is pulled down. However, the control signal BSW is not pulled down, so that the time-division switches 13B are kept turned on. The time-division switches 13B are continuously turned on until the next horizontal period (the (j+1)-th horizontal period).

In the (j+1)-th horizontal period, the pixels 11 of the (j+1)-th line are also driven successively after the precharge of the data lines. It should be noted that the pixels 11 of the (j+1)-th line are driven in order of the pixels 11B, 11G, and 11R in the (j+1)-th horizontal period.

Specifically, when the j-th horizontal period is started, the control signal HIZSW is pulled up to place the source outputs Si to Sm into the high impedance state. Subsequently, the internal precharge signal PSW is pulled up to turn on the precharge switches $29_1$-$29_m$. As a result, the source outputs S1 to Sm are driven to the precharge voltage Vpre. Simultaneously with the pull-up of the internal precharge signal PSW, the control signals RSW and GSW are also pulled up. As a result, all the time-division switches 13 are turned on to provide electrical connections between the data lines and the associated source outputs S1 to Sm, so that all the data lines are driven to the precharge voltage Vpre.

After the precharge of the data lines is completed, the internal precharge signal PSW is pulled down, and the source outputs S1 to Sm are returned to the high impedance state. In the meantime, the control signal BSW is not pulled down even after completing the precharge of the data lines; the time-division switches 13B are continuously turned on. This aims to decrease the number of times of switching of the time-division switches 13.

Subsequently, the gate line Gj+1 is pulled up, and the drive voltages associated with the pixels 11B are outputted from the source outputs S1 to Sm. Since the control signal BSW is being pulled up continuously, the drive voltages are supplied immediately to the data lines BD to drive the pixels 11B, when the drive voltages associated with the pixels 11B are outputted. Subsequently, the control signal BSW is pulled down so that the time-division switches 13B are turned off.

Subsequently, the control signals GSW and RSW are pulled up in this order to turn on the time-division switches 13G and 13R in this order. Simultaneously with the turn-on of the time-division switches 13G and 13R, the drive voltages associated with the pixels 11G and 11R are outputted from the source outputs S1 to Sm to drive the pixels 11G and 11R in this order.

After the drive of the pixels 11R of the (j+1)-th line is completed, the gate line Gj+1 is pulled down. However, the control signal RSW is not pulled down, so that the time-division switches 13R are kept turned on. The time-division switches 13R are continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 of the (j+3)-th line are driven in the (j+3)-th horizontal period in the same manner as those of the (j+1)-th line. The pixels 11 on other lines are driven in the same manner.

In such operation, the control signals RSW, GSW, and BSW are pulled up only four times in total, and pulled down only four times in total, for each horizontal period. The operation of FIG. 25 effectively decreases the number of times of switching of the time-division switches 13.

The 2H inversion drive technique may be also used for the case when the pixels 11 of the j-th line are driven in order of the pixels 11R, 11G, 11B and the pixels 11 on the (j+1)-th line are driven in the reversed order. When the 2H inversion drive is used, the data lines are precharged in every other horizontal period.

Figure 26:
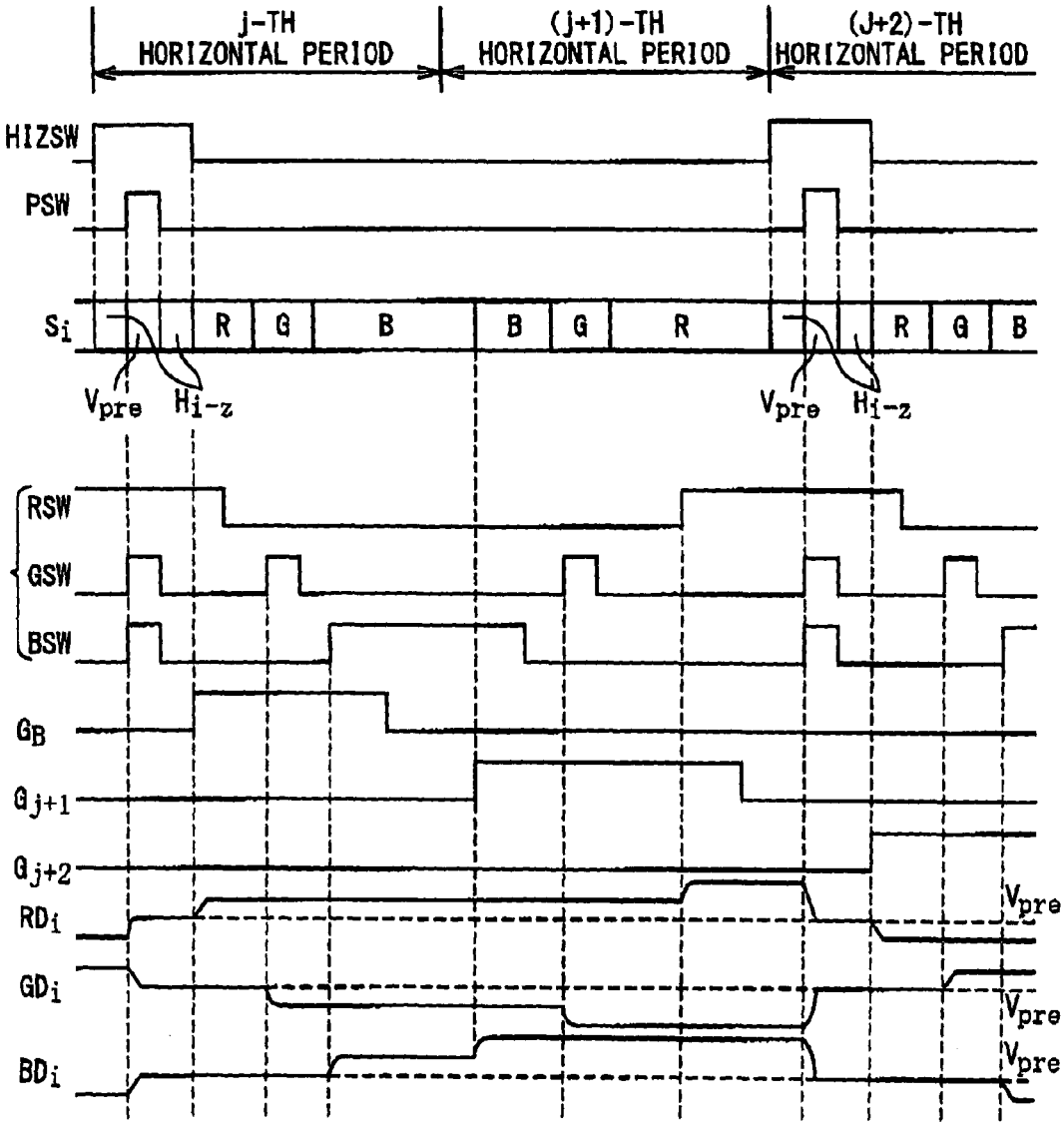
FIG. 26 is a timing chart illustrating a preferred operation of the liquid crystal display apparatus of FIG. 20 when the 2H inversion drive technique is used.

FIG. 26 is a diagram illustrating the operation of the liquid crystal display apparatus according to the third embodiment when the 2H inversion drive technique is used. In the operation of FIG. 26, at the beginning of the j-th horizontal period, the control signal RSW is continuously activated from the (j−1)-th horizontal period. In other words, the time-division switches 13R are already turned on at the start of the j-th horizontal period.

When the j-th horizontal period is started, the control signal HIZSW is pulled up to place the source outputs S1 to Sm into the high impedance state. Subsequently, the internal precharge signal PSW is pulled up to turn on the precharge switches $29_1$-$29_m$, and the source outputs S1-Sm are driven to the precharge voltage Vpre. Simultaneously with the pull-up of the internal precharge signal PSW, the control signals GSW and BSW are also pulled up. As a result, all the time-division switches 13 are turned on. Accordingly, the data lines are connected to the associated source outputs S1-Sm, so that all the data lines are driven to the precharge voltage Vpre.

After the completion of the precharge of the data lines, the internal precharge signal PSW is pulled down, and the source outputs S1 to Sm are returned to the high impedance state. In addition, the control signals GSW and BSW are pulled down, so that the time-division switches 13G and 13B are turned off.

Even after the precharge of the data lines is completed, the control signal RSW is not pulled down. The time-division switches 13R are continuously turned on. This aims to decrease the number of times of switching of the time-division switches 13.

Subsequently, the pixels 11 of the j-th line are driven in order of the pixels 11R, 11G, and 11B. Specifically, after the completion of the precharge, the gate line Gj is pulled up and the drive voltages associated with the pixels 11R are outputted from the source outputs S1 to Sm and supplied to the data lines RD. As a result, the pixels 11R are driven to desired drive voltages. Subsequently, the control signal RSW is pulled down so that the time-division switches 13R are turned off. The data lines RD (and the pixels 11R) are kept at the drive voltages.

Subsequently, the control signals GSW and BSW are pulled up in this order, so that the time-division switches 13G and 13B are turned on in this order. Simultaneously with the turn-on of the time-division switches 13G and 13B, the drive voltages associated with the pixels 11G and 11B are outputted from the source outputs S to drive the pixels 11G and 11B in this order.

After the drive of the pixels 11B of the j-th line is completed, the gate line Gj is pulled down. However, the control signal BSW is not pulled down, so that the time-division switches 13B are kept turned on. The time-division switches 13B are continuously turned on until the next horizontal period (the (j+1)-th horizontal period).

In the (j+1)-th horizontal period, the data lines are not precharged. In the (j+1)-th horizontal period, the pixels 11 of the (j+1)-th line are driven in order of the pixels 11B, 11G, and 11R. It should be noted that, when the pixels 11B are driven lastly among the pixels 11 of the j-th line in the j-th horizontal period, the pixels 11B of the (j+1)-th line, which are connected with the same data lines, are driven first in the (j+1)-th horizontal period.

More specifically, when the gate line Gj+1 is pulled up after the beginning of the (j+1)-th horizontal period, the drive voltages associated with the pixels 11B are outputted from the source outputs S1 to Sm. Since the control signal BSW is being pulled up continuously from the j-th horizontal period, the drive voltages are supplied immediately to the data line BD, and the pixels 11B are driven to desired drive voltages, when the drive voltages associated with the pixels 11B are outputted. Subsequently, the control signal BSW is pulled down so that the time-division switches 13B are turned off.

Subsequently, the control signals GSW and RSW are activated in this order to turn on the time-division switches 13G and 13R in this order. Simultaneously with the turn-on of the time-division switches 13G and 13R, the drive voltages associated with the pixels 11G and 11R are outputted from the source outputs S1 to Sm to drive the pixels 11G and 11R in this order.

After the drive of the pixels 11R of the (j+1)-th line is completed, the gate line Gj+1 is pulled down. However, the control signal PSW is not pulled down, so that the time-division switches 13R are kept turned on. The time-division switches 13R are continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 of the (j+3)-th line are driven in the (j+3)-th horizontal period in the same manner as those of the (j+1)-th line. The pixels 11 on other lines are driven in the same manner.

In such operation, the control signals RSW, GSW, and BSW are pulled up only three times in total, and pulled down only three times in total, for each horizontal period. The operation of FIG. 26 effectively decreases the number of times of switching of the time-division switches 13.

The operation of the liquid crystal display apparatus according to the third embodiment may be applied to a case where the number of data lines connected with each source output is other than three. For example, the operation of the liquid crystal display apparatus according to the third embodiment may be applied to the case where six data lines are connected to each source output (as is the case of the structure shown in FIG. 10). It should be noted that, the source driver 2 is requested to be adapted to output the precharge voltage Vpre from the source output, in this case.

Figure 27:
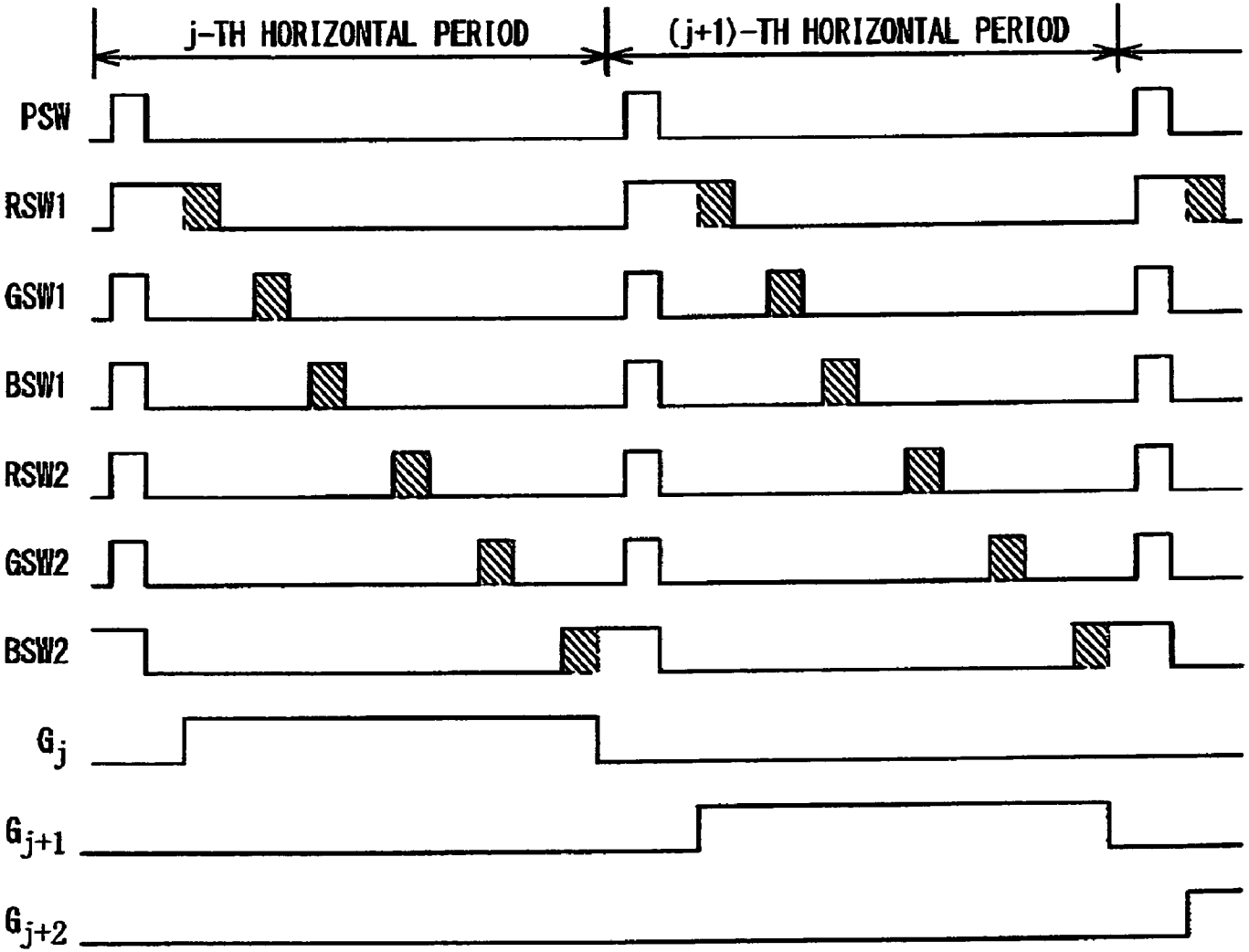
FIG. 27 is a timing chart illustrating an operation of the liquid crystal display apparatus according to the third embodiment, in the case that six data lines are connected to each source output.

FIG. 27 is a timing chart illustrating an exemplary operation of the liquid crystal display apparatus according to the third embodiment, in the case that six data lines are connected to each source output. The operation of FIG. 27 is almost identical to the operation of FIG. 20, except for that the operation of FIG. 27 is modified in accordance with the change in the number of data lines connected with each single source output. At the beginning of the j-th horizontal period, the control signal BSW2 is being pulled up continuously from the (j−1)-th horizontal period. Therefore, the time-division switch 13$R_{2i}$ is already turned on at the beginning of the j-th horizontal period. After the beginning of the j-th horizontal period, the external precharge signal PSW and the control signals RSW1, GSW1, BSW1, RSW2, GSW2 are pulled up, and the precharge voltage Vpre is outputted from the source outputs S1 to Sm. As a result, all the data lines are precharged to the precharge voltage Vpre.

After the completion of the precharge, the control signals GSW1, BSW1, RSW2, GSW2, and BSW2 are pulled down. However, the control signal RSW1 is continuously pulled up; in other words, the time-division switch 13$R_{2i-1}$ is continuously turned on even after the precharge is completed.

Subsequently, the gate line Gj is activated and the pixels 11 on the j-th line are driven in order of the pixels 11$R_{2i-1}$, 11$G_{2i-1}$, 11$B_{2i-1}$, 11$R_{2i}$, 11$G_{2i}$, and 11$B_{2i}$. In FIG. 27, hatchings indicate the period during which the associated pixels 11 are driven. It is unnecessary to switch the control signal RSW1 when the pixel 11$R_{2i-1}$ is driven, since the control signal RSW1 is continuously pulled up after the completion of the precharge.

After the drive of the pixel 11$B_{2i}$ of the j-th line is completed, the gate line Gj is pulled down. However, the control signal BSW2 is not pulled down, so that the time-division switch 13$B_{2i}$ is continuously kept turned on. The time-division switch 13$B_{2i}$ is continuously turned on until the next horizontal period (the (j+1)-th horizontal period).

In the next (j+1)-th horizontal period, the pixels 11 of the (j+1)-th line are driven in the same manner as those of the j-th line. The pixels 11 on other lines are driven in the same manner as well.

In such operation, the control signals RSW, GSW, and BSW are pulled up only ten times in total, and pulled down only ten times in total, for each horizontal period. The operation of FIG. 27 effectively decreases the number of times of switching of the time-division switches 13.

Figure 28:
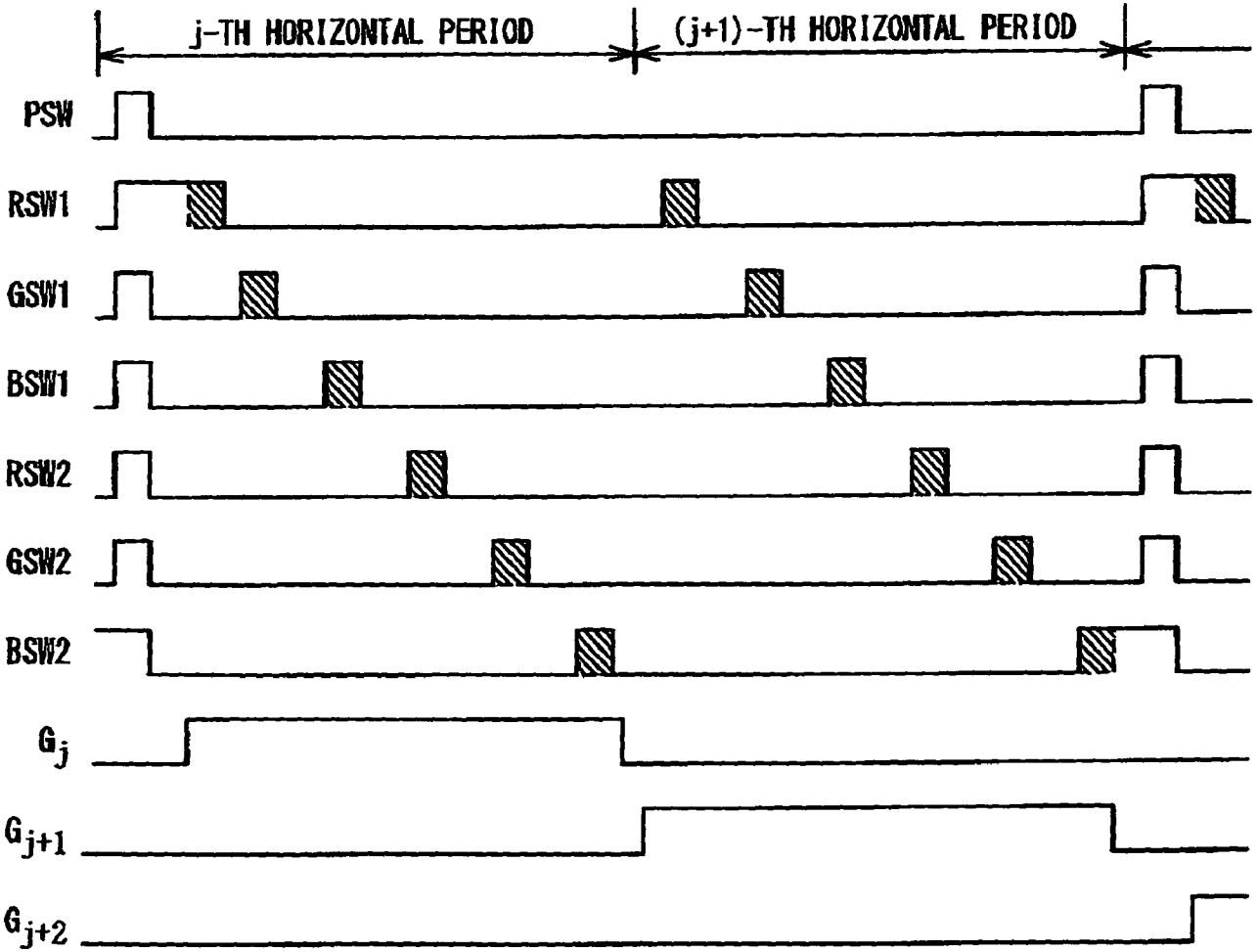
FIG. 28 is a timing chart illustrating an exemplary operation of the liquid crystal display apparatus according to the third embodiment when six data lines are connected to each source output in the case that the 2H inversion drive technique is used.

It should be noted that the 2H inversion drive technique may be used for the case that six data lines are connected to each source output. FIG. 28 is a timing chart illustrating the operation modified from the operation shown in FIG. 27 so as to be adapted to the 2H inversion drive technique. As shown in FIG. 28, the internal precharge signal PSW and control signals RSW1, GSW1, BSW1, RSW2, GSW2, and BSW2 are pulled up at the beginning of the j-th horizontal period, and the data lines are precharged. At the beginning of the following (j+1)-th horizontal period, on the contrary, the internal precharge signal PSW is not pulled up so that the data lines are not precharged. At the beginning of the next (j+2)-th horizontal period, the data lines are precharged. The polarities of the drive voltages supplied to the respective pixels 11 of the (j+2)-th line driven in the (j+2)-th horizontal period are inverted from the polarities of the drive voltages supplied to the corresponding pixels 11 of the j-th line.

In the operation shown in FIG. 28, the control signals RSW1, GSW1, BSW1, RSW2, GSW2, and BSW2 are pulled up only eight times in total, and pulled down only eight times in total, for each horizontal period. This effectively decreases the number of times of switching of the time-division switches 13.

Figure 29:
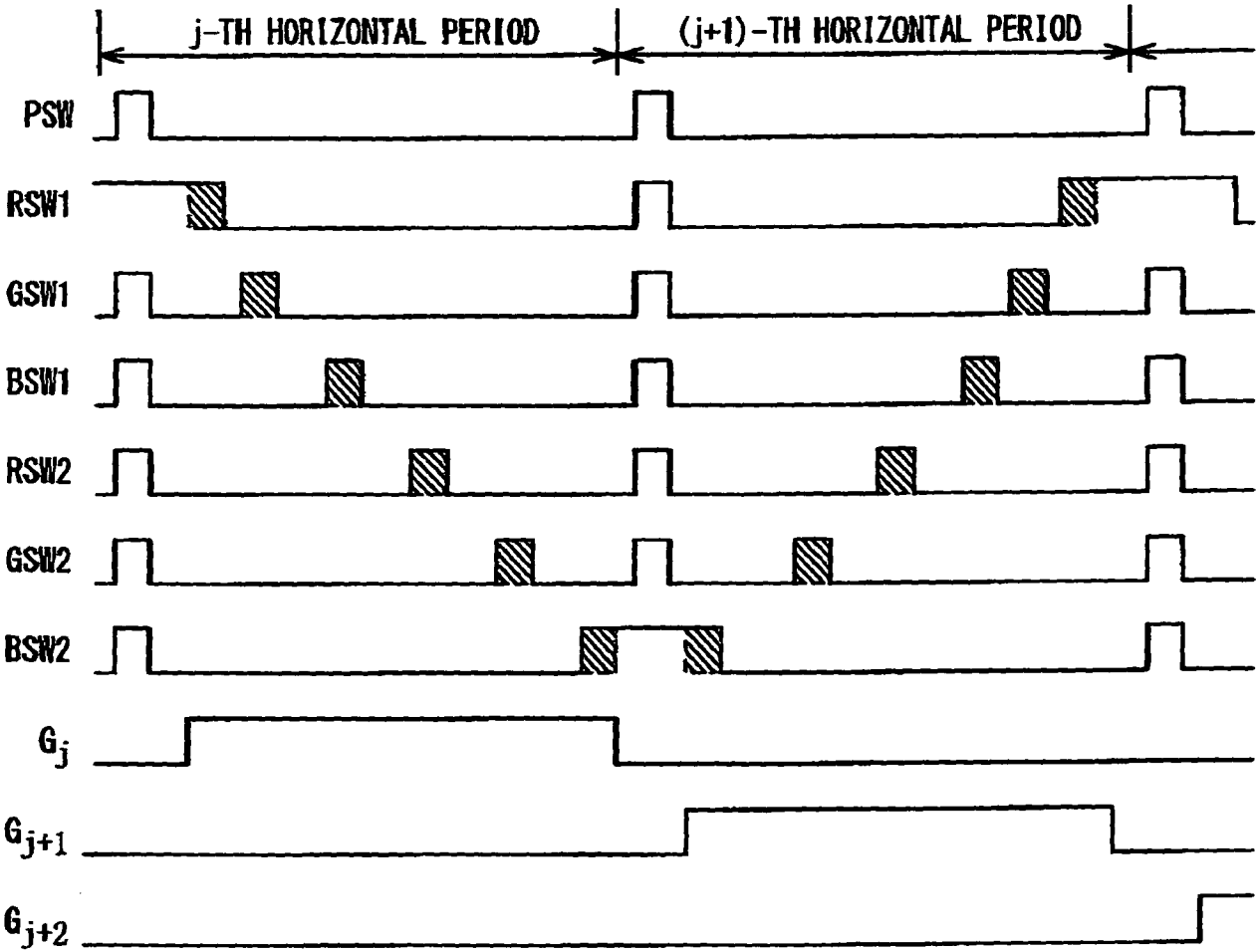
FIG. 29 is a timing chart illustrating a preferred operation of the liquid crystal display apparatus of the third embodiment, in the case that six data lines are connected to each source output.

FIG. 29 is a timing chart illustrating another exemplary operation of the liquid crystal display apparatus according to the third embodiment, in the case that six data lines are connected to each source output. In the operation of FIG. 29, the pixels 11 of the j-th line are driven in order of the pixels 11$R_{2i-1}$, 11$G_{2i-1}$, 11$B_{2i-1}$, 11$R_{2i}$, 11$G_{2i}$, and 11$B_{2i}$, while the pixels 11 of the (j+1)-th line are driven in a reversed order. It should be noted that, after the pixel 11$B_{2i}$ of j-th line is driven lastly among the pixels 11 of the j-th line in the j-th horizontal period, the pixel 11$B_{2i}$ of the (j+1)-th line, which is connected to the same data line, is driven first in the (j+1)-th horizontal period in the operation shown in FIG. 29.

At the beginning of the j-th horizontal period, the control signal RSW1 is being pulled up continuously from the (j−1)-th horizontal period. Therefore, the time-division switch 13$R_{2i-1}$, is already turned on at the beginning of the j-th horizontal period. At the beginning of the j-th horizontal period, the internal precharge signal PSW and the control signals GSW1, BSW1, RSW2, GSW2, BSW2 are pulled up, and the precharge voltage Vpre is outputted from the source outputs S1 to Sm to precharge all the data lines to the precharge voltage Vpre.

After the completion of the precharge, the control signals GSW1, BSW1, RSW2, GSW2, and BSW2 are pulled down. However, the control signal RSW1 is continuously pulled up. In other words, the time-division switch 13$R_{2i-1}$ is continuously turned on even after the precharge is completed.

Subsequently, the gate line Gj is activated and the pixels 11 of the j-th line are driven in order of the pixels 11$R_{2i-1}$, 11$G_{2i-1}$, 11$B_{2i-1}$, 11$R_{2i}$, 11$G_{2i}$, and 11$B_{2i}$. In FIG. 29, hatchings indicate the periods during which the associated pixels 11 are driven. It is unnecessary to switch the control signal RSW1 when driving the pixel 11$R_{2i-1}$, since the control signal RSW1 is continuously pulled up after the completion of the precharge.

After the drive of the pixel 11$B_{2i}$ of the j-th line is completed, the gate line Gj is pulled down. However, the control signal BSW2 is not pulled down, so that the time-division switch 13$B_{2i}$ is kept turned on. The time-division switch 13$B_{2i}$ is continuously turned on until the next horizontal period (the (j+1)-th horizontal period).

When the next (j+1)-th horizontal period is started, the internal precharge signal PSW and the control signals RSW1, GSW1, BSW1, RSW2, and GSW2 are pulled up, and the precharge voltage Vpre is outputted from the source outputs S1 to Sm to precharge all the data lines to the precharge voltage Vpre.

After the completion of the precharge, the control signals RSW1, GSW1, BSW1, RSW2, and GSW2 are pulled down. However, the control signal BSW2 is continuously pulled up. In other words, the time-division switch 13$B_{2i}$ is continuously turned on even after the precharge is completed.

Subsequently, the gate line Gj+1 is activated and the pixels 11 of the (j+1)-th line are driven in order of the pixels 11$B_{2i}$, 11$G_{2i}$, 11$R_{2i}$, 11$B_{2i-1}$, 11$G_{2i-1}$, and 11$R_{2i-1}$. It is unnecessary to switch the control signal RSW2 when driving the pixel 11$R_{2i}$, since the control signal RSW2 is continuously pulled up after the completion of the precharge.

After the drive of the pixel 11$B_{2i}$ of the (j+1)-th line is completed, the gate line Gj+1 is pulled down. However, the control signal RSW1 is not pulled down, so that the time-division switch 13$R_{2i-1}$ is kept turned on. The time-division switch 13$R_{2i-1}$ is continuously turned on until the next horizontal period (the (j+1)-th horizontal period).

In the (j+2)-th horizontal period, the pixels 11 of the (j+2)-th line are driven in the same manner as those of the j-th line. Thereafter, the pixels 11 of the (j+3)-th line are driven in the (j+3)-th horizontal period in the same manner as those of the (j+1)-th line. The pixels 11 of other lines are driven in the same manner as well.

In such operation, the control signals RSW, GSW, and BSW are pulled up only ten times in total, and pulled down only ten times in total, for each horizontal period. The operation of FIG. 27 effectively decreases the number of times of switching of the time-division switches 13.

Figure 30:
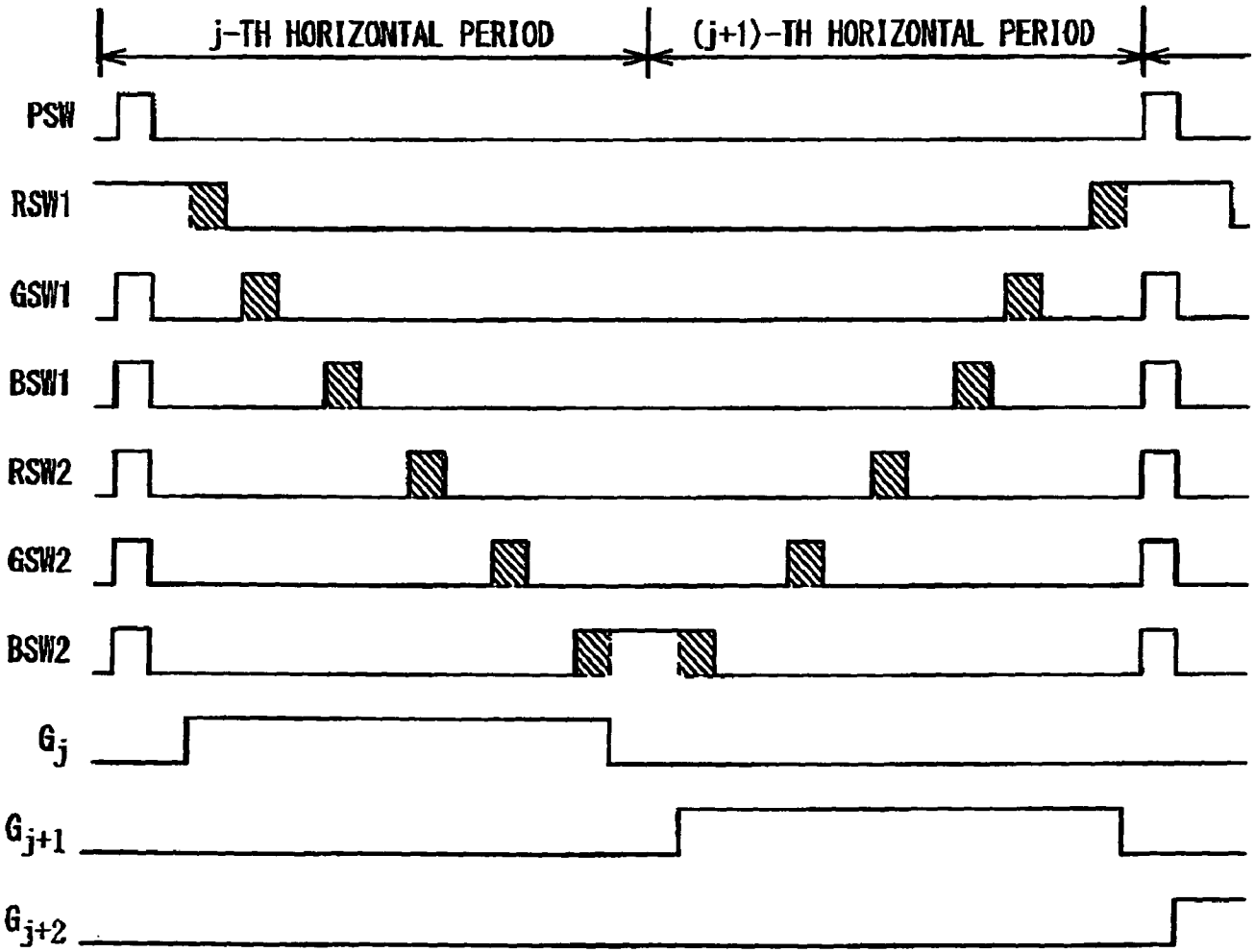
FIG. 30 is a timing chart illustrating a preferred operation of the third embodiment when six data lines are connected to each source output in the case that the 2H inversion drive technique is used.

FIG. 30 is a timing chart showing an operation modified from the operation shown in FIG. 29 so as to be adapted to the 2H inversion drive technique. As shown in FIG. 30, the internal precharge signal PSW and the control signals RSW1, GSW1, BSW1, RSW2, GSW2, BSW2 are pulled up at the beginning of the j-th horizontal period to pregharge the data lines. However, at the beginning of the following (j+1)-th horizontal period, the internal precharge signal PSW is not pulled up so that the data lines are not precharged. In the next (j+2)-th horizontal period, the data lines are precharged at the beginning of the period. The polarities of the drive voltages supplied to the respective pixels 11 of the (j+2)-th line in the (j+2)-th horizontal period are inverted from the polarities of the drive voltages supplied to the corresponding pixels 11 of the j-th line.

In the operation shown in FIG. 30, the control signals RSW1, GSW1, BSW1, RSW2, GSW2, and BSW2 are pulled up only seven and a half times in total, and pulled down only seven and a half times in total, for each horizontal period. This effectively decreases the number of times of switching of the time-division switches 13.

Fourth Embodiment

Figure 31:
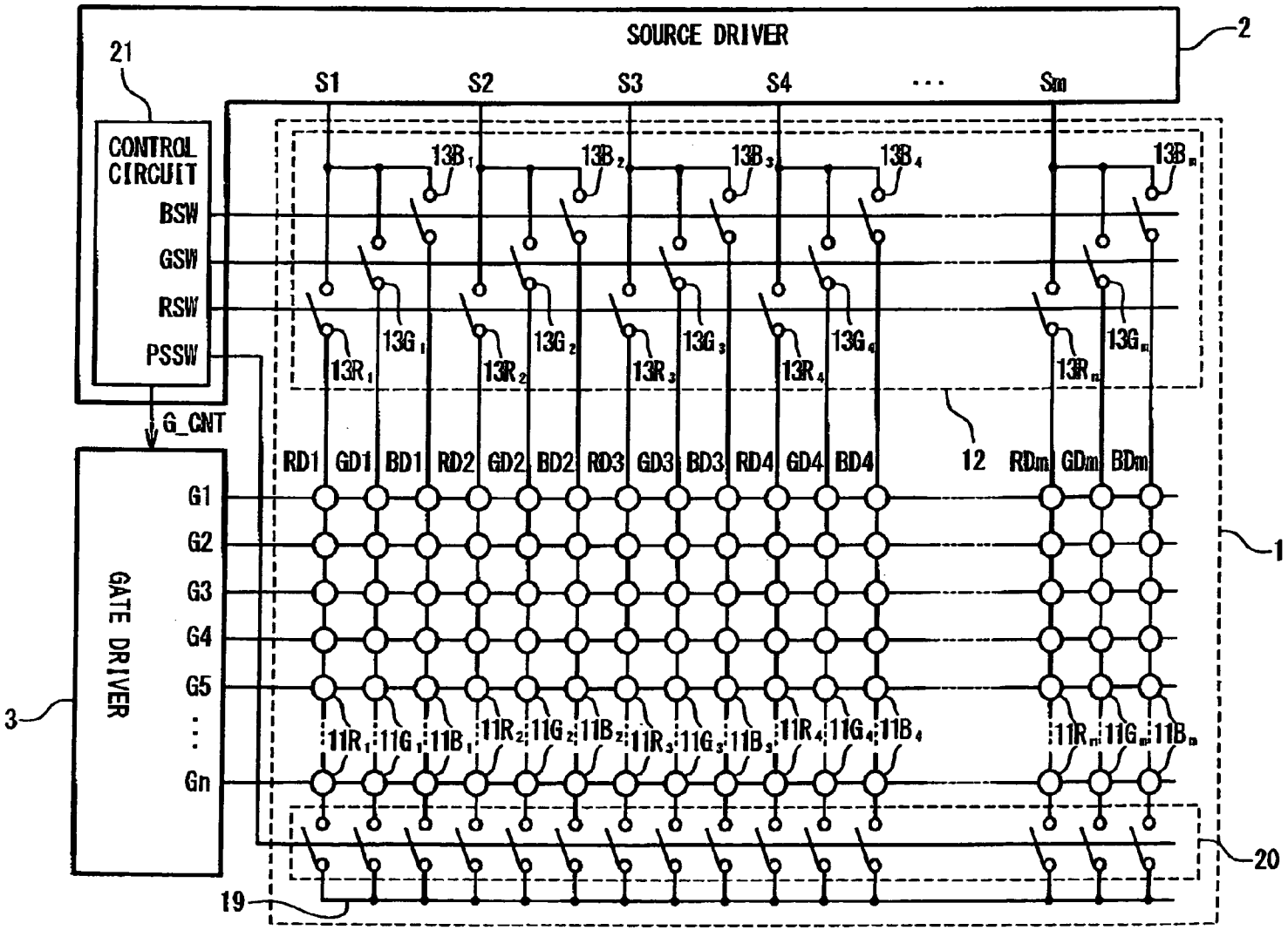
FIG. 31 is a diagram illustrating an exemplary structure of a liquid crystal display apparatus according to a fourth embodiment.

FIG. 31 is a block diagram showing a structure of a liquid crystal display apparatus according to a fourth embodiment of the present invention. In the fourth embodiment, the liquid crystal display panel 1 is provided with a neutralizing line 19 and neutralizing switches 20. The neutralizing switches 20 are turned on and off in response to an external precharge signal PSSW supplied from the control circuit 21 of the source driver 2. When the neutralizing switches 20 are turned on by the external precharge signal PSSW, all the data lines are electrically connected to each other through the neutralizing line 19. The source driver 2 may be structured identically to the structure shown in FIG. 19, which is adapted to output the precharge voltage Vpre from the source outputs.

Figure 32:
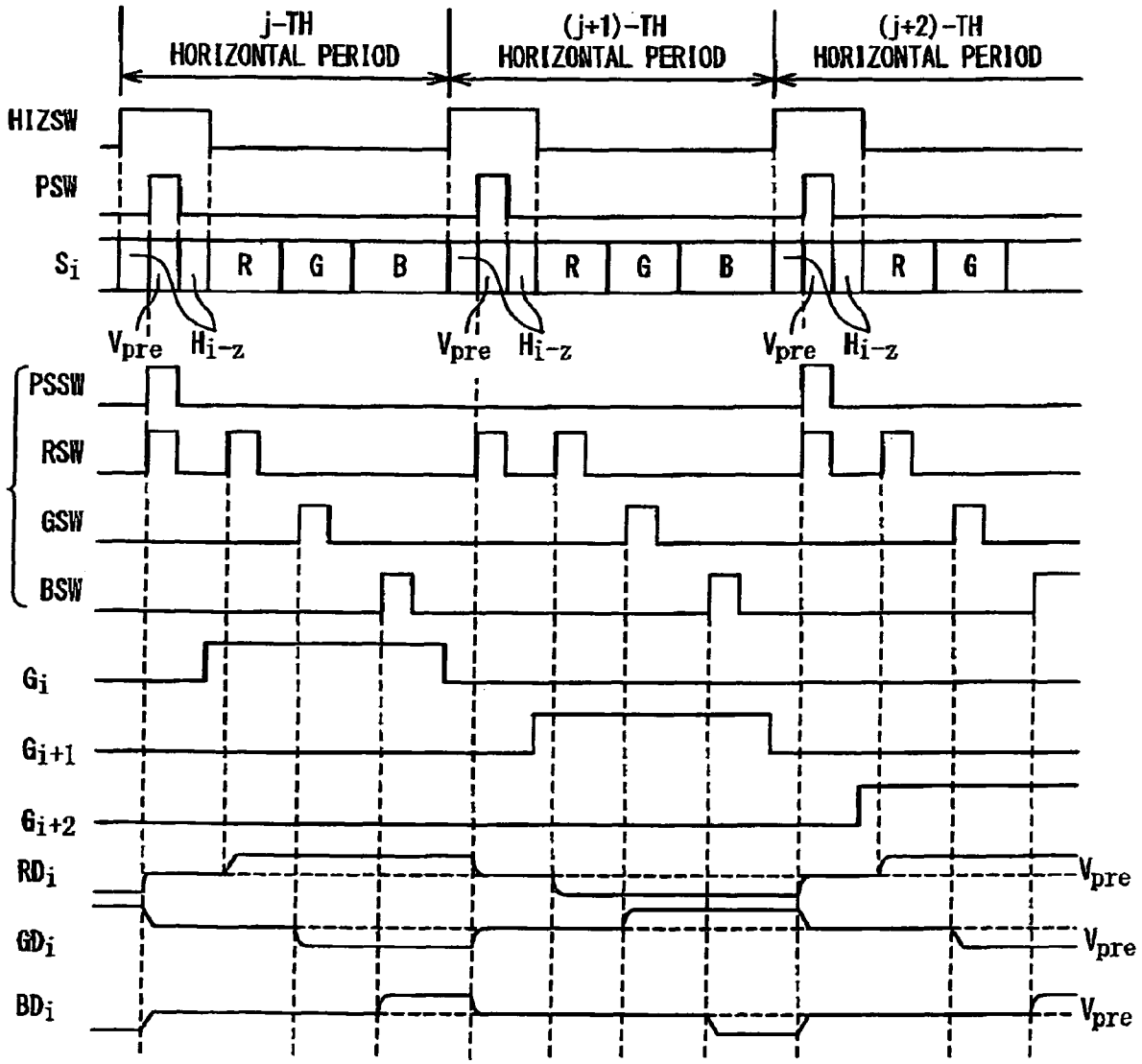
FIG. 32 is a timing chart illustrating an exemplary operation of the liquid crystal display apparatus according to the fourth embodiment.

FIG. 32 is a timing chart showing an exemplary operation of the liquid crystal display apparatus according to the fourth embodiment. One feature of the operation according to the fourth embodiment is that all the data lines are mutually connected through the neutralizing line 19 when the data lines are precharging, while only one or two time-division switches are turned on among the three time-division switches 13$R_i$, 13$G_i$, and 13$B_i$ associated with each source output $S_i$. Even if only one or two time-division switch is turned on among the three time-division switches 13$R_i$, 13$G_i$, and 13$B_i$, it is possible to precharge all the data lines, since all the data lines are electrically connected to each other through the centralizing lines 19. Such operation effectively decreases the number of times of switching of the time-division switches 13. In the following, a description is given of the operation in which only one of the time-division switches 13$R_i$, 13$G_i$, and 13$B_i$ is turned on in the precharge.

When the j-th horizontal period is started, the control signal HIZSW is pulled up to place the source outputs S1 to Sm into the high impedance state. Subsequently, the internal precharge signal PSW is pulled up, so that the precharge voltage Vpre is outputted from the source outputs S1 to Sm. Further, simultaneously with the pull-up of the internal precharge signal PSW, the external precharge signal PSSW and the control signal RSW are pulled up. Accordingly, the time-division switches 13R and the neutralizing switches 20 are turned on to precharge all the data lines to the precharge voltage Vpre. More specifically, the data lines RD are electrically connected to the source outputs S1 to Sm thorough the time-division switches 13R, so that the data lines RD are precharged to the precharge voltage Vpre. Meanwhile, the data lines GD and BD are electrically connected to the data lines RD through the neutralizing line 19 so as to be precharged to the precharge voltage Vpre.

It should be noted that the control signals GSW and BSW are not pulled up during the precharging (that is, the time-division switches 13G and 13B are not turned on). Such operation is effective for decreasing the number of times of the switching of the time-division switches 13.

After the completion of the precharge of the data lines, the internal precharge signal PSW, the external precharge signal PSSW, and the control signal RSW are pulled down. As a result, the source outputs S1 to Sm are returned to the high impedance state. Thereafter, the pixels 11R, 11G, and 11B are driven successively. More specifically, the control signals RSW, GSW, and BSW are pulled up successively. Further, the drive voltages associated with the pixels 11R, 11G, and 11B are outputted from the source outputs S1 to Sm to drive the pixels 11 of the j-th lines in this order.

In the (j+1)-th horizontal period, the pixels 11 of the (j+1)-th line are driven in the same manner. The pixels of other lines are driven in the same manner as well.

Figure 33:
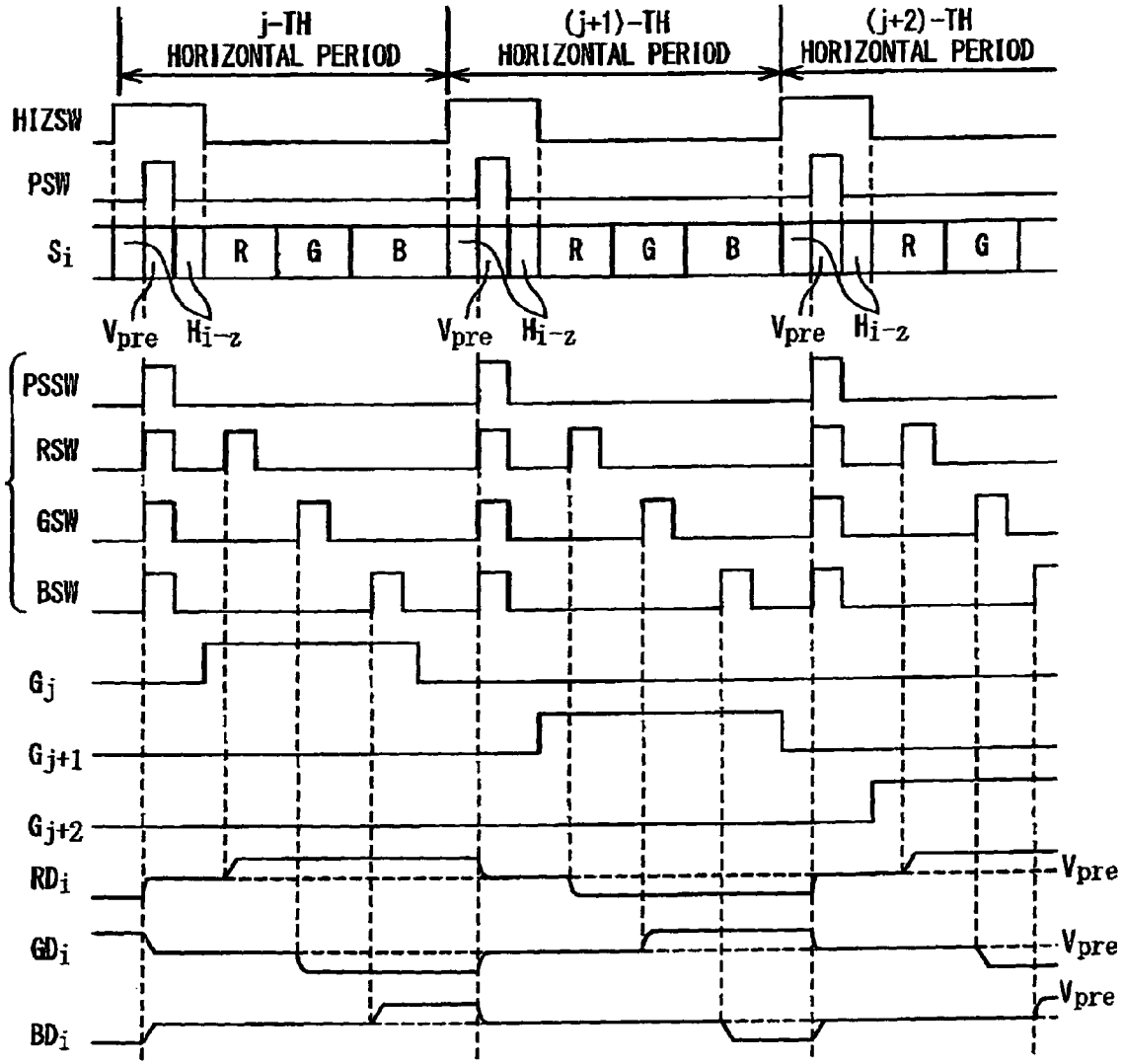
FIG. 33 is a timing chart illustrating an exemplary operation of a liquid crystal display apparatus according to a comparative example.

Such operation effectively decreases the number of times of switching of the time-division switches 13, thereby effectively reducing the power consumption in the time-division switches 13. The advantage of the operation according to the fourth embodiment shown in FIG. 32 would be understood more clearly when compared to the operation shown in FIG. 33. As shown in FIG. 33, in the operation of the typical liquid crystal display apparatus (for example, the liquid crystal display apparatus of FIG. 3), all the control signals RSW, GSW, and BSW are pulled up in precharging, and the control signals RSW, GSW, and BSW are all pulled down thereafter. Then, the control signals RSW, GSW, and BSW are pulled up successively to drive the pixels 11R, 11G, and 11G. In such operation, the control signals RSW, GSW, and BSW are pulled up six times in total, and pulled down six times in total, for each horizontal period.

In the operation of the fourth embodiment shown in FIG. 32, on the other hand, only one control signal out of the control signals RSW, GSW, and BSW is pulled up and pulled down in precharging. Thus, in the operation of the fourth embodiment shown in FIG. 32, the control signals RSW, GSW, and BSW are pulled up only four times in total, and pulled down only four times in total, for each horizontal period. The operation of the fourth embodiment shown in FIG. 32 effectively decreases the number of times of switching of the time-division switches 13.

In the operation shown in FIG. 32, the control signal RSW is pulled up at the time of precharging (that is, the time-division switches 13R are turned on). However, the control signal GSW or BSW may be pulled up in place of the control signal RSW. Alternatively, two out of the control signals RSW, GSW, and BSW may be pulled up in precharging. In order to decrease the number of times of switching of the time-division switches 13, however, it is preferable to pull up only one of the control signals RSW, GSW, and BSW in precharging.

Figure 34:
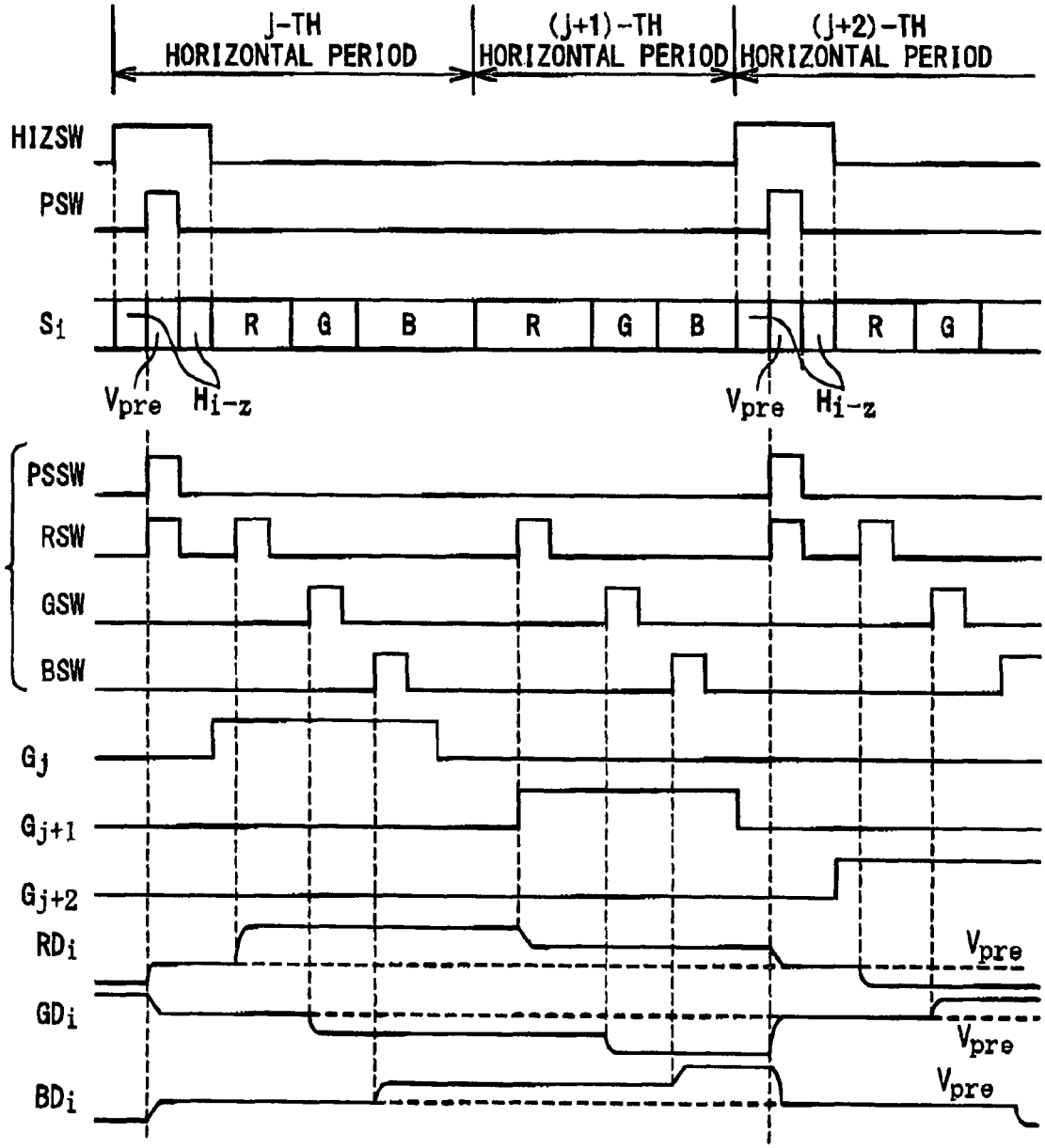
FIG. 34 is a timing chart illustrating an operation of the liquid crystal display apparatus of FIG. 31 when the 2H inversion drive technique is used.

The 2H inversion drive technique may be used in the fourth embodiment. FIG. 34 is a timing chart illustrating the operation of the liquid crystal display apparatus according to the fourth embodiment when the 2H inversion drive technique is used.

In the j-th horizontal period, the pixels of the j-th line are driven in the same manner as those of FIG. 32. When the j-th horizontal period is started, the precharge voltage Vpre is outputted from the source outputs S1 to Sm, while the neutralizing switches 20 and the time-division switches 13R are turned on. This allows all the data lines to be precharged to the precharge voltage Vpre. Thereafter, the control signals RSW, GSW, and BSW are pulled up successively, so that the pixels 11R, 11G, and 11B are driven successively.

In the (j+1)-th horizontal period, the data lines are not precharged. The control signals RSW, GSW, and BSW are pulled up successively to drive the pixels 11B, 11G, and 11B on the (j+1)-th line successively.

In the (j+2)-th horizontal period, the pixels 11 of the (j+2)-th line are driven in the same manner as those of the j-th horizontal period. In the (j+3)-th horizontal period, the pixels 11 of the (j+3)-th line are driven in the same manner as those of the (J+1)-th horizontal period. The pixels 11 of other lines are driven in the same manner.

In the operation of the liquid crystal display apparatus shown in FIG. 34, the control signals RSW, GSW, and BSW are pulled up only three and a half times in total, and pulled down only three and a half times in total, for each horizontal period. The operation of FIG. 34 effectively decreases the number of times of switching of the time-division switches 13.

Figure 35:
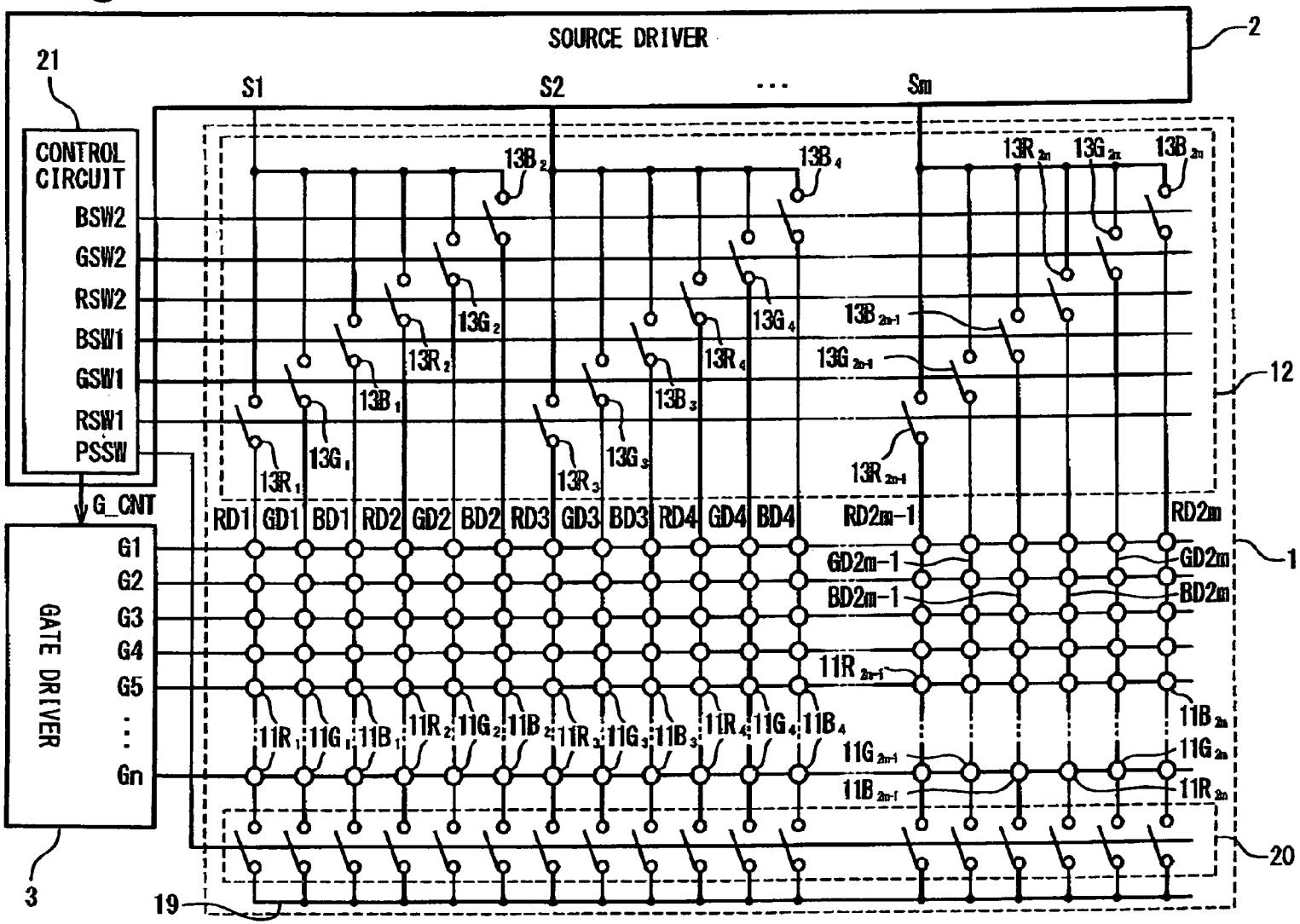
FIG. 35 is a diagram illustrating another exemplary structure of the liquid crystal display apparatus according to the fourth embodiment.
Figure 36:
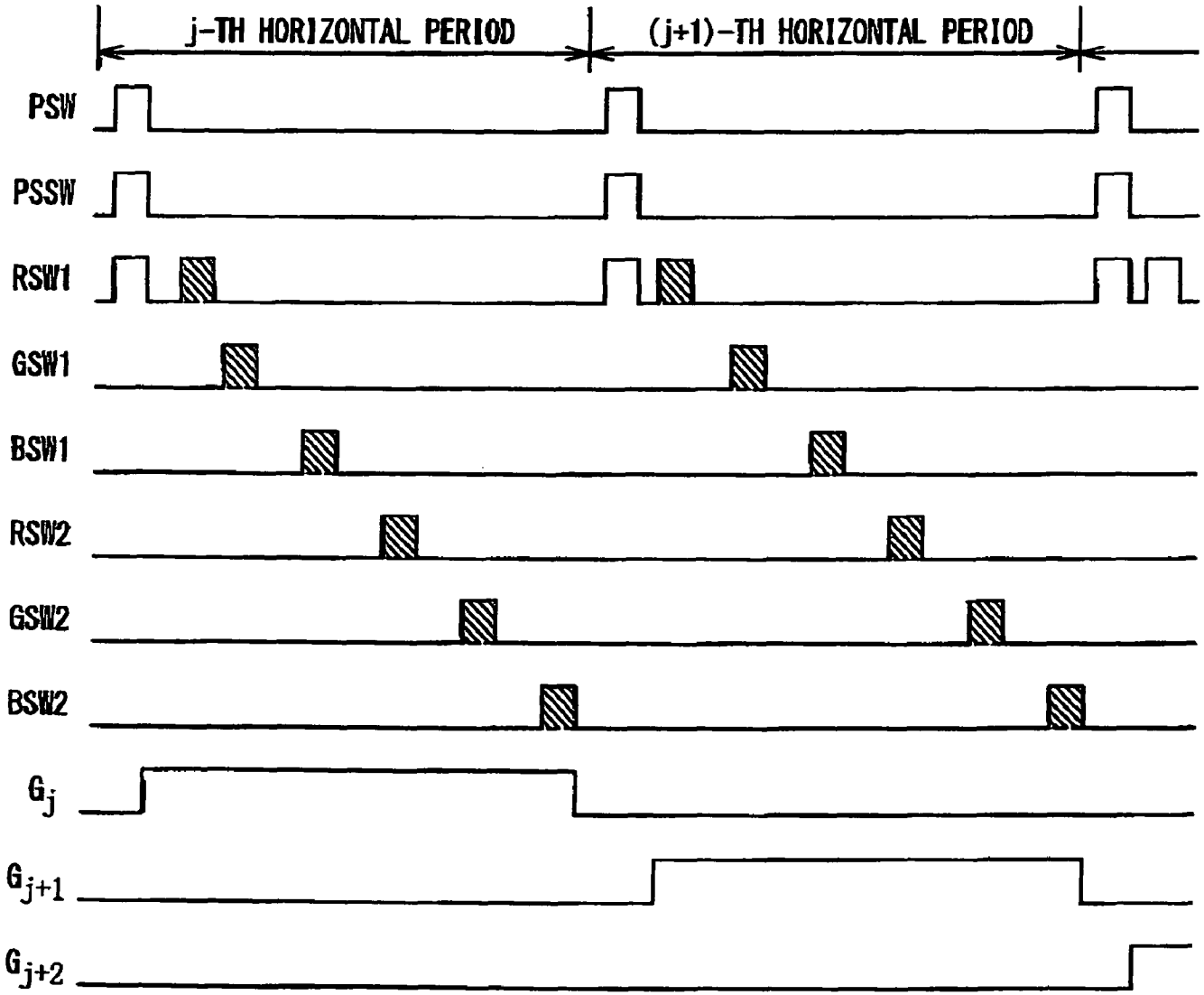
FIG. 36 is a timing chart illustrating an exemplary operation of the liquid crystal display apparatus of FIG. 35.

It should be noted that the number of data lines connected to each source output is not limited to three in the present embodiment either. For example, six data lines may be connected with each source output as shown in FIG. 35. The structure of the liquid crystal display apparatus shown in FIG. 35 is similar to that of the liquid crystal display apparatus shown in FIG. 16. The difference therebetween is that the source driver 2 in the fourth embodiment is adapted to output the precharge voltage Vpre from the source outputs S1 to Sm, and that 6 m data lines RD, GD, and BD are connected with the neutralizing line 19 through the neutralizing switches 20. The source driver 2 may be structured identically to the structure shown in FIG. 19, which is adapted to output the precharge voltage Vpre from the source outputs FIG. 36 is a timing chart illustrating an exemplary operation of the liquid crystal display apparatus shown in FIG. 35. When the j-th horizontal period is started, the internal precharge signal PSW is pulled up, and the precharge voltage Vpre is outputted from the source outputs S1 to Sm. In addition, the external precharge signal PSSW and the control signal RSW1 are pulled up. As a result, the time-division switches 13$R_1$ to 13$R_m$ and the neutralizing switches 20 are turned on, so that all the data lines are precharged to the precharge voltage Vpre. It should be noted that other control signals GSW1, BSW1, RSW2, GSW2, and BSW2 are not pulled up in precharging. Such operation is effective for decreasing the total number of times of switching of the time-division switches 13.

After the completion of the precharge, the internal precharge signal PSW, the external precharge signal PSSW, and the control signal RSW1 are pulled down. Thereafter, the control signals RSW1, GSW1, BSW1, RSW2, GSW2, and BSW2 are pulled up successively. Further, the drive voltages associated with the pixels 11$R_{2i-1}$, 11$B_{2i-1}$, 11$R_{2i}$, 11$G_{2i}$, and 11$B_{2i}$ are outputted from the associated source output Si to drive the pixels 11 of the j-th line in order of the 11$R_{2i-1}$, 11$G_{2i-1}$, 11$B_{2i-1}$, 11$R_{2i}$, 11$G_{2i}$, and 11$B_{2i}$.

In the (j+1)-th horizontal period, the pixels 11 of the (j+1)-th line are driven in the same manner. The pixels 11 of other lines are driven in the same manner.

In the operation shown in FIG. 36, the control signals RSW1, GSW1, BSW1, RSW2, GSW2, and BSW2 are pulled up only seven times in total, and pulled down only seven times in total, for each horizontal period. The operation of FIG. 36 effectively decreases the number of times of switching of the time-division switches 13.

Figure 37:
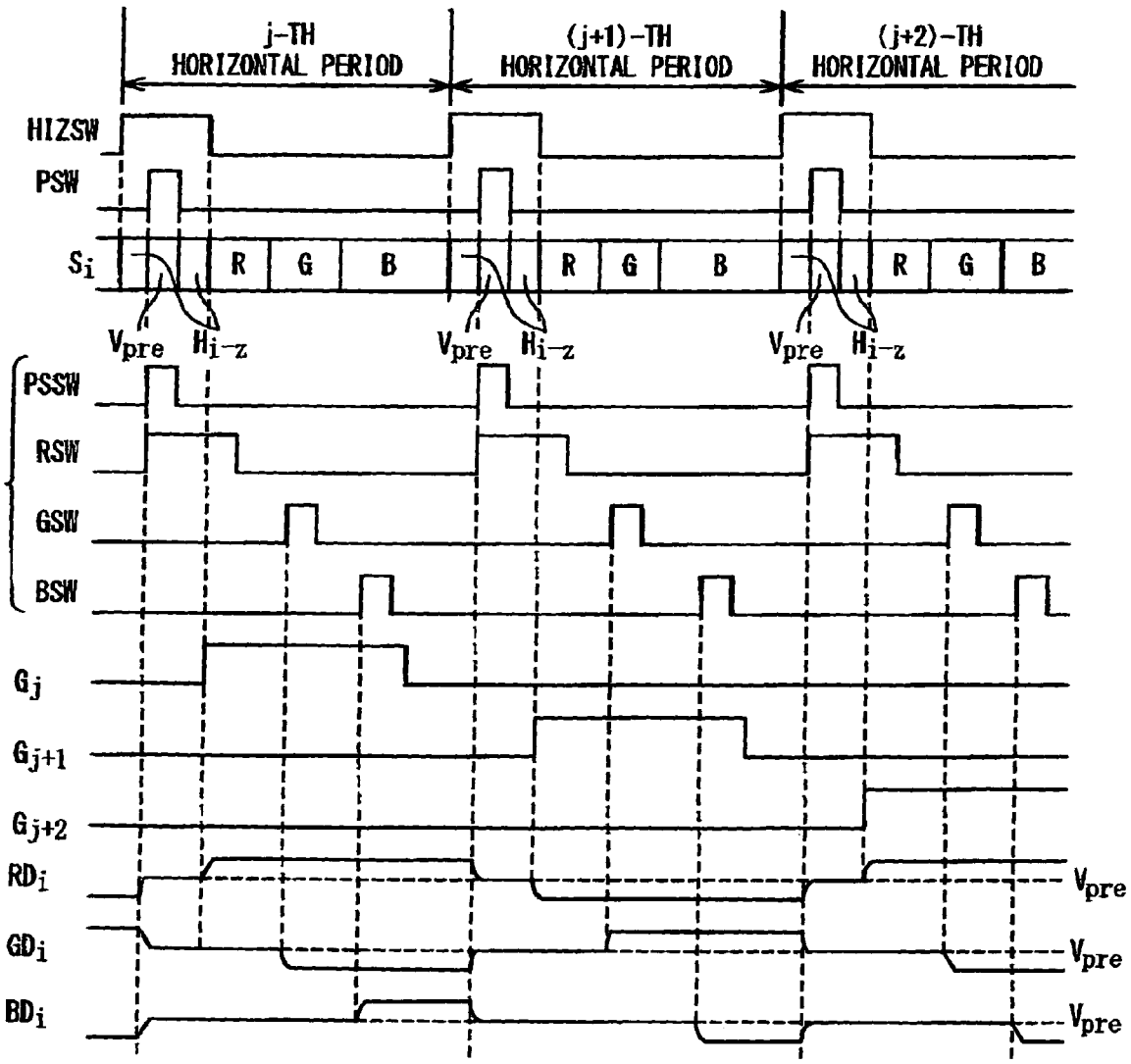
FIG. 37 is a timing chart illustrating a preferred operation of the liquid crystal display apparatus of FIG. 31.

In order to further decrease the number of times of switching of the time-division switches 13, it is preferable that the time-division switches 13 turned on in precharging are continuously turned on until the drive of the associated pixels 11 are completed. FIG. 37 is a timing chart of such operation. It should be noted that FIG. 37 illustrates an exemplary operation for the case that three data lines are connected to each source output. The operation of the liquid crystal display apparatus shown in FIG. 37 is almost the same as that of FIG. 32, except for that the control signal RSW is continuously turned on until the drive of the pixels 11R is completed after the precharging.

More specifically, when the j-th horizontal period is started, the control signal HIZSW is pulled up to place the source outputs S1 to Sm into the high impedance state. Subsequently, the internal precharge signal PSW is pulled up to output the precharge voltage Vpre from the source outputs S1 to Sm. Further, the time-division switches 13$R_1$ to 13$R_m$ and the neutralizing switches 20 are turned on simultaneously with the pull-up of the internal precharge signal PSW. As a result, all the data lines are driven to the precharge voltage Vpre.

After the completion of the precharge, the internal precharge signal PSW and the external precharge signal PSSW are pulled down. As a result, the source outputs S1 to Sm are returned to the high impedance state. The control signal RSW is pulled down continuously.

Thereafter, the gate line Gj is pulled up, and the drive voltages associated with the pixels 11R are outputted from the source outputs S1 to Sm, and supplied to the data lines RD to drive the pixels 11R to the drive voltages. Subsequently, the control signal RSW is pulled down so that the time-division switches 13R are turned off. The data lines RD (and the pixels 11R) are kept at the drive voltages.

Subsequently, the control signals GSW and BSW are pulled up in this order, so that the time-division switches 13G and 13B are turned on in this order. Simultaneously with the turn-on of the time-division switches 13G and 13B, the drive voltages associated with the pixels 11G and 11B are outputted from the source outputs S1 to Sm to drive the pixels 11G and 11B in this order. After the drive of the pixels 11B of the j-th line is completed, the gate line Gj is pulled down.

In the (j+1)-th horizontal period, the pixels 11 of the (j+1)-th line are driven in the same manner. The pixels 11 of other lines are driven in the same manner.

In the operation of the liquid crystal display apparatus shown in FIG. 37, the control signals RSW, GSW, and BSW are pulled up only three times in total, and pulled down only three times in total, for each horizontal period. The operation of FIG. 37 effectively decreases the number of switching times in the time-division switches 13.

Figure 38:
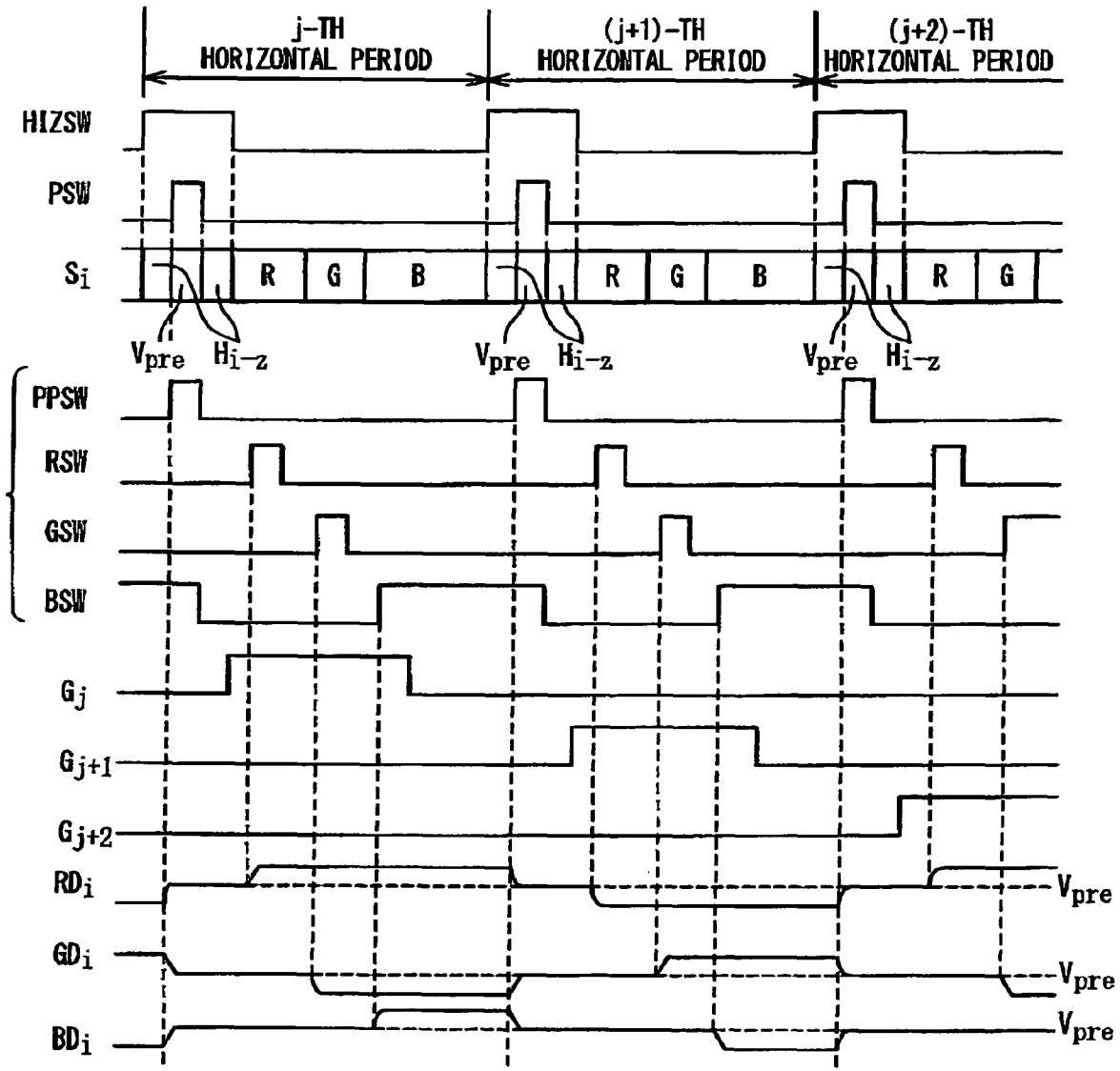
FIG. 38 is a timing chart showing another preferred operation of the liquid crystal display apparatus of FIG. 31.

It is also preferable that the time-division switches 13 which are associated with the pixels 11 that are driven lastly in each horizontal period are continuously turned on until the precharge is completed in the next horizontal period, as shown in FIG. 38. The operation of the liquid crystal display apparatus shown in FIG. 38 is almost the same as that of FIG. 32, except for that the control signal BSW is continuously turned on until the precharging is completed, even after the completion of the drive of the pixels 113.

More specifically, at the beginning of the j-th horizontal period, the control signal BSW is being pulled up continuously from the (j−1)-th horizontal period. In other words, the time-division switches 13B are already turned on at the beginning of the j-th horizontal period.

When the j-th horizontal period is started, the control signal HIZSW is pulled up to place the source outputs S1 to Sm into the high impedance state. Subsequently, the internal precharge signal PSW is pulled up to output the precharge voltage Vpre from the source outputs S1 to Sm. Further, the external precharge signal PSSW is pulled up simultaneously with the pull-up of the internal precharge signal PSW, so that the neutralizing switches 20 are turned on. As a result, all the data lines are precharged to the precharge voltage Vpre. After the completion of the precharge, the internal precharge signal PSW, the external precharge signal PSSW, and the control signal BSW are pulled down.

Subsequently, the control signals RSW, GSW and BSW are pulled up in this order to turn on the time-division switches 13R, 13G, and 13B in this order. Simultaneously with the turn-on of the time-division switches 13R, 13G, and 13B, the drive voltages associated with the pixels 11R, 11G, and pixels 11B are outputted from the source outputs to drive the pixels 11R, 11G, and 11B in this order.

After the drive of the pixel 11B is completed, the gate line Gj is pulled down. However, the control signal BSW is not pulled down, so that the time-division switches 13B are kept turned on. The time-division switches 13B are continuously turned on until the next horizontal period (the (j+1)-th horizontal period).

In the (j+1)-th horizontal period, the pixels 11 of the (j+1)-th line are driven in the same manner. The pixels 11 of other lines are driven in the same manner.

In the operation of the liquid crystal display apparatus shown in FIG. 38, the control signals RSW, GSW, and BSW are pulled up only three times in total, and pulled down only three times in total, for each horizontal period. The operation of FIG. 38 effectively decreases the number of times of switching of the time-division switches 13.

Figure 39:
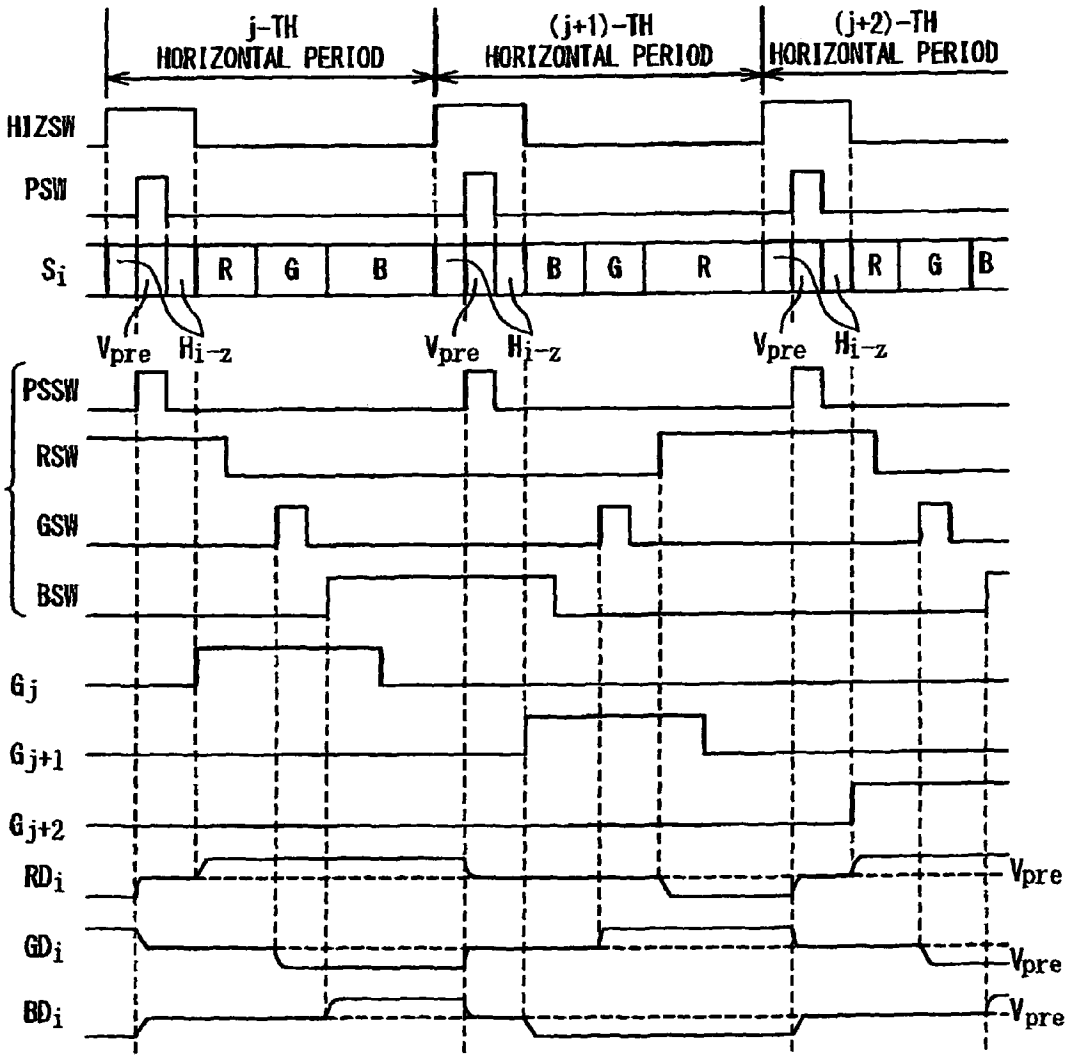
FIG. 39 is a timing chart showing still another preferred operation of the liquid crystal display apparatus of FIG. 31.

In order to further decrease the number of times of switching of the time-division switches 13, it is preferable that the time-division switches 13 associated with the pixels 11 driven lastly in a given horizontal period are continuously turned on until the drive of the corresponding pixels 11 in the next horizontal period is completed, as shown in FIG. 39. In this case, the pixels 11 of the j-th line are driven in order of the pixels 11R, 11G and 11B, while the pixels 11 of the (j+1)-th line are driven in the reversed order. In the operation shown in FIG. 39, after the pixels 11B of the j-th line are driven lastly among the pixels 11 of the j-th line in the j-th horizontal period, the pixels 11B of the (j+1)-th line), which are connected to the same data lines, are driven first in the (j+1)-th horizontal period.

More specifically, in the operation of FIG. 39, at the beginning of the j-th horizontal period, the control signal RSW is being activated continuously from the (j−1)-th horizontal period. In other words, the time-division switches 13R are already turned on at the beginning of the j-th horizontal period.

When the j-th horizontal period is started, the control signal HIZSW is pulled up to place the source outputs S1 to Sm into the high impedance state. Subsequently, the internal precharge signal PSW is pulled up to output the precharge voltage Vpre from the source outputs S1 to Sm. Further, the external precharge signal PSSW is pulled up simultaneously with a pull-up of the internal precharge signal PSW to provide electrical connections between all the data lines and to the neutralizing line 19. As a result, all the data lines are driven to the precharge voltage Vpre.

After the completion of the precharge of the data lines, the internal precharge signal PSW and the external precharge signal PSSW are pulled down, and the source outputs S1 to Sm are returned to the high impedance state. However, even after the completion of the precharge of the data lines, the control signal RSW is not pulled down; the time-division switches 13R are continuously turned on. This aims to decrease the number of times of switching of the time-division switches 13.

Subsequently, the pixels 11 of the j-th line are driven in order of the pixels 11R, 11G, and 11B, Specifically, after the completion of the precharge, the gate line Gj is pulled up and the drive voltages associated with the pixels 11R are outputted from the source outputs S1 to Sm, and supplied to the data lines RD to drive the pixels 11R to desired drive voltages. Subsequently, the control signal RSW is pulled down so that the time-division switches 13R are turned off. The data lines RD (and the pixels 11R) are kept at the drive voltages.

Subsequently, the control signals GSW and BSW are pulled up in this order to turn on the time-division switches 13G and 13B in this order. Simultaneously with the turn-on of the time-division switches 13G and 13B, the drive voltages associated with the pixels 11G and 11B are outputted from the source outputs S1 to Sm to drive the pixels 11G and 11B in this order.

After the drive of the pixels 11B of the j-th line is completed, the gate line Gj is pulled down. However, the control signal BSW is not pulled down, so that the time-division switches 13B are kept turned on. The time-division switch 13B is continuously turned on until the next horizontal period (the (j+1)-th horizontal period).

Subsequently, all the data lines are precharged at the beginning of the (j+1)-th horizontal period. Specifically, when the (j+1)-th horizontal period is started, the control signal HIZSW is pulled up to place the source outputs S1 to Sm are set to the high impedance state. Then, the internal precharge signal PSW is pulled up to output the precharge voltage Vpre from the source outputs S1 to Sm. Further, the external precharge signal PSSW is pulled up simultaneously with the pull-up of the internal precharge signal PSW. As a result, all the data lines are connected electrically to the neutralizing line 19 to drive all the data lines to the precharge voltage Vpre.

After the completion of the precharge of the data lines, the internal precharge signal PSW and the external precharge signal PSSW are pulled down, and the source outputs S1 to Sm are returned to the high impedance state. However, even after completing the precharge of the data lines, the control signal BSW is not pulled down; the time-division switches 13B are continuously turned on. This aims to decrease the number of times of switching of the time-division switches 13.

Subsequently, the pixels 11 of the (j+1)-th line are driven in order of the pixels 11B, 11G, and 11R. Specifically, after the completion of the precharge, the gate line Gj+1 is pulled up, and the drive voltages associated with the pixels 11B are outputted from the source outputs S1 to Sm, and supplied to the data lines BD to drive the pixels 11B to desired drive voltages. Subsequently, the control signal BSW is pulled down so that the time-division switch 13B is turned off. The data lines BD (and the pixels 11B) are kept the drive voltage.

Subsequently, the control signals GSW and RSW are pulled up in this order, so that the time-division switches 13G and 13R are turned on in this order. Simultaneously with the turn-on of the time-division switches 13G and 13R, the drive voltages associated with the pixels 11G and 11R are outputted from the source outputs S1 to Sm to drive the pixels 11G and 11R in this order.

After the drive of the pixels 11R of the (j+1)-th line is completed, the gate line Gj+1 is pulled down. However, the control signal RSW is not pulled down, so that the time-division switches 13R are kept turned on. The time-division switches 13R are continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 of the (j+3)-th line are driven in the (j+3)-th horizontal period in the same manner as those of the (j+1)-th line. The pixels 11 of other lines are driven in the same manner.

In the operation of the liquid crystal display apparatus shown in FIG. 39, the control signals RSW, GSW, and BSW are pulled up only twice in total, and pulled down only twice in total, for each horizontal period. The operation of FIG. 39 effectively decreases the number of times of switching of the time-division switches 13.

Figure 40:
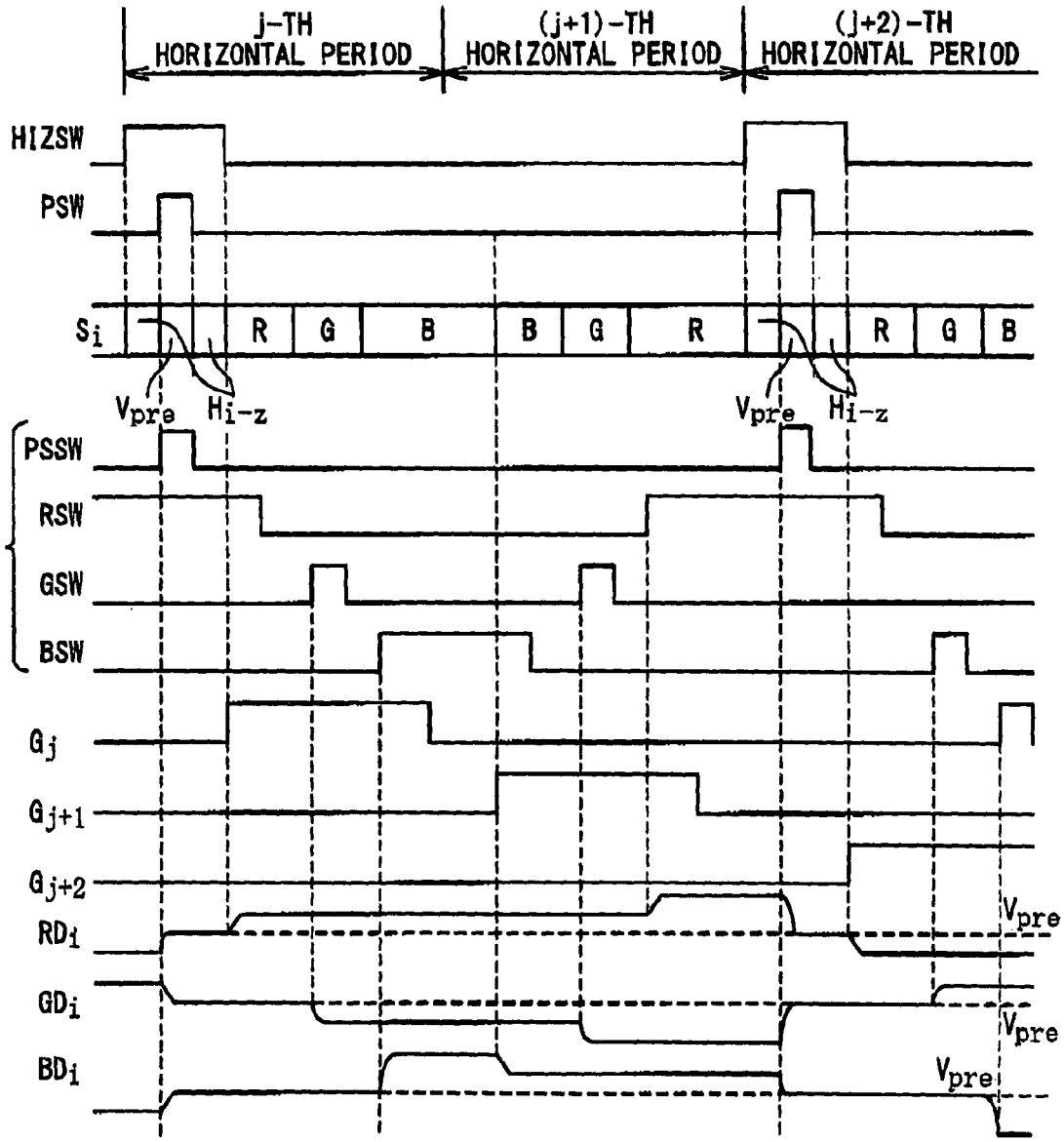
FIG. 40 is a timing chart showing a preferred operation of the liquid crystal display apparatus of FIG. 31 when the 2H inversion drive technique is used.

The 2H inversion drive technique may be applied to the operations of FIGS. 37 to 39. FIG. 40 is a timing chart illustrating an exemplary operation of the liquid crystal display-apparatus in the case that the 2H inversion drive technique is applied to the operation of FIG. 39. As shown in FIG. 40, the internal precharge signal PSW and the external precharge signal PSSW are pulled up at the beginning of the j-th horizontal period to precharge all the data lines. However, at the beginning of the following (j+1)-th horizontal period, the internal precharge signal PSW and the external precharge signal PSSW are not pulled up so that the data lines are not precharged. At the beginning of the next (j+2)-th horizontal period, the data lines are precharged. The polarities of the drive voltages supplied to the respective pixels 11 of the (j+2)-th line driven in the (j+2)-th horizontal period are inverted from the polarities of the drive voltages supplied to the corresponding pixels 11 of the j-th line.

Also in the operation shown in FIG. 40, the control signals RSW, GSW, and BSW are pulled up only twice in total, and pulled down only twice in total, for each horizontal period. This effectively decreases the number of times of switching of the time-division switches 13.

Figure 41:
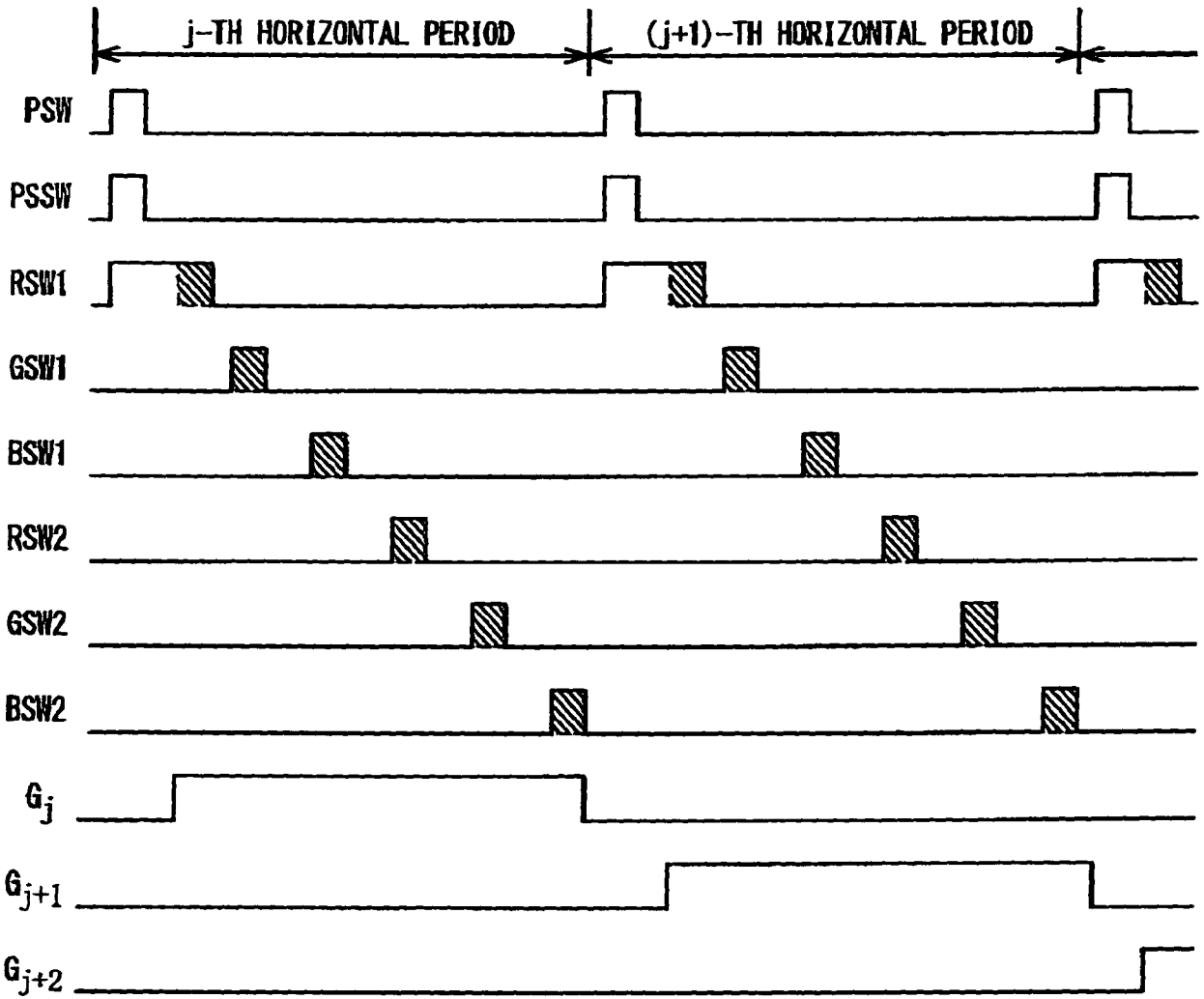
FIG. 41 is a timing chart showing an exemplary operation of the liquid crystal display apparatus of FIG. 35, in the case that six data lines are connected to each source output.

The operations of FIGS. 37-39 are also applicable to the structure in which six data lines are connected with each source output. FIG. 41 is a timing chart showing an exemplary operation of the liquid crystal display apparatus in the case that six data lines are connected to each source output, and the time-division switches 13 which are turned on in precharging are continuously turned on until the drive of the corresponding pixels 11 is completed (such operation corresponds to the operation of FIG. 37).

When the j-th horizontal period is started, the internal precharge signal PSW is pulled up, and the precharge voltage Vpre is outputted from the source outputs S1 to Sm. In addition, the external precharge signal PSSW and the control signal RSW1 are pulled up, so that the time-division switch 13$R_{2i-1}$ and the neutralizing switches 20 are turned on. As a result, all the data lines are precharged to the precharge voltage Vpre. It should be noted that the remaining control signals GSW1, BSW1, RSW2, GSW2, and BSW2 are not pulled up in precharging. Such operation is effective for decreasing the total number of times of switching of the time-division switches 13.

After the precharge is completed, the internal precharge signal PSW and the external precharge signal PSSW are pulled down. However, the control signal RSW1 is continuously pulled up.

Subsequently, the gate line Gj is pulled up and the drive voltage associated with the pixel 11$R_{2i-1}$ is outputted from the source output Si to drive the pixel 11$R_{2i-1}$.

Thereafter, the control signals GSW1, BSW1, RSW2, GSW2, and BSW2 are pulled up successively and Further, the drive voltages associated with the pixels 11$G_{2i-1}$, 11$B_{2i-1}$, 11$R_{2i}$, 11$G_{2i}$, and 11$B_{2i}$ are outputted from the source outputs Si to drive the pixels 11 of the j-th line in order of the pixels 11$R_{2i-1}$, 11$G_{2i-1}$, 11$B_{2i-1}$, 11$R_{2i}$, 11$G_{2i}$, and 11$B_{2i}$.

In the (j+1)-th horizontal period, the pixels 11 of the (j+1)-th line are driven in the same manner as those of the j-th line. The pixels of other lines are driven in the same manner.

In the operation shown in FIG. 41, the control signals RSW, GSW, and BSW are pulled up only six times in total, and pulled down only six times in total, for each horizontal period. This effectively reduces the number of times of switching of the time-division switches 13.

Figure 42:
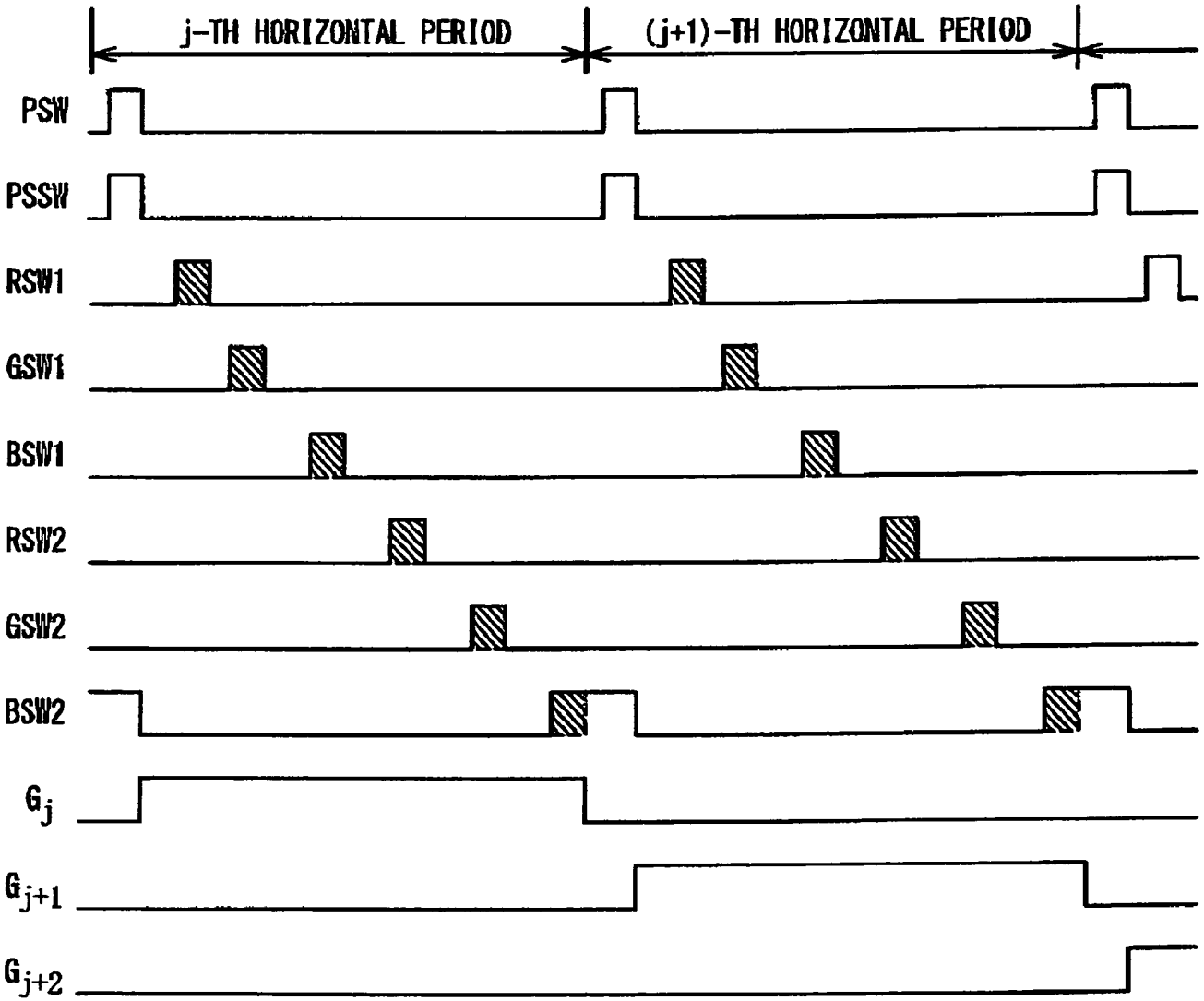
FIG. 42 is a timing chart showing an exemplary operation of the liquid crystal display apparatus of FIG. 35, in the case that six data lines are connected to each source output.

FIG. 42 is a timing chart illustrating an exemplary operation of the liquid crystal display apparatus in the case that six data lines are connected with each source output, and the time-division switches 13 associated with the pixels 11 that are driven lastly in each horizontal period are continuously turned on until the precharge is completed (such operation corresponds to the operation of FIG. 38).

At the beginning of the j-th horizontal period, the control signal BSW2 is being pulled up continuously from the (j−1)-th horizontal period. In other words, at the beginning of the j-th horizontal period, the time-division switch 13$R_{2i-1}$ is being turned on. When the j-th horizontal period is started, the internal precharge signal PSW is pulled up, and the precharge voltage Vpre is outputted from the source outputs S1 to Sm. In addition, the external precharge signal PSSW is pulled up, so that the neutralizing switches 20 are turned on. As a result, all the data lines are precharged to the precharge voltage Vpre. It should noted that the other control signals RSW1, GSW1, BSW1, RSW2, and GSW2 are not pulled up in precharging. Such operation is effective for decreasing the total number of times of switching of the time-division switches 13.

After the precharge is completed, the internal precharge signal PSW, the external precharge signal PSSW, and the control signal BSW2 are pulled down.

Thereafter, the control signals RSW1, GSW1, BSW1, RSW2, GSW2, and BSW2 are pulled up successively, and the drive voltages associated with the pixels 11$R_{2i-1}$, 11$G_{2i-1}$, 11$B_{2i-1}$, 11$R_{2i}$, 11$G_{2i}$, and 11$B_{2i}$ are outputted from the source output Si to drive the pixels 11 of the j-th line in order of the pixels 11$R_{2i-1}$, 11$G_{2i-1}$, 11$B_{2i-1}$, 11$R_{2i}$, 11$G_{2i}$, and 11$B_{2i}$.

After the drive of the pixel 11$B_{3i}$ on the j-th line is completed, the gate line Gj is pulled down. However, the control signal BSW2 is not pulled down, so that the time-division switch 13$B_{2i}$ is kept turned on. The time-division switch 13$B_{2i}$ is continuously turned on until the next horizontal period (that is, the (j+1)-th horizontal period).

In the (j+1)-th horizontal period, the pixels 11 of the (j+1)-th line are driven in the same manner as those of the j-th line. The pixels of other lines are driven in the same manner.

In the operation shown in FIG. 42, the control signals RSW, GSW, and BSW are pulled up only six times in total, and pulled down only six times in total, for each horizontal period, This effectively decreases the number of times of switching of the time-division switches 13.

Figure 43:
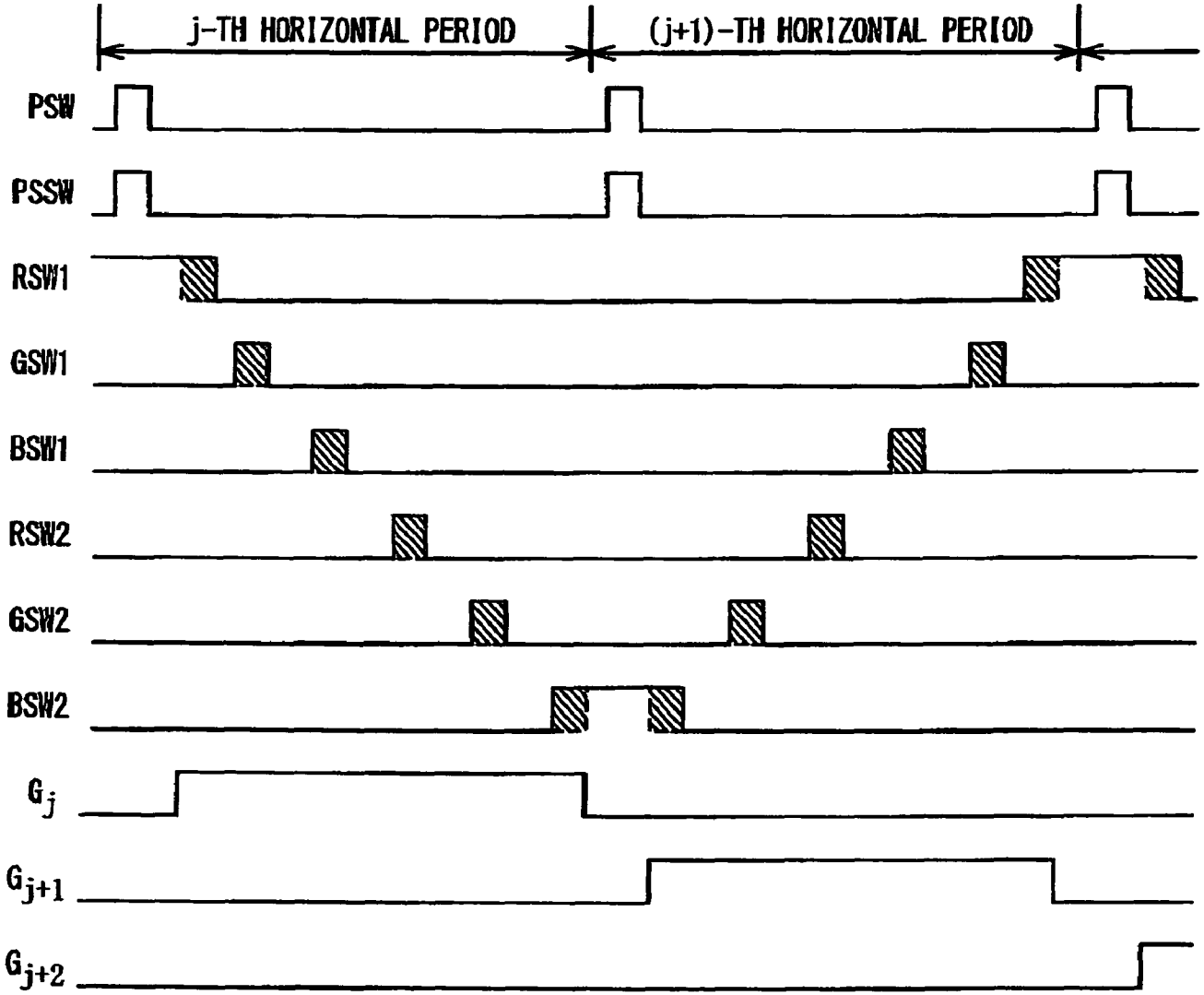
FIG. 43 is a timing chart showing an exemplary operation of the liquid crystal display apparatus of FIG. 35, in the case that six data lines are connected to each source output.

FIG. 43 is a timing chart illustrating an exemplary operation of the liquid crystal display apparatus in the case that six data lines are connected with each source output, and the time-division switches 13 associated with the pixels which are driven lastly in a given horizontal period are continuously turned on until the drive of the corresponding pixels 11 is completed in the next horizontal period (such operation corresponds to the operation of FIG. 39). It should be noted that, in the operation of FIG. 43, the pixels 11 of the j-th line are driven in order of the pixels 11$R_{2i-1}$, 11$G_{2i-1}$, 11$B_{2i-1}$, 11$R_{2i}$, 11$G_{2i}$, and 11$B_{2i}$, while the pixels of the (J+1)-th line are driven in the reversed order.

More specifically, at the beginning of the j-th horizontal period, the control signal RSW1 is continuously activated from the (j−1)-th horizontal period. In other words, the time-division switch 13$R_{2i-1}$ is already turned on at the beginning of the j-th horizontal period.

When the j-th horizontal period is started, the internal precharge signal PSW is pulled up to drive the source outputs S1 to Sm to the precharge voltage Vpre. Further, the external precharge signal PSSW is pulled up simultaneously with the pull-up of the internal precharge signal PSW to provide electrical connections between all the data lines and the neutralizing line 19. As a result, all the data lines are driven to the precharge voltage Vpre.

After the completion of the precharge of the data lines, the internal precharge signal PSW and the external precharge signal PSSW are pulled down. However, even after the precharge of the data lines is completed, the control signal RSW1 is not pulled down. That is, the time-division switch 13$R_{2i-1}$ is continuously turned on. This aims to decrease the number of times of switching of the time-division switches 13.

Subsequently, the pixels 11 of the j-th line are driven in order of the pixels 11$R_{2i-1}$, 11$G_{2i-1}$, 11$B_{2i-1}$, 11$R_{2i}$, 11$G_{2i}$, and 11$B_{2i}$. Specifically, after the completion of the precharge, the gate line Gj is pulled up, and the drive voltages associated with the pixel 11$R_{2i-1}$ is outputted from the source output Si, and supplied to the data line RD2*i*-1 to drive the pixel 11$R_{2i-1}$ to a desired drive voltage.

Subsequently, the control signals GSW1, SSW1, RSW2, GSW2, and BSW2 are pulled up in this order to turn on the time-division switches 13$G_{2i-1}$, 13$B_{2i-1}$, 13$R_{2i-1}$, 13$R_{2i}$, 13$G_{2i}$, and 13$B_{2i}$ in this order. Simultaneously with the turn-on of the time-division switches 13$G_{2i-1}$, 13$B_{2i-1}$, 13$R_{2i-1}$, 13$R_{2i}$, 13$G_{2i}$, and 13$B_{2i}$, the drive voltages associated with the pixels 11$G_{2i-1}$, 11$B_{2i-1}$, 11$R_{2i}$, 11$G_{2i}$, and 11$B_{2i}$ are outputted from the source output Si to drive the pixels 11$G_{2i-1}$, 11$B_{2i-1}$, 11$R_{2i}$, 11$G_{2i}$, 11$B_{2i}$ in this order.

After the drive of the pixel 11$B_{2i}$ of the j-th line is completed, the gate line Gj is pulled down. However, the control signal BSW2 is not pulled down, so that the time-division switch 13$B_{2i}$ is kept turned on. The time-division switch $13B_{2i}$ is continuously turned on until the next horizontal period (the (j+1)-th horizontal period).

Subsequently, all the data lines are precharged at the beginning of the (j+1)-th horizontal period. Specifically, when the (j+1)-th horizontal period is started, the internal precharge signal PSW and the external precharge signal PSSW are pulled up to drive all the data lines to the precharge voltage Vpre.

After the completion of the precharge of the data lines, the internal precharge signal PSW and the external precharge signal PSSW are pulled down. However, even after completing the precharge of the data lines, the control signal BSW2 is not pulled down. That is, the time-division switch $13B_{2i}$ is continuously turned on. This aims to decrease the number of times of switching of the time-division switches 13.

Subsequently, the pixels 11 of the (j+1)-th line are driven in order of the pixels $11B_{2i}$, $11G_{2i}$, $11R_{2i}$, $11B_{2i-1}$, $11G_{2i-1}$, and $11G_{2i-1}$. Specifically, after the completion of the precharge, the gate line Gj+1 is pulled up, and the drive voltage associated with the pixel $11B_{2i}$ is outputted from the source output Si and supplied to the data line BD2*i* to drive the pixel $11B_{2i}$, to a desired drive voltage.

Subsequently, the control signals GSW2, RSW2, BSW1, GSW1, and RSW1 are pulled up in this order to turn on the time-division switches $13G_{2i}$, $13R_{2i}$, $13B_{2i-1}$, $13G_{2i-1}$, and $13B_{2i-1}$ in this order. Simultaneously with the turn-on of the time-division switches $13G_{2i}$, $13R_{2i}$, $13B_{2i-1}$, $13G_{2i-1}$, and $13R_{2i-1}$, the drive voltages associated with the pixels $11G_{2i}$, $11R_{2i}$, $11B_{2i-1}$, $11G_{2i-1}$, and $11R_{2i-1}$ are outputted from the source output Si to drive the pixels $11G_{2i}$, $11R_{2i}$, $11B_{2i-1}$, $11G_{2i-1}$, and $11R_{2i-1}$ in this order.

After the drive of the pixels $11R_{2i-1}$ of the (j+1)-th line is completed, the gate line Gj+1 is pulled down. However, the control signal RSW1 is not pulled down, so that the time-division switch $13R_{2i-1}$ is kept turned on. The time-division switch $13R_{2i-1}$ is continuously turned on until the next horizontal period (the (j+2)-th horizontal period).

In the (j+2)-th horizontal period, the pixels 11 of the (j+2)-th line are driven in the same manner as those of the j-th line. Thereafter, the pixels 11 on the (j+3)-th line are driven in the (j+3)-th horizontal period in the same manner as those of the (j+1)-th line. The pixels 11 of other lines are driven in the same manner as well.

In the operation of the liquid crystal display apparatus shown in FIG. 43, the control signals RSW1, GSW1, BSW1, RSW2, GSW2, and BSW2 are pulled up only five times in total, and pulled down only five times in total, for each horizontal period. The operation of FIG. 43 effectively decreases the number of times of switching of the time-division switches 13.

Although various embodiments of the present invention have been described above, it is apparent that the present invention is not limited to the above embodiments, but may be modified and changed without departing from the scope of the invention. For example, the order of driving the pixels 11 may be determined differently (without departing from the scope and spirit of the present invention). In particular, it should be noted that it is preferable to change the order of driving the pixels 11 with a cycle of a predetermined number of frame periods and/or a predetermined number of frame lines, in order to reduce the flicker.

What is claimed is:

1. A method of operating a display apparatus in which one source output of a source driver is connected with first to N-th data lines through first to N-th time division switches, said method comprising:

driving a first pixel positioned in a first horizontal line and connected with one of said first to N-th data lines, by feeding a first drive voltage to said one of said first to N-th data lines from said one source output with an associated one of said first to N-th time division switches turned on; and driving a second pixel positioned in a second horizontal line next to said first horizontal line and connected with said one of said first to N-th data lines, by feeding a second drive voltage to said one of said first to N-th data lines from said source output with the associated one of said first to N-th time division switches, wherein said associated one time division switch is kept turned on during a time period from a start time of said driving said first pixel to a start time of said driving said second pixel from a first horizontal period to a second horizontal period, wherein a second time division switch is kept turned on through a transition from the second horizontal period to a third horizontal period such that at least one of the time division switches is kept turned on periodically for each transition of a horizontal period.

2. The method according to claim 1, further comprising:

precharging said first to N-th data lines during a precharge period which is a part of said time period from said start time of said driving said first pixel to said start time of said driving said second pixel, by connecting said first to N-th data lines with a precharge line of a predetermined precharge voltage with said source output set to high impedance.

3. The method according to claim 1, further comprising:

precharging said first to N-th data lines during a precharge period which is a part of said time period from said start time of said driving said first pixel to said start time of said driving said second pixel, by outputting a predetermined precharge voltage from said source output with said first to N-th time division switches turned on.

4. The method according to claim 1, further comprising:

precharging said first to N-th data lines during a precharge period which is a part of said time period from said start time of said driving said first pixel to said start time of said driving said second pixel, by outputting a predetermined precharge voltage from said source output with said first to N-th data lines electrically connected through at least one neutralization switch.

5. The method according to claim 4, wherein said first to N-th data lines are precharged with one(s) of said first to N-th time division switches other than said associated one of said first to N-th time division switches turned off.

6. The method according to claim 1, wherein when a first to N-th output switches are turned to an off state, the one source output is set into a high impedance state.

7. The method according to claim 1, wherein the associated one time division switch is kept turned on during a time period from a start time of said driving said first pixel to a start time of said driving said second pixel to reduce a total number of switchings performed by the first to N-th time division switches for a predetermined time period.

8. A display panel driver for driving a display panel including a plurality of pixels, first to N-th time division switches and first to N-th data lines disposed along columns of said plurality of pixels, respectively, the display panel driver comprising:

a source output adapted to be connected with said first to N-th data lines through said first to N-th time division switches;

a driver circuit adapted to output drive voltages for driving said plurality of pixels from said source output; and a control circuit adapted to control said first to N-th time divisional switches, wherein said control circuit turns on one of said first to N-th time division switches in a first drive period for driving a first pixel of said plurality of pixels, which is positioned in a first horizontal line and connected with one of said first to N-th data lines, wherein said drive circuit drives said first pixel by feeding a first drive voltage from said source output to said first pixel through said one of said first to N-th time division switches in said first drive period, wherein said control circuit turns on said one of said first to N-th time division switches in a second drive period for driving a second pixel of said plurality of pixels, which is positioned in a second horizontal line next to said first horizontal line and connected with said one of said first to N-th data lines, wherein said drive circuit drives said second pixel by feeding a second drive voltage from said source output to said pixel through said one of said first to N-th time division switches in said second drive period, and wherein said control circuit keeps said one of said first to N-th time division switches turned on during a time period from a timing when said first pixel starts to be driven to a timing when said second pixel stops being driven, wherein a second time division switch is kept turned on through a transition from the second drive period to a third drive period such that at least one of the time division switches is kept turned on periodically for each transition of a drive period.

9. The display panel driver according to claim 8, wherein when a first to N-th output switches are turned to an off state, the one source output is set into a high impedance state.

10. The display panel driver according to claim 8, wherein the associated one time division switch is kept turned on during a time period from a start time of said driving said first pixel to a start time of said driving said second pixel to reduce a total number of switchings performed by the first to N-th time division switches for a predetermined time period.

* * * * *